US012270555B2

(12) United States Patent
Karamanos et al.

(10) Patent No.: US 12,270,555 B2
(45) Date of Patent: Apr. 8, 2025

(54) HVAC DEVICES WITH IMPROVED RADIAX DESIGN AND FUNCTIONALITY

(71) Applicant: Best Technologies, Inc., Reno, NV (US)

(72) Inventors: John C Karamanos, San Jose, CA (US); Herbert Willke, New York, NY (US)

(73) Assignee: BEST TECHNOLOGIES, INC., Reno, NV (US)

( * ) Notice: Subject to any disclaimer, the term of this patent is extended or adjusted under 35 U.S.C. 154(b) by 0 days.

(21) Appl. No.: 18/930,503

(22) Filed: Oct. 29, 2024

(65) Prior Publication Data

US 2025/0052432 A1 Feb. 13, 2025

Related U.S. Application Data

(63) Continuation of application No. 18/516,068, filed on Nov. 21, 2023, which is a continuation of application (Continued)

(51) Int. Cl.
*F24F 13/08* (2006.01)
*F24F 1/0029* (2019.01)

(Continued)

(52) U.S. Cl.
CPC ..... *F24F 1/0029* (2013.01); *F24F 13/0236* (2013.01); *F24F 13/0245* (2013.01);

(Continued)

(58) Field of Classification Search
CPC ..... F24F 13/081; F24F 13/08; F24F 13/24
See application file for complete search history.

(56) References Cited

U.S. PATENT DOCUMENTS 4,986,170 A 1/1991 Ramakrishnan et al.
5,344,069 A 9/1994 Narikiyo (Continued)

OTHER PUBLICATIONS

Non Final office action received for U.S. Appl. No. 16/930,635 dated Feb. 9, 2021, 17 pages.

(Continued)

*Primary Examiner* — Allen R. B. Schult
(74) *Attorney, Agent, or Firm* — Amin, Turocy & Watson, LLP

(57) ABSTRACT

Architectures and techniques are presented that can facilitate improved design and function of certain heating, ventilation, and air conditioning (HVAC) devices. Architectures directed to an improved evase device can be designed with rounded corners that can facilitate, e.g., mitigation of reverse flow that traditionally grows back from corners of a transition from an axial fan to a rectangular duct. Architectures directed to an improved intake device can be designed to limit intake from certain flow directions and to smoothly change flow direction, which can facilitate, e.g., reduction in noise. Architectures directed to an improved fan intake device can be designed to reduce noise without significantly reducing total pressure. Architectures directed to an improved air handler device can be designed to concurrently heat and cool air and to reduce dimensions (e.g., size, weight) that can reduce costs and mitigate shipping and installation difficulties.

20 Claims, 28 Drawing Sheets

Related U.S. Application Data

No. 18/314,420, filed on May 9, 2023, now Pat. No. 11,846,434, which is a continuation-in-part of application No. 17/219,531, filed on Mar. 31, 2021, now Pat. No. 11,674,696, which is a continuation of application No. 16/930,635, filed on Jul. 16, 2020, now Pat. No. 11,346,564.

(51) Int. Cl.
*F24F 13/02* (2006.01)
*F24F 13/20* (2006.01)
*F24F 13/24* (2006.01)

(52) U.S. Cl.
CPC ..... *F24F 13/08* (2013.01); *F24F 13/20* (2013.01); *F24F 13/24* (2013.01); *F24F 2013/242* (2013.01)

(56) References Cited

U.S. PATENT DOCUMENTS

| | | | | |
|---|---|---|---|---|
| 5,453,049 | A | 9/1995 | Tillman, Jr. et al. | |
| 5,522,768 | A | 6/1996 | Brodt et al. | |
| 5,564,626 | A | 10/1996 | Kettler et al. | |
| 5,587,563 | A * | 12/1996 | Yazici | F24F 7/08 181/224 |
| 5,728,979 | A | 3/1998 | Yazici et al. | |
| 6,102,153 | A | 8/2000 | Willke, Jr. | |
| 6,419,576 | B1 * | 7/2002 | Han | F24F 7/007 454/906 |
| 6,802,690 | B2 * | 10/2004 | Han | F04D 29/664 415/208.1 |
| 2001/0011007 | A1 | 8/2001 | Akhtar et al. | |
| 2002/0112673 | A1 | 8/2002 | Lorton et al. | |
| 2002/0182061 | A1 | 12/2002 | Han | |
| 2004/0253918 | A1 | 12/2004 | Ezell et al. | |
| 2007/0087677 | A1 | 4/2007 | Morris et al. | |
| 2008/0070493 | A1 | 3/2008 | Rimmer et al. | |
| 2012/0071082 | A1 | 3/2012 | Karamanos | |
| 2014/0086728 | A1 | 3/2014 | Engert et al. | |
| 2015/0300372 | A1 | 10/2015 | Stephan et al. | |
| 2016/0327287 | A1 | 11/2016 | Sprayberry et al. | |
| 2017/0045255 | A1 | 2/2017 | Karamanos | |
| 2017/0261223 | A1 | 9/2017 | Henderson | |
| 2017/0314796 | A1 | 11/2017 | Kuckuk et al. | |
| 2020/0086369 | A1 | 3/2020 | Rossi | |
| 2021/0348780 | A1 | 11/2021 | Goodman | |

OTHER PUBLICATIONS

Final office action received for U.S. Appl. No. 16/930,635 dated May 19, 2021, 19 pages.
Non Final office action received for U.S. Appl. No. 17/220,380 dated Jun. 30, 2021, 22 pages.
Non-Final Office Action received for U.S. Appl. No. 16/930,635 dated Aug. 2, 2021, 29 pages.
Non-Final Office Action received for U.S. Appl. No. 17/219,531 dated Aug. 12, 2021, 35 pages.
Final office action received for U.S. Appl. No. 17/220,380 dated Nov. 1, 2021, 38 pages.
Final office action received for U.S. Appl. No. 17/219,531 dated Dec. 20, 2021, 46 pages.
Non-Final Office Action received for U.S. Appl. No. 17/219,531 dated Mar. 10, 2022, 64 pages.
Final Office Action received for U.S. Appl. No. 17/219,531 dated Sep. 28, 2022, 76 pages.
Notice of Allowance received for U.S. Appl. No. 17/219,531 dated Feb. 1, 2023, 70 pages.
Notice of Allowance received for U.S. Appl. No. 18/314,420 dated Aug. 9, 2023, 87 pages.
Non-Final Office Action for U.S. Appl. No. 18/935,044 dated Jan. 15, 2025.
Non-Final Office Action for U.S. Appl. No. 18/516,068 dated Feb. 11, 2025.

* cited by examiner

HVAC DEVICES WITH IMPROVED RADIAX DESIGN AND FUNCTIONALITY

RELATED APPLICATION

The subject patent application is a continuation of, and claims priority to each of, U.S. patent application Ser. No. 18/516,068, filed Nov. 21, 2023, and entitled "AIR HANDLER DEVICES WITH U-BEND DESIGN", which is a continuation of U.S. patent application Ser. No. 18/314,420 (now U.S. Pat. No. 11,846,434), filed May 9, 2023, and entitled "AIR HANDLER DEVICES WITH U-BEND DESIGN", which is a continuation-in-part of U.S. patent application Ser. No. 17/219,531 (now U.S. Pat. No. 11,674,696), filed Mar. 31, 2021, and entitled "AIR HANDLER DEVICES WITH IMPROVED DESIGN AND FUNCTIONALITY", which is a continuation of U.S. patent application Ser. No. 16/930,635 (now U.S. Pat. No. 11,346,564), filed Jul. 16, 2020, and entitled "HVAC DEVICES WITH IMPROVED DESIGN AND FUNCTIONALITY", the entireties of which are hereby incorporated by reference herein.

TECHNICAL FIELD

The present disclosure is directed to improved heating, ventilation, and air conditioning (HVAC) design and functionality, and more particularly to a radiax device that can facilitate improved intake of a fluid flow.

BACKGROUND

In several ways, modern air handler devices rely on structural designs or techniques that are many decades old without adequate improvement over that time. As such, improved designs, including those using advanced aero-acoustical physics, can provide much needed and long awaited benefits.

SUMMARY

The following presents a summary to provide a basic understanding of one or more embodiments of the disclosure. This summary is not intended to identify key or critical elements or delineate any scope of the particular embodiments or any scope of the claims. Its sole purpose is to present concepts in a simplified form as a prelude to the more detailed description that is presented later.

According to an embodiment of the present disclosure, an evase device is presented. The evase device can comprise a housing that encompasses a channel. The channel can extend in a longitudinal direction from a first side of the housing to a second side of the housing. The evase device can comprise a first opening that is situated at the first side of the housing. The first opening can be configured to receive a flow of a fluid discharged by a fan. The evase device can comprise a second opening that is situated at the second side of the housing. The second opening can be configured to discharge the flow into a duct. At the second side, the housing can have a rounded corner determined to mitigate a reverse flow of the fluid at corners of the duct.

According to an embodiment of the present disclosure, an intake device (e.g., radiax) is presented. The intake device can, e.g., intake air (or another fluid) for an HVAC system (or another system), and can operate with greatly reduced noise reduction. The intake device can comprise an intake duct. The intake duct can comprise a first opening by which a fluid enters the intake duct and a second opening by which the fluid exits the intake duct. The first opening and the second opening can be substantially circular about a longitudinal axis of the intake duct. A first circumference of the first opening can be larger than a second circumference of the second opening. The intake device can further comprise a top cover. The top cover can prevent the fluid from entering the intake duct in a direction along the longitudinal axis (e.g., vertical). However, the top cover can be situated a distance from the first opening, e.g., to permit the fluid to enter the intake duct in a radial direction that is radial about the longitudinal axis (e.g., horizontal). The intake device can further comprise an inner funnel that can be situated within the inner passageway of the intake duct. The inner funnel can comprise an upper portion that couples to the top cover and a lower portion that extends into the passageway. The inner funnel can comprise an outer surface that spans the upper portion and the lower portion. The outer surface can be sloped, causing the flow of the fluid entering the intake duct in the radial direction to change to the direction along the longitudinal axis.

According to an embodiment of this disclosure, an aero-acoustical fan intake device is presented (e.g., uniax). The fan intake device can, e.g., represent an intake for air (or another fluid) for a fan of an HVAC system (or another system), and can operate with greatly reduced acoustical (e.g., noise) reduction without significant aerodynamic loss. The fan intake device can comprise an inlet face. The inlet face can comprise an inlet opening configured to receive a flow of a fluid. The fan intake device can further comprise a discharge face. The discharge face can comprise a discharge opening configured to discharge the flow of the fluid. Further still, the fan intake device can comprise a housing. The housing can encompass a flow channel that extends from the inlet opening to the discharge opening. Significantly, a cross-sectional area of the flow channel can vary between the inlet opening and the discharge opening in a manner that is determined to cause the flow of the fluid through the flow channel to continuously accelerate from a first location of the channel to the discharge opening.

According to a first embodiment of this disclosure, an air handler device is presented. The air handler device can comprise a mixing plenum. The mixing plenum can be configured to receive multiple flows of air from multiple different ducts that feed the mixing plenum. The air handler device can comprise a fan device. The fan device can be configured to receive a mixing plenum flow from the mixing plenum and to discharge a supply flow. The air handler device can further comprise a supply plenum. The supply plenum can be configured to receive the supply flow from the fan device. The supply plenum can comprise a plurality of duct interfaces. The duct interfaces can be respectively configured to interface with a different one of a plurality of supply ducts. The supply plenum can further comprise a plurality of thermal transfer units comprising a first thermal transfer unit and a second thermal transfer unit. The plurality of thermal transfer units can be respectively situated in different ones of the plurality of duct interfaces. Furthermore, the first thermal transfer unit can be configured to heat a first air flow concurrently with the second thermal transfer unit cooling a second air flow.

According to a second embodiment of this disclosure, another air handler device is presented. This air handler device (as well as the first air handler device) can be part of an HVAC product. The air handler device can be configured to circulate a flow of air within an HVAC system situated at a site the HVAC product is to be installed. The air handler device can comprise a top surface that is, relative to an installation at the site, on top of the air handler device. The air handler device can have a first height that is, relative to the installation, a height of the air handler device. The HVAC product can further comprise a heat exchange device that can be configured to exchange heat with the flow of air. The heat exchange device can have a second height that is, relative to the installation, a height of the heat exchange device. Further, the heat exchange device can be situated on the top surface of the air handler device, resulting in the HVAC product having a total height that is, relative to the installation, determined to be less than or equal to a defined height constraint In some embodiments, elements described in connection with the systems and apparatuses above can be embodied in different forms such as a computer-implemented method of fabrication, or another form.

DETAILED DESCRIPTION

Figure 1:
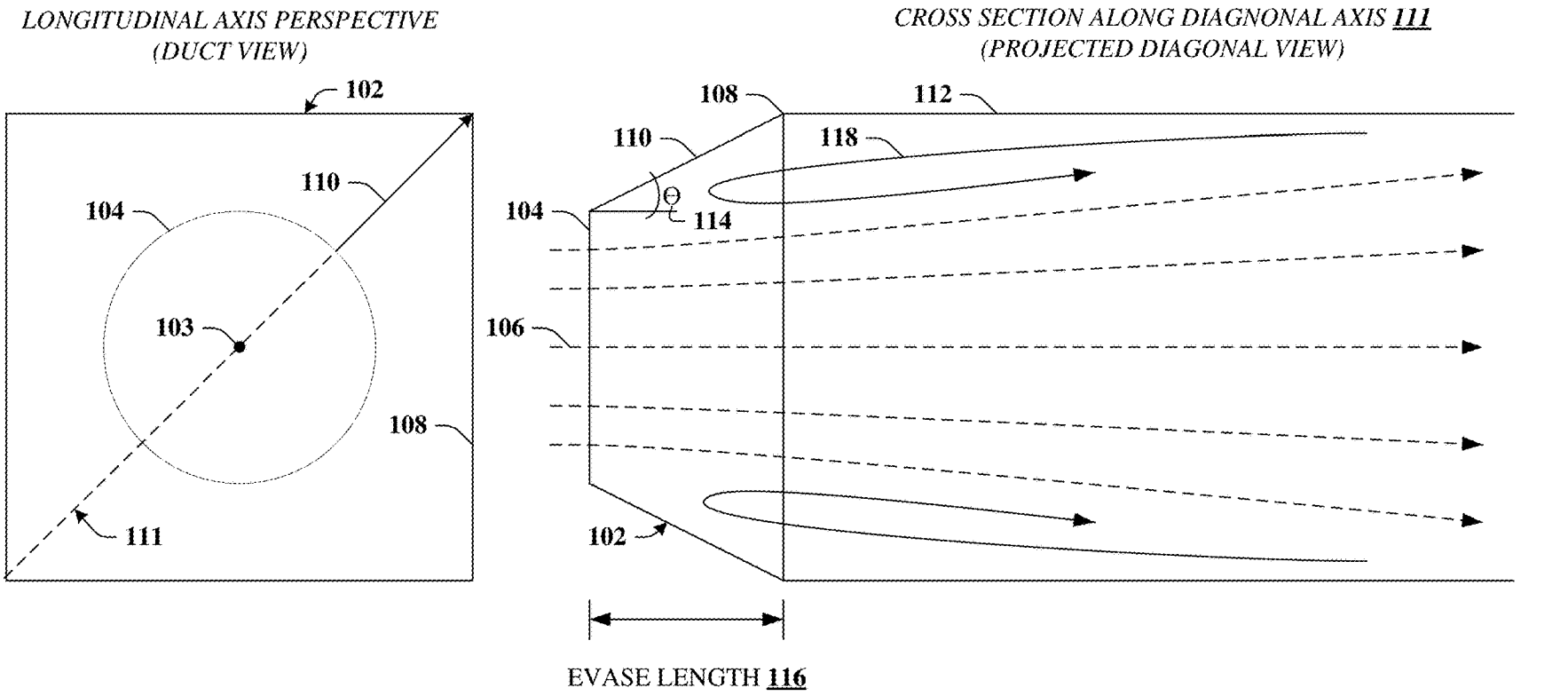
FIG. 1 illustrates a block diagram of two example views of an evase are depicted in accordance with certain embodiments of this disclosure.

The disclosed subject matter is now described with reference to the drawings, wherein like reference numerals are used to refer to like elements throughout. In the following description, for purposes of explanation, numerous specific details are set forth in order to provide a thorough understanding of the disclosed subject matter. It may be evident, however, that the disclosed subject matter may be practiced without these specific details. In other instances, well-known structures and devices are shown in block diagram form in order to facilitate describing the disclosed subject matter.

Example Evase Apparatus

Referring now to the drawings, with initial reference to FIG. 1, a block diagram 100 of two example views of an evase are depicted in accordance with certain embodiments of this disclosure. In the HVAC domain, an evase can operate as a duct transition. For instance, the evase can connect a fan outlet, typically circular in shape to match fan impeller sweep, to a supply duct that is typically larger in size and rectangular in shape. This duct size and shape transition can lead to undesired consequences, some of which are discussed in connection with evase 102.

The left side of FIG. 1 illustrates a longitudinal axis perspective of evase 102, for instance a view as seen from the duct, with the longitudinal axis that extends into the page and intersects at point 103. Evase 102 can comprise inlet 104 that is circular in shape and can be configured to receive a flow of a fluid discharged by a fan (not shown). Evase 102 can further comprise outlet 108 that is rectangular in shape and can be configured to discharge the fluid into a supply duct (see duct 112).

The right side of FIG. 1 depicts evase 102 from the perspective of a cross-section along diagonal line 111 that runs from the top-right corner to the bottom-left corner, which can represent a projected diagonal view. Circular inlet 104 receives a flow of fluid from the fan, which is illustrated by fluid flow lines 106 (dashed lines). Because outlet 108 is larger in size, the fluid gradually expands through the interior chamber of evase 102. This gradual expansion continues well into duct 112.

As shown, a longest distance 110 between inlet 104 and outlet 108 is represented by some point on the circular ring of inlet 104 to a rectangular corner of the outlet. Distance 110 can represent a significant factor in the efficacy of evase 102 because it can approximately represent a potentially longest path for the flow of fluid through evase 102. Based on ordinary geometric principles, angle 114 is a function of and therefore constrained by evase length 116 and distance 110.

Further, due to the velocity of the fluid discharged by the fan, a common situation arises in other evase devices such as evase 102 in which angle 114 is too large to facilitate fluid flow to flow along longest path 110. As a result, significant reverse flow 118 arises. This reverse flow 118 leads to a number of disadvantages.

For example, in conventional systems, a decrease in kinetic energy between the fan discharge and larger downstream duct is entirely lost, being converted into heat carried by the flow. The effective fan efficiency is greatly reduced, in some cases by nearly 50%. To account for this loss, a larger fan motor than would otherwise be required is generally utilized and/or the fan is operated at a higher revolutions per minute (RPM) than needed otherwise. Generally, higher operating RPM's mean a noisier equipment room and reduced motor lifetime.

Further, because HVAC systems are generally configured to supply cool air to the building, the heating of the flow outlined above requires either increasing the total flow to obtain the same cooling effect from the warmer air or lowering heat rejection temperature to compensate for that extra heat. In any case the extra heat places an additional burden on the thermal rejection system, which must also extract heat equal to the heating caused by the evase energy loss. Poor evase efficiency is paid for by increased operating cost for the fan and heat rejection sections.

Further still, practical HVAC systems rarely have sufficient space (e.g., 5 to 10 duct diameters of duct length) required for the flow to straighten out downstream of the ineffective evase. In practice the flow is often turned and/or divided almost immediately following the evase. The non-uniform flow increases losses in turns and will not follow the geometry of a split unless downstream dampers are feathered to limit flow to the favored channel, contributing to additional losses to the system together with additional noise from dampers up in the ceiling space, which can adversely affect occupants below the dampers.

Figure 2:
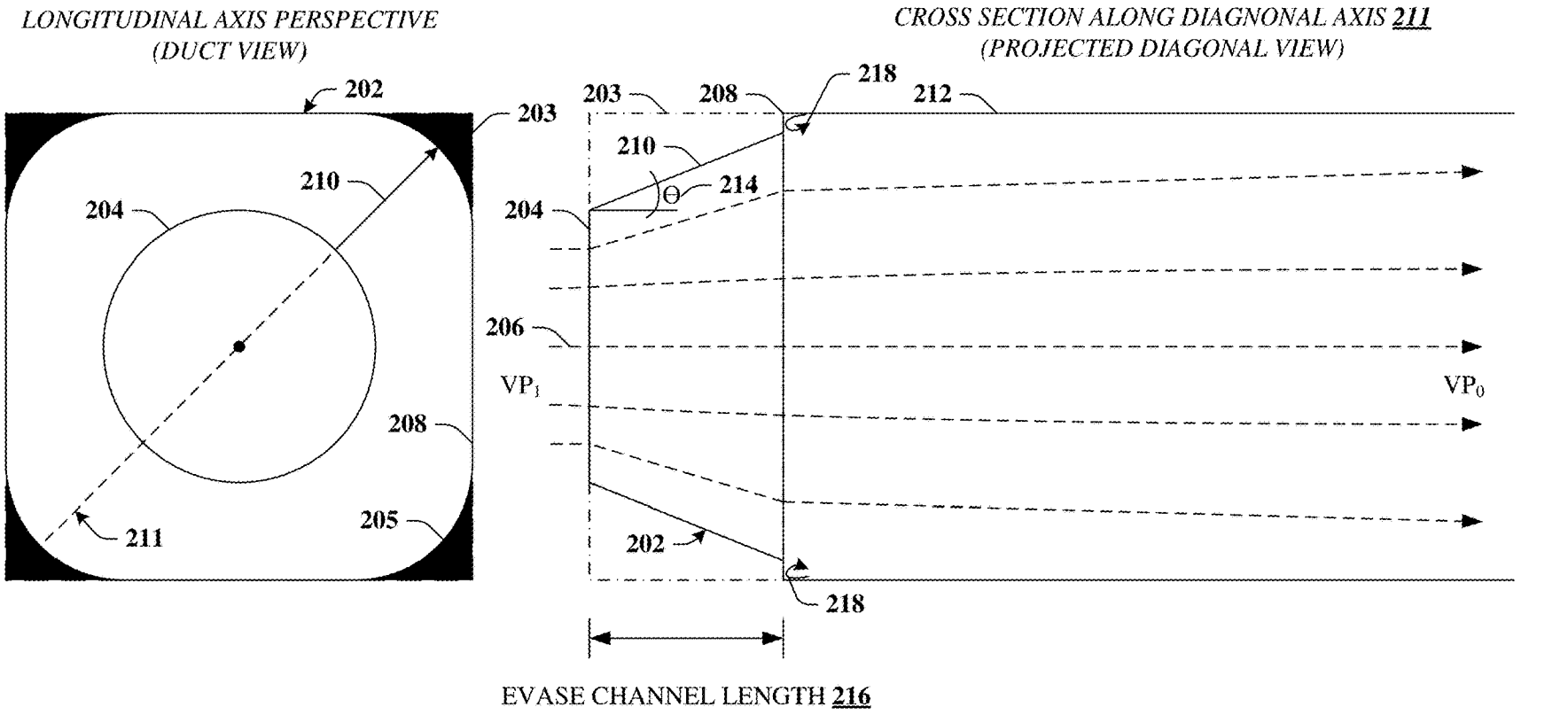
FIG. 2 illustrates a block diagram of two example views of an improved evase design in accordance with certain embodiments of this disclosure.

Referring now to FIG. 2, a block diagram 200 of two example views of an improved evase design are depicted in accordance with certain embodiments of this disclosure. In that regard, a longitudinal axis perspective of evase 202 is illustrated on the left side of FIG. 2, while the right side of FIG. 2 depicts a cross-section along diagonal line 211 that runs from the top-right corner to the bottom-left corner, which can represent a projected diagonal view. Evase 202 can comprise housing 203 shown in dashed lines. Housing 203 can encompass a channel that extends in a longitudinal direction from a first side (e.g., inlet side) of housing 203 to a second side (e.g., outlet side) of housing 203. A length of this channel is illustrated by reference numeral 216.

Evase 202 can further comprise first opening 204 situated at the first side of housing 203 (e.g., inlet side). First opening 204 can be configured to receive a flow 206 (e.g., indicated by dashed lines) of a fluid discharge by a fan. As depicted, first opening can have a circular shape that can match or scale to the fan or impeller blades of the fan, however first opening 204 can be any suitable shape.

Evase 202 can further comprise second opening 208. Second opening 208 can be situated at the second side of housing 203 (e.g., outlet side). Second opening 208 can be configured to discharge flow 206 into duct 212. Advantageously, at second opening 208, housing 203 can have rounded corners 205. Rounded corners 205 can be configured to or determined to mitigate a reverse flow (e.g., see reverse flow 118 of FIG. 1) at corners of duct 212. In some implementations, reverse flow 118 can be entirely prevented, while in other cases reverse flow 118 can be significantly reduced, resulting in much smaller effective reverse flow shown here at reference numeral 218.

In more detail, duct 212 can have a rectangular shape and corners of duct 212 can be squared corners. As evase 202 can be coupled to duct 212 and/or serve as an interface to duct 212, corners of an exterior portion of housing 203 can be rectangular shaped that can be variably sized to correspond to or match a size and shape of duct 212. However, an interior portion of housing 203 can exhibit rounded corners 205.

By way of comparison with evase 102 of FIG. 1, due to rounded corners 205, length 210 is shorter than the corresponding length 110 of FIG. 1, the latter of which extends to the corner of duct 112. Assuming channel length 216 is approximately the same as length 116 (which is often a physical constraint of a given system or customer site), one result of length 210 being shorter is that angle 214 is less than angle 114. As such, flow 206 can readily flow through a larger volume of both the evase channel and duct 212 instead of being more inclined flow in regions not much larger than opening 104 until much farther downstream of duct 112, as shown in FIG. 1.

In some embodiments, a shape of rounded corners 205 is determined or designed based on a Reynolds number calculation. It is appreciated that the fluid discharged by the fan can have a velocity pressure that is converted to static pressure less an impact loss. In some embodiments, the shape of rounded corners 205 can be determined to reduce this impact loss and therefore cause a net positive change in static pressure.

It is appreciated that the shape of rounded corners 205 in this example is representative of a square shaped housing 203 with a suitably sized duct 212. In other embodiments, housing 203 and/or ducts 212 might be different shapes, for example, rectangular in shape. In those cases, and further based on a difference between sizes or shapes of housing 203 and duct 212, the prominence of rounded corners 205 can differ from what is depicted in this example. For instance, consider the case of a more rectangular shape in which a width of the longitudinal axis perspective is greater than the height. In that case, rounded corners 205 can have a similar height to what is depicted, but with a greater length. At some threshold, the rounded corners 205 may meet one of the two neighboring rounded corners 205. For example, both of the rounded corners 205 at the top of the figure can intersect with those at the bottom of the figure, causing the shape of the opening to resemble a flattened oval. In other embodiments, such as when a given rounded corner 205 intersects with both neighboring rounded corners 205, the shape of the opening can resemble a circle. These different shapes, as well as other suitable shapes are considered to be within the scope of the disclosed subject matter.

To continue the above description, when comparing evase 102 (e.g., comprising squared corners) to evase 202 (e.g., comprising rounded corners 205), a change in static pressure ($\Delta SP$) is expected to be zero. In contrast, $\Delta SP$ for evase 202 can be a function of a difference between a velocity pressure (VP) at first opening 204 (e.g., $VP_1$) and a VP within the duct 212 at some defined distance downstream of evase 202 (e.g., $VP_0$). As one example, $\Delta SP$ can equal $8*(VP_1-VP_0)$. This can reduce utilized fan horsepower by 20-30%, sometimes allowing selection of the next smaller motor size, which can significantly reduce costs and overhead.

Furthermore, certain disadvantages listed above with respect to other systems (e.g., evase 102) are reversed for improved evase 202. For instance, evase 202 can result in reduced fan RPM's and installed horsepower, quieter equipment rooms, longer motor life, and more even discharge flow so that elbows and splitters work more efficiently. In addition, heat rejection load can be reduced. Both fan and heat rejection operating costs are reduced.

While not shown here, in some embodiments, evase 202 can further comprise an intermediate baffle that can further enhance advantages discussed herein, which is further detailed in connection with FIGS. 4 and 5. Further, in some embodiments, some portions of housing 203 or another housing or container can be filled with a material that absorbs sound, which is also discussed in more detail in connection with FIG. 4.

As previously noted first opening 204 can have a circular or annular shape. In some embodiments, this circular or annular shape can have a diameter that corresponds to or matches an impeller hub diameter of the fan. In some embodiments, the fan can be mounted to or embedded in housing 203, which is further detailed in connection with FIG. 6

Figure 3:
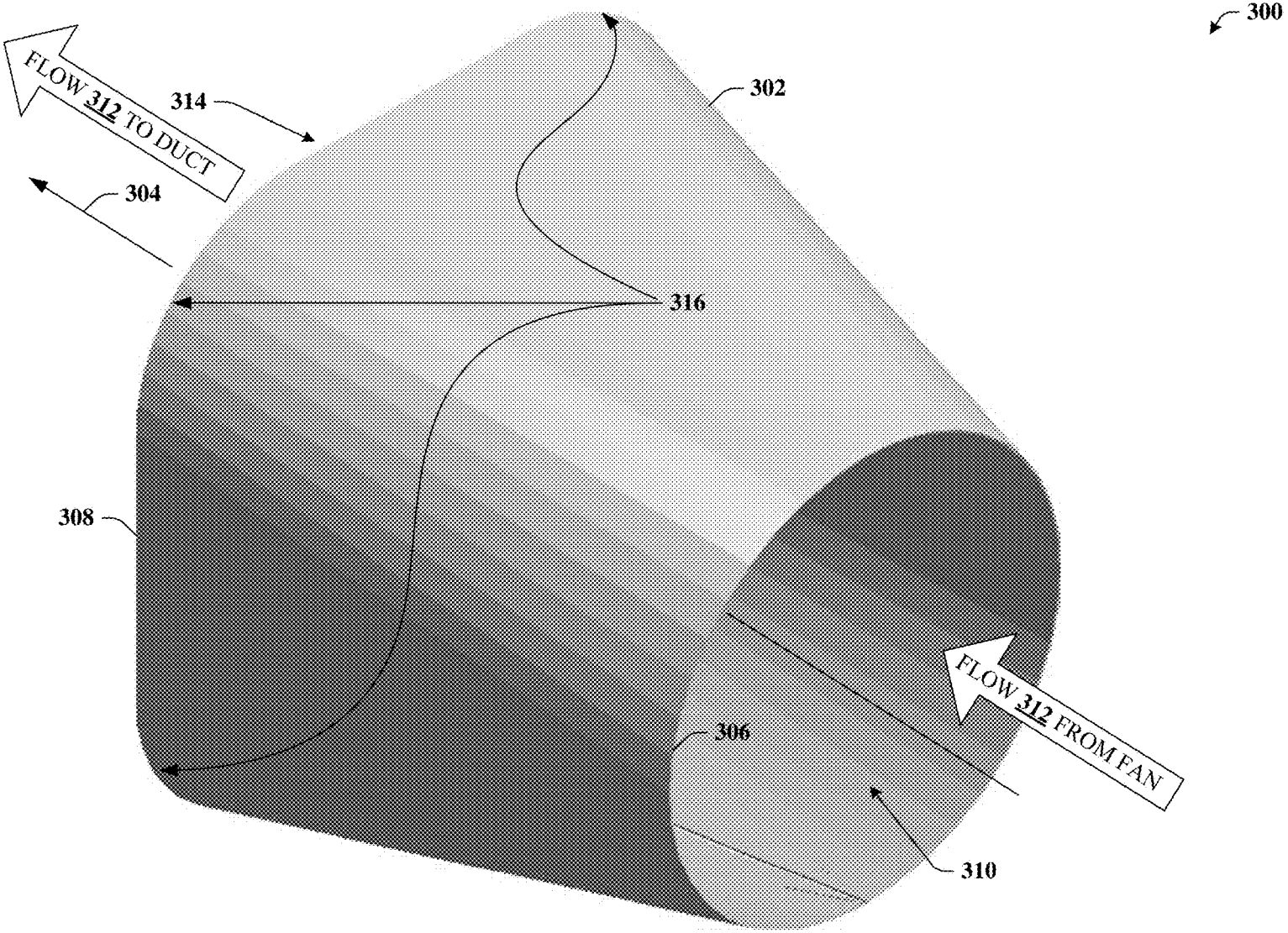
FIG. 3 illustrates a three-dimensional graphical depiction of a first example improved evase device is illustrated in accordance with certain embodiments of this disclosure.

Turning now to FIG. 3, a three-dimensional graphical depiction of a first example improved evase device 300 is illustrated in accordance with certain embodiments of this disclosure. As illustrated, evase device 300 can comprise housing 302 that encompasses a channel (e.g., in which fluid flows) that extends in a longitudinal direction. This longitudinal direction can be represented by longitudinal axis 304 and the channel can extend from first side 306 of housing 302 (e.g., right hand side) to second side 308 of housing 302 (e.g., left hand side).

Evase device 300 can comprise first opening 310 situated at first side 306 of housing 302. First opening 310 can be configured to receive flow 312 of a fluid discharged by a fan. Evase device 300 can further comprise second opening 314 situated at second side 308 of housing 302. Second opening 314 can be configured to discharge flow 312 into a duct. Beneficially, at second side 308, housing 302 has one or more rounded corners 316. Rounded corners 316 can be determined to mitigate a reverse flow of the fluid that might otherwise occur at corners of the duct.

Figure 4:
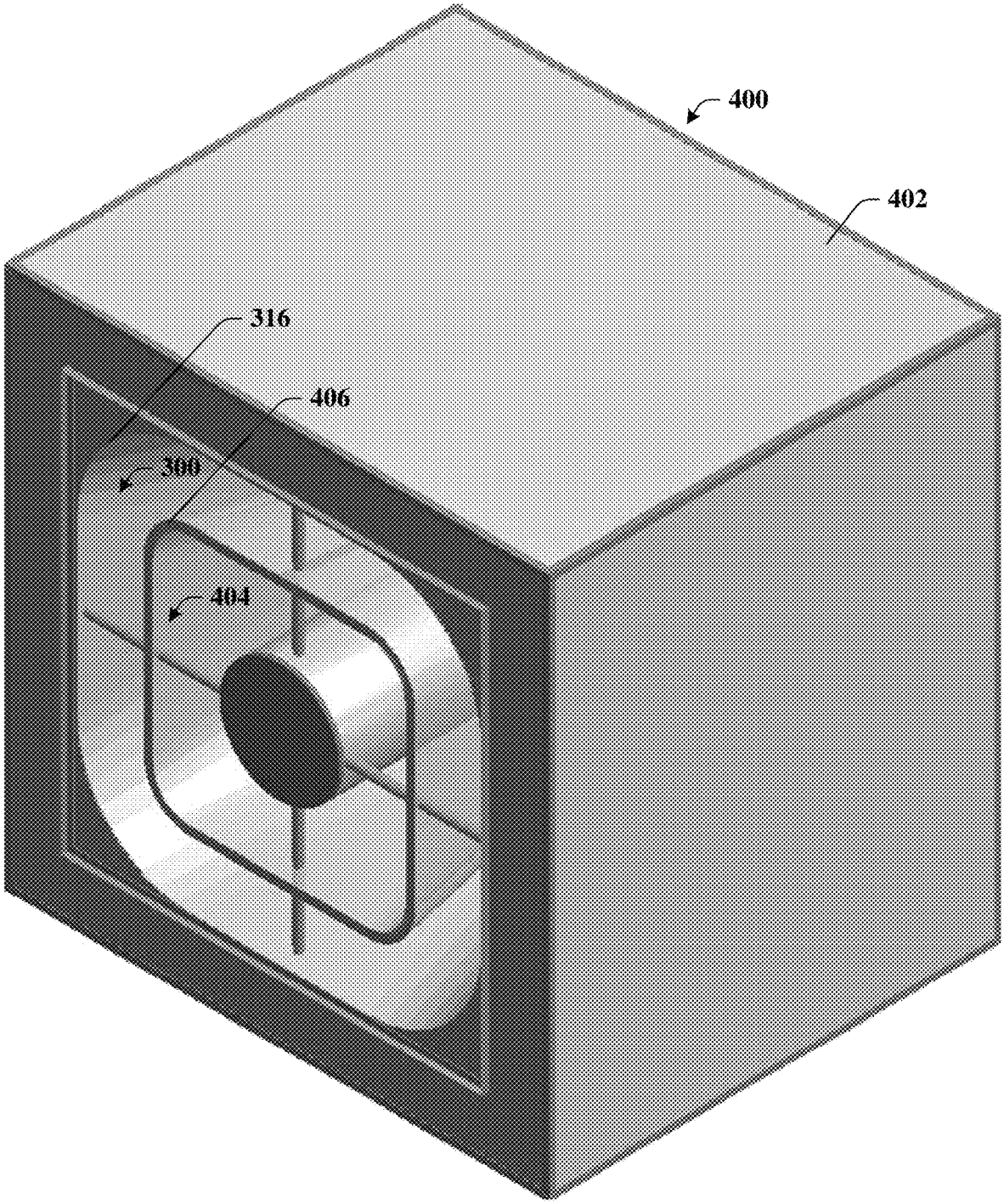
FIG. 4 illustrates a three-dimensional graphical depiction of a second example improved evase device is illustrated in accordance with certain embodiments of this disclosure.

Referring now to FIG. 4, a three-dimensional graphical depiction of a second example improved evase device 400 is illustrated in accordance with certain embodiments of this disclosure. As illustrated, evase device 400 comprises all or a portion of example evase device 300. In this view rounded corners 316 can be seen. In addition, evase device 400 comprises an exterior housing 402 that encloses evase device 300 and other elements. Housing 402 can further include a material that absorbs or mitigate sound.

In addition, evase device 400 can further include an intermediate baffle 404. Intermediate baffle 404 can further improve functional advantages such as improving mitigation of reverse flow 116. Intermediate baffle 404 can operate reduce necessary length (e.g., evase channel length 216) of the evase by about half. For example, by including intermediate baffle 404, evase channel length 216 can be about half the size as what might otherwise be needed in order to effectuate proper flow with mitigated reverse flow. Such can be a significant advantage, particularly in implementations where there is not a lot of space at the installation site for an evase device Intermediate baffle 404 can operate to guide the outer portion of the flow to expand at nearly twice the angle (e.g., angle 214) otherwise possible without engendering complete flow separation from the rapidly expanding outer boundaries. Intermediate baffle 404 can also provides superior sound attenuation by placing additional absorption material in the middle of the flow where the outer and inner sound absorbing materials are least effective. As illustrated, intermediate baffle 404 can also exhibit or comprise rounded corners 406. Rounded corners 406 of intermediate baffle 404 can exhibit the same or a different gradient as rounded corners 316 of evase device 300, either of which can be based on a Reynolds number calculation.

Figure 5:
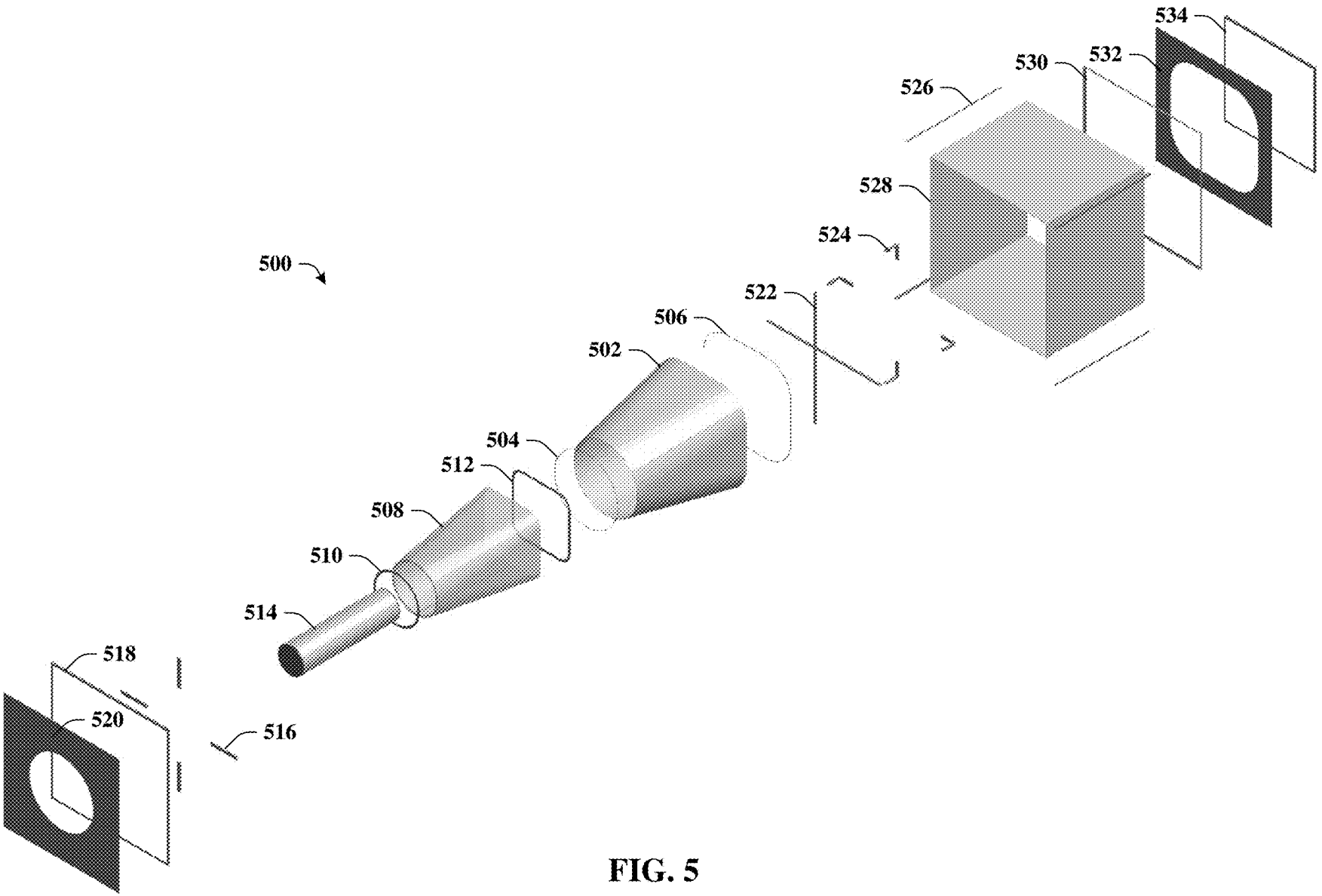
FIG. 5 illustrates a graphical depiction of a first system that can be representative of an example exploded view of an example improved evase device in accordance with certain embodiments of this disclosure.

Turning now to FIG. 5, a graphical depiction illustrates system 500 that can be representative of an example exploded view of evase device 400 in accordance with certain embodiments of this disclosure. In this example, additional elements of evase device 400 can be identified. It is appreciated that evase device 400 can contain all or only a portion of elements described in connection with system 500, which are intended to be exemplary or representative, but also non-limiting. For instance, other elements may be present and certain elements discussed here may be optional or excluded.

System 500 can include evase 502, which can be substantially similar to evase 300. At opposing sides of evase 502, the device can be coupled to interface elements such as annular fan interface element 504 and rectangular duct interface element 506. Elements 504 and 506 can essentially line opposing openings (e.g., first opening 306 and second opening 308. Hence, rectangular duct interface element 506 can exhibit rounded corners that match or correspond to rounded corners 316.

System 500 can include intermediate baffle 508, which can be substantially similar to intermediate baffle 404. Likewise intermediate baffle 508 can be coupled to interface elements 510 and 512 that are situated on opposing sides of intermediate baffle 508. When assembled, intermediate baffle 508 can fit inside evase device 502 and a central axis (e.g., longitudinal axis 304) can be include central pod 514. Sizing for central pod 514 can match the impeller hub, eliminating the impact loss that otherwise occurs at the impeller hub region, and which can be built into the fan curves according to testing. A fan tested at, e.g., 78% efficient may become, e.g., 83% efficient, representing a 5-10% increase in efficiency. Central pod 514 may be conical in shape, resulting in a smaller area at the discharge, further reducing impact losses. The net effect of central pod 514 can translate to an 80% to 90% recovery of the impact loss behind the impeller hub.

Support for the assembled elements at the intake side can be provided by support elements 516, while similar support at the opposing side can be provided by support elements 522. Rectangular frame 518 and intake side face plate 520 can further be assembled.

On the opposing side (e.g., discharge side), L-shaped support elements 524 and support rod elements 526 can be assembled. These support elements (e.g., 522, 524, and 526) can provide support, such as support for elements fitted inside housing 528, which can include evase 502, intermediate baffle 508, and central pod 514. System 500 can further include discharge side rectangular frame 530, discharge side face plate 532 and top frame 534.

Figure 6:
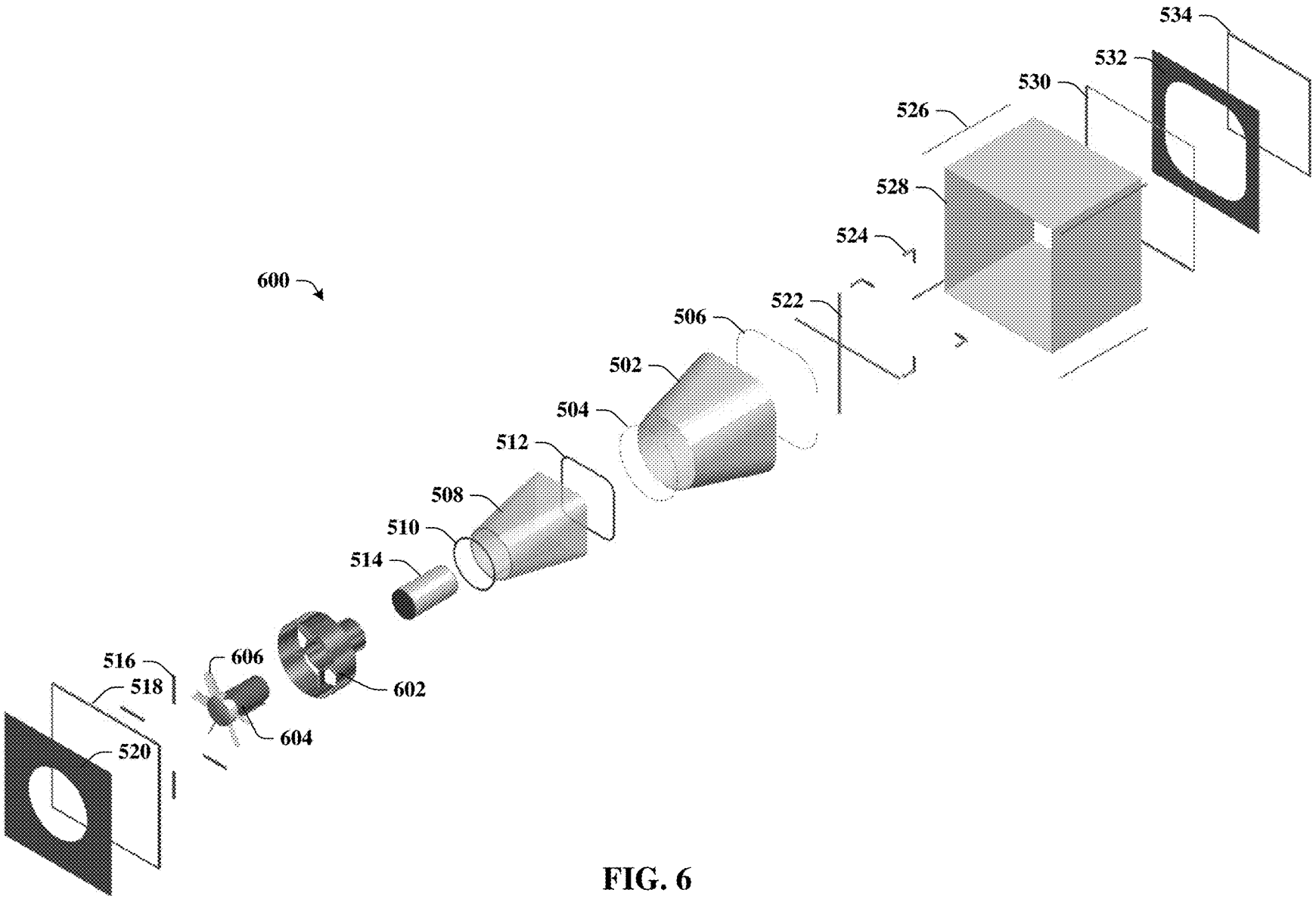
FIG. 6 illustrate a graphical depiction of a second system that can be representative of an example exploded view of an example improved evase device with an integrated fan in accordance with certain embodiments of this disclosure.

With reference now to FIG. 6, a graphical depiction illustrates system 600 that can be representative of an example exploded view of evase device 400 with an integrated fan in accordance with certain embodiments of this disclosure. System 600 can include all or a portion of elements detailed in connection with system 500, including all or some portion of elements 502-534. In addition, system 600 can further include an integrated fan.

For example, system 600 can include fan hub 602 that can couple to all or a portion of central pod 514, interface elements 504, 510, intermediate baffle 508, and/or evase 502. As illustrated, impeller housing 602 can include straightening vanes and a sleeve having an impeller hub diameter to contain the motor. System 600 can further include motor 604 and impeller 606. Hence, in some embodiments, housing 528 of evase system 500, or elements therein such as intermediate baffle 508 or evase 502, can operate as a housing for certain elements of the fan, such as motor 604.

As can be observed, in some embodiments, motor 604 can be situated within the interior channel of evase device 300 and/or within an interior channel of intermediate baffle 508, which itself can be situated within the interior channel of evase device 300. In some embodiments, central pod 514 can have dimensions that match or correspond to dimensions of motor 604. In some embodiments, central pod 514 can contain all or portions of motor 604 such that central pod 514 can match up right behind the impeller hub.

Advantageously, situating fan elements (e.g., motor 604, etc.) inside the interior channel of evase device 300 can result in significant space savings, which can further increase the efficacy of evase devices detailed herein. For example, turning back FIG. 2, flow 206 can be considered to begin just behind location of impeller 606. In other systems, where the fan motor is farther upstream, the length of the motor reduces the available length for evase 202 because an evase channel length 216 can be constrained by the locations of the fan and duct 212. However, by placing motor 604 within the channel of evase 202 (or other evase devices detailed herein), evase channel length 216 can be increased by a similar amount. As such, angle 214 can be decreased, which can further prevent or mitigate reverse flow 218 as well as further other advantages detailed herein.

Example Methods of Fabricating an Evase Device

Figure 7:
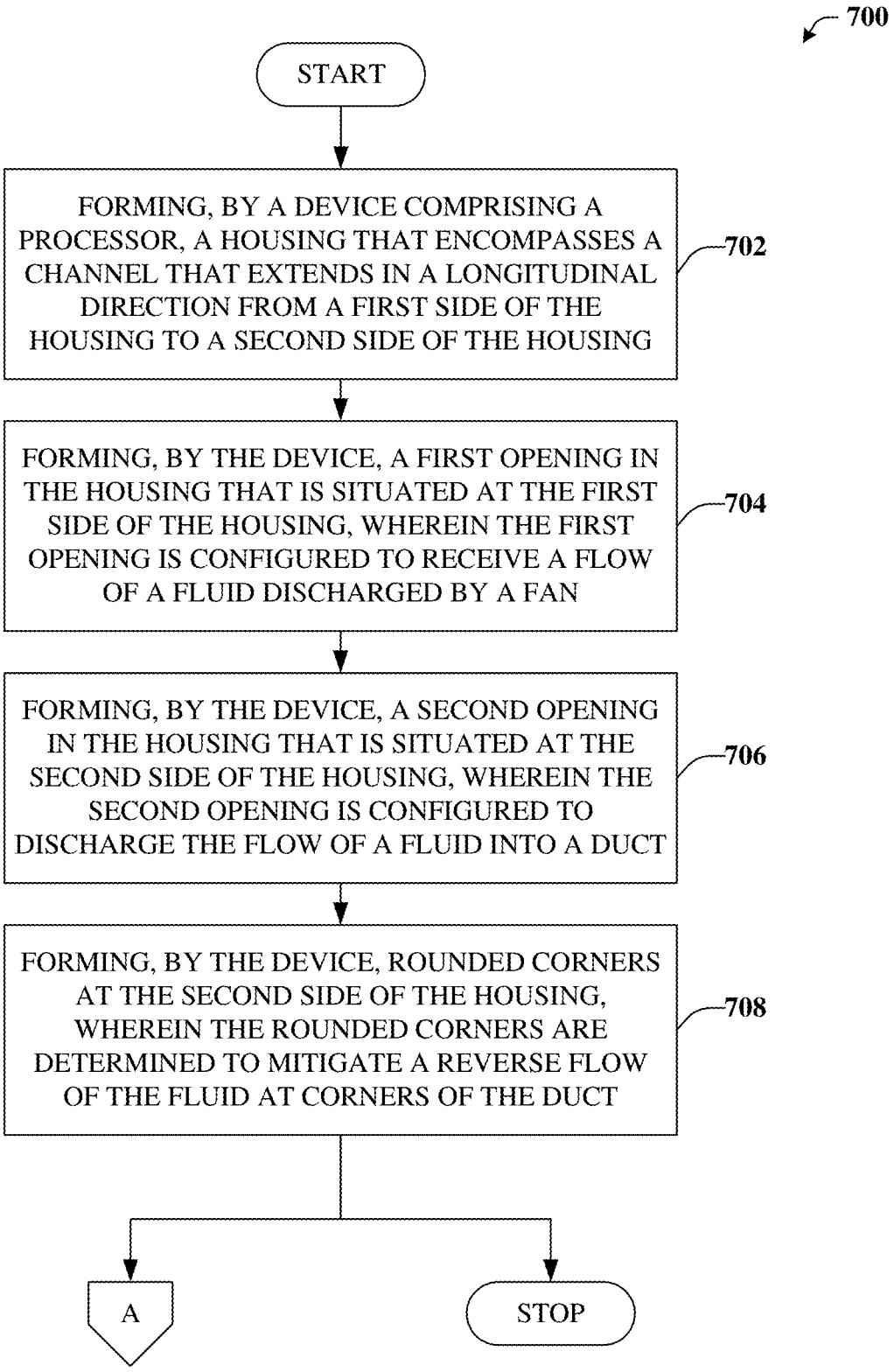
FIG. 7 illustrates a flow diagram of an example, non-limiting method for fabricating an evase device in accordance with one or more embodiments of the disclosed subject matter.
Figure 8:
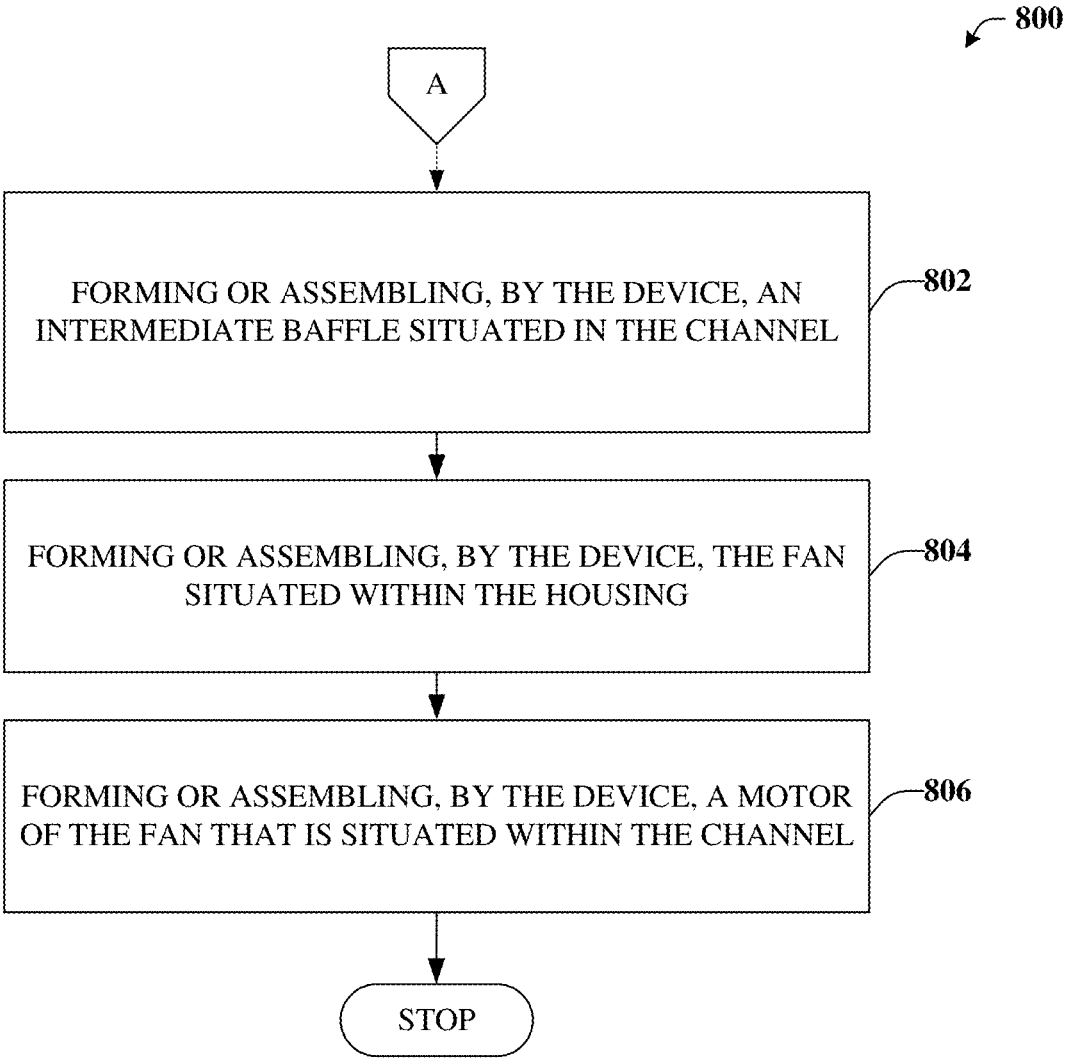
FIG. 8 illustrates a flow diagram of an example, non-limiting method that can provide additional aspects or elements in connection with fabricating an evase device in accordance with one or more embodiments of the disclosed subject matter.

FIGS. 7 and 8 illustrate various methodologies in accordance with the disclosed subject matter. While, for purposes of simplicity of explanation, the methodologies are shown and described as a series of acts, it is to be understood and appreciated that the disclosed subject matter is not limited by the order of acts, as some acts can occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts can be required to implement a methodology in accordance with the disclosed subject matter. Additionally, it should be further appreciated that the methodologies disclosed hereinafter and throughout this specification are capable of being stored on an article of manufacture to facilitate transporting and transferring such methodologies to computers.

FIG. 7 illustrates a flow diagram 700 of an example, non-limiting method for fabricating an evase device in accordance with one or more embodiments of the disclosed subject matter. For example, a device comprising a processor can perform certain operations. Examples of said processor as well as other suitable computer or computing-based elements, can be found with reference to FIG. 24, and can be used in connection with implementing one or more of the devices or components shown and described in connection with figures disclosed herein.

At reference numeral 702, the device comprising the processor can facilitate forming a housing that encompasses a channel. The channel can extend in a longitudinal direction from a first side of the housing to a second side of the housing. As used herein, the term 'forming' can comprise any suitable structural manipulation of a material or element including concepts directed to creating a material or element, structurally manipulating a material or element, or assembling a material or element.

At reference numeral 704, the device can facilitate forming a first opening in the housing that is situated at the first side of the housing, wherein the first opening is configured to receive a flow of a fluid discharged by a fan. In some embodiments, the first opening can be sized to match or correspond to certain elements of a fan, such as an impeller of the fan. In some embodiments, the first side of the housing can be coupled to the fan.

At reference numeral 706, the device can facilitate forming a second opening in the housing that is situated at the second side of the housing, wherein the second opening is configured to discharge the flow of a fluid into a duct. In some embodiments, the second opening can be sized to match or correspond to a duct. In some embodiments, the second side can be coupled to the duct.

At reference numeral 708, the device can facilitate forming rounded corners at the second side of the housing, wherein the rounded corners are determined to mitigate a reverse flow of the fluid at corners of the duct. Method 700 can proceed to insert A, which is further detailed in connection with FIG. 8, or terminate.

Turning now to FIG. 8, illustrated is a flow diagram 800 of an example, non-limiting method that can provide additional aspects or elements in connection with fabricating an evase device in accordance with one or more embodiments of the disclosed subject matter.

At reference numeral 802, the device can facilitate forming or assembling, by the device, an intermediate baffle situated in the channel. In some embodiments, the intermediate baffle can comprise rounded corners at an interface region to the duct. In some embodiments, the intermediate baffle can comprise a central pod situated within a baffle channel.

At reference numeral 804, the device can facilitate assembling or forming the fan situated within the housing. As illustrated at reference numeral 806, in some embodiments, a motor of the fan can be situated within the channel and/or within the baffle channel. In some embodiments, the motor can have dimensions that match or correspond to dimensions of the central pod.

Example Intake Apparatus (e.g., Radiax)

Figure 9:
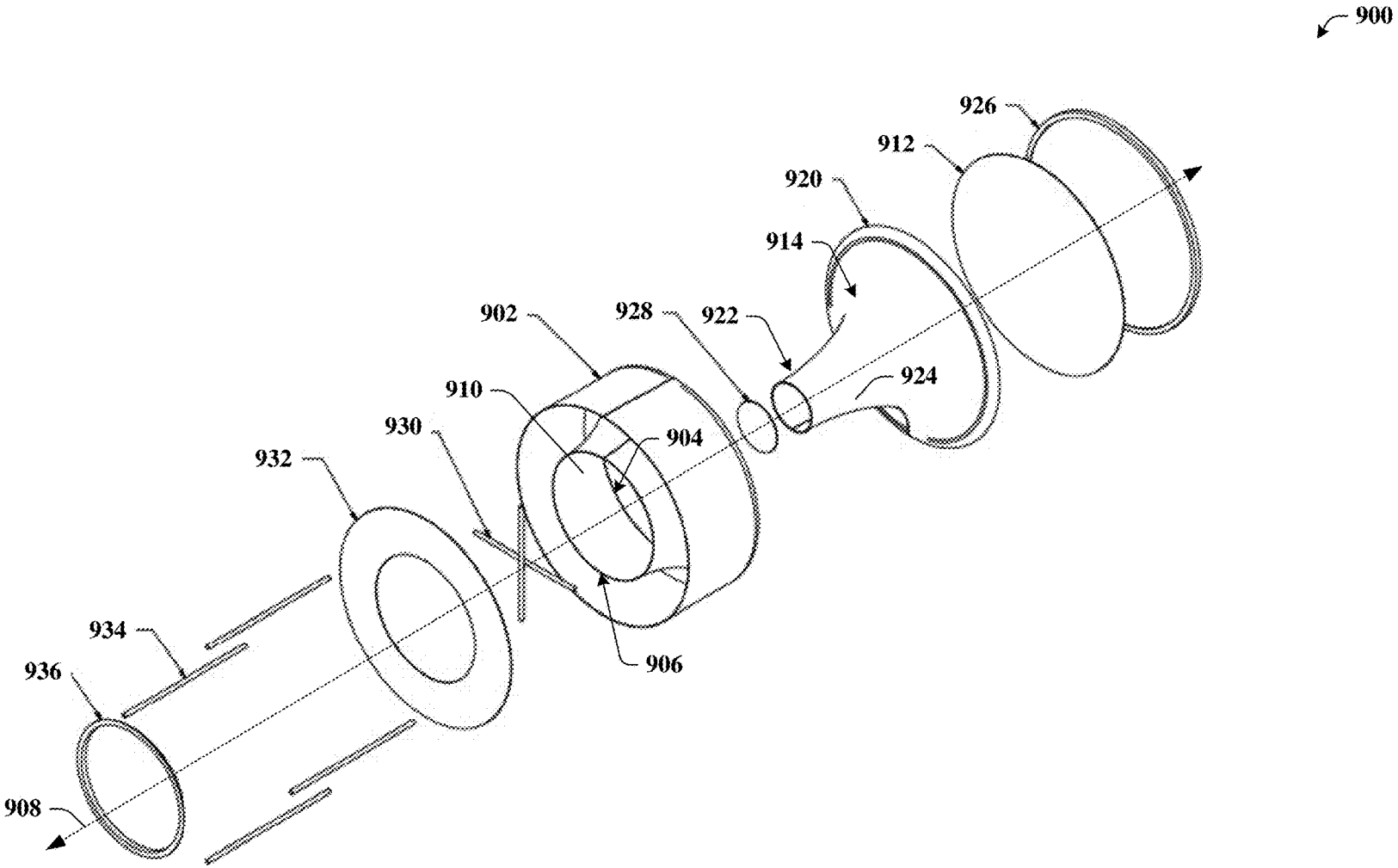
FIG. 9 illustrates a three-dimensional example exploded view of an example improved intake device in accordance with certain embodiments of this disclosure.

Turning now to FIG. 9, a graphical depiction is illustrated of an example three-dimensional exploded view of an improved intake device 900 in accordance with certain embodiments of this disclosure. Intake device 900 can operate as an intake for a fluid, such as outside air, for an HVAC system. It is common practice for HVAC systems to mix outside air with tempered or conditioned air, typically mixed with return air from a controlled environment. However, conventional intake devices suffer from certain disadvantages.

For example, conventional intake device tend to be noisy, especially for large systems and/or large buildings. Standard inlet bell designs tend to be wide open at the inlet or mouth, both acoustically and aerodynamically. These designs can lead to significant acoustical noise issues and aerodynamic losses such that costs are increased. For instance, more energy is consumed and/or a larger system than might otherwise be needed is selected. In contrast, one significant advantage of certain embodiments detailed herein is that the intake flow is not wide open and is turned (e.g., about 90 degrees) and accelerated. This turning flow can mitigate direct acoustic radiation and can do so without introducing significant aerodynamic losses. Furthermore, due in part to the disclosed design elements, the disclosed intake apparatus can be made small enough so that an associated fan can be placed closer to a floor or wall than is possible using a standard inlet bell, which can mitigate potential building HVAC construction or upgrade issues and/or open up new possibilities in that regard.

Figure 10:
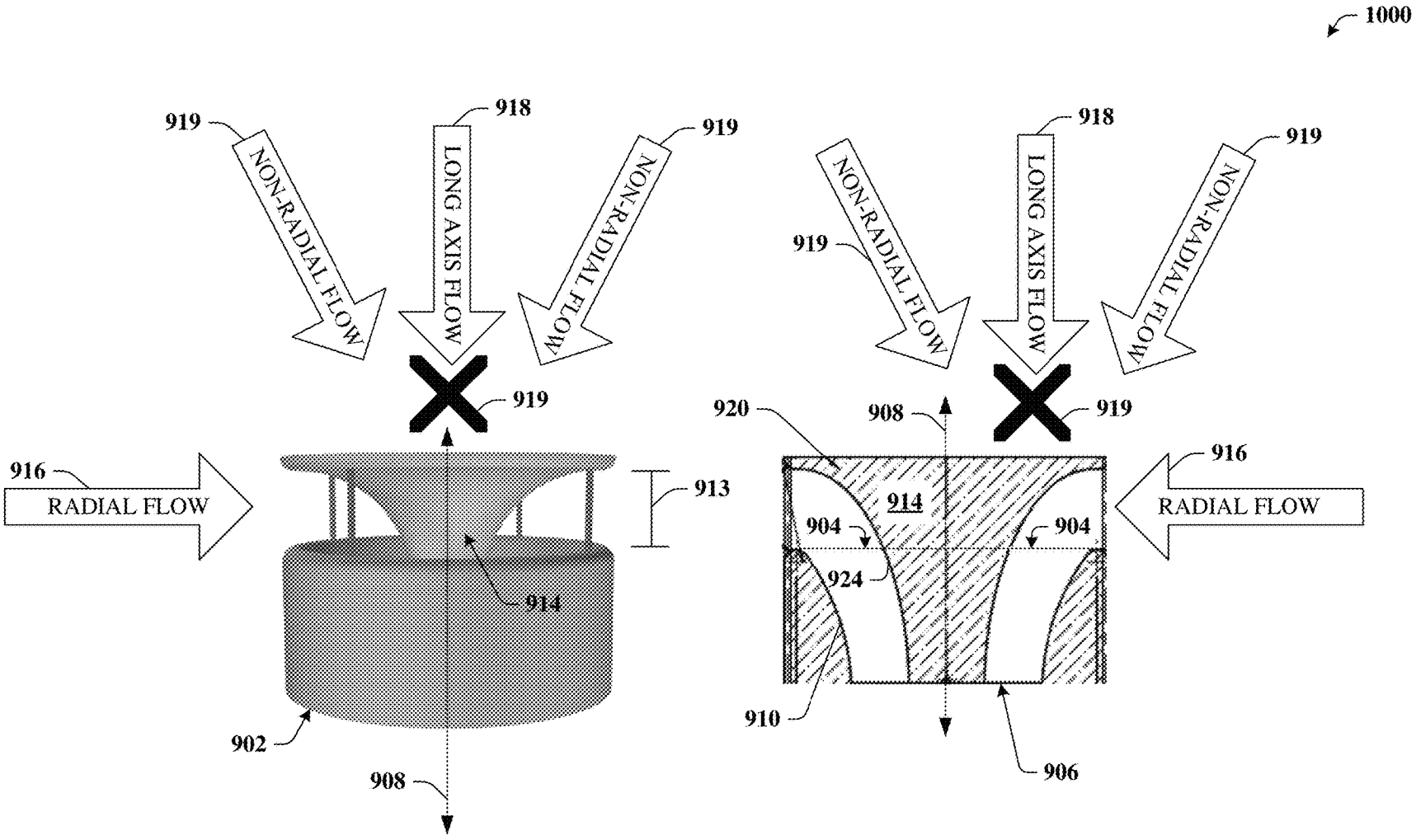
FIG. 10 illustrates graphical depictions of an example three-dimensional view of the improved intake device and a corresponding two-dimensional cross-section view of the improved intake device in accordance with certain embodiments of this disclosure.

FIG. 9 is intended to be referenced in conjunction with FIG. 10, showing graphical depictions 1000 of an example three-dimensional view (left side of page) of an example assembled improved intake device 900 and a corresponding two-dimensional cross-section view (right side of page) of the improved intake device 900 in accordance with certain embodiments of this disclosure.

It is appreciated that intake device 900, which can be referred to herein as a "radiax", "radiax device" or other similar variations, and can contain all or only a portion of elements described, which are intended to be exemplary or representative, but also non-limiting. For instance, other elements may be present and certain elements discussed here may be optional or excluded.

Intake device 900 can comprise intake duct 902. Intake duct 902 can comprise first opening 904 by which a fluid enters the intake duct and second opening 906 by which the fluid exits intake duct 902. First opening 904 and second opening 906 can be substantially circular or annular in shape about longitudinal axis 908 of intake duct 902. It is appreciated that a first circumference of first opening 904 can larger than a second circumference of second opening 906, which is best observed with reference to the cross-section view illustrated by FIG. 10. Intake duct 902 can further comprise interior surface 910. Interior surface 910 can extend from first opening 904 to second opening 906, providing a passageway for a fluid to flow. That second opening 906 is smaller than first opening 904 can be significant for reasons further detailed below such as, for instance, fluid flow through the passageway can undergo acceleration after entering intake duct 902.

Intake device 900 can further comprise top cover 912. Being situated on top, top cover 912 can prevent fluid from entering intake duct 902 in a direction along longitudinal axis 908, which is illustrated by reference numeral 918, showing fluid flow along longitudinal axis 908 being blocked by top cover 912. As illustrated by reference numeral 919, other non-radial flows can also be block by top cover 912. On the other hand, because top cover 912 can be situated some distance 913 away from first opening 904, such can permit the fluid to enter the intake duct 902 in a radial direction that is radial about the longitudinal axis, as illustrated by reference numeral 916.

Intake device 900 can further comprise inner funnel 914. Inner funnel 914 can comprise upper portion 920 that can couple to top cover 912. Inner funnel 914 can comprise lower portion 922 that can extend into the passageway of intake duct 902. Inner funnel 914 can further comprise outer surface 924 that can span from upper portion 920 to lower portion 922. This span of outer surface 924 can be sloped causing the flow entering intake device 900 in the radial direction (e.g., flow 916) to change substantially to the direction along longitudinal axis 908. As can be seen, the passageway of intake duct 902, through which fluid flows, is bounded by the regions between interior surface 910 (of intake duct 902) and outer surface 924 (of inner funnel 914).

In some embodiments, interior surface 910 of intake duct 902 can provide a smoothly tapered surface that encompasses a substantially funnel-shaped passageway for the flow of the fluid. Such is best illustrated by the white regions of the two-dimensional cross-section view illustrated by FIG. 10. As noted, such can create a gradual change in the angle of the fluid flow. In some embodiments, the angular difference of the change in direction of the flow, e.g., representing a difference between the radial direction and the direction along longitudinal axis 908 can be in a range of about 80 degrees to about 100 degrees.

As can be observed in this embodiment, a cross-sectional area of the passageway (e.g., taking slices along longitudinal axis 908), can decrease when moving from first opening 904 to second opening 906. In other words, the passageway narrows are fluid flows farther into intake device 900. In some embodiments, this narrowing can be determined to cause the flow of the fluid in the passageway to increase in velocity and/or to accelerate when flowing toward second opening 906, where the cross-sectional area can be the smallest. This increase in velocity and/or acceleration can be determined to have a damping effect on turbulence flow, which can, inter alia, significantly decrease noise of intake device 900 relative to other intake devices known in the marketplace.

In some embodiments, geometries of outer surface 924 of inner funnel 914 and interior surface 910 of intake duct 902 can be determined to cause the flow to be laminar. A laminar flow can be one that has high momentum diffusion while maintaining low momentum convection. Typically, a laminar flow occurs when the fluid flows in parallel layers with no disruption between them (e.g., no eddies or swirls). In some embodiments, these geometries of outer surface 924 and interior surface 910 can be determined to mitigate losses due to flow separation along bounding surfaces of a turning flow (e.g., the flow that is turning within intake device 900). The turning flow can represent the flow entering in the radial direction 916 and turning toward the longitudinal direction 908. In some embodiments, these geometries are determined to cause at least a portion of the flow entering intake device 900 to follow an elliptical path when changing from radial direction 916 to the direction along longitudinal axis 908.

In addition to elements detailed above, in some embodiments, intake device 900 can optionally include several other elements that are now described. For example, intake device 900 can include angled cover support 926 that can couple to top cover 912 and can include bottom funnel cover 928 that can attach to lower portion 922 of inner funnel 914. Intake device 900 can further include center support structure 930 that can couple to one or both inner funnel 914 and intake duct 902. For instance center support structure 930 can support the positioning or orientation of inner funnel 914 within the passageway of intake duct 902. Further, intake device 900 can include bottom duct cover 932 that can couple to a bottom side of intake duct 902. Support rods 934 and angled ring 936 can also be included in intake device 900.

It is appreciated that in some embodiments, interior portions of inner funnel 914 and interior portions of intake duct 902 can be filled with a material that absorbs or mitigates noise or sound. For example, one or both inner funnel 914 and intake duct 902 can be filled with fiberglass or another material having sound absorption properties.

Figure 11:
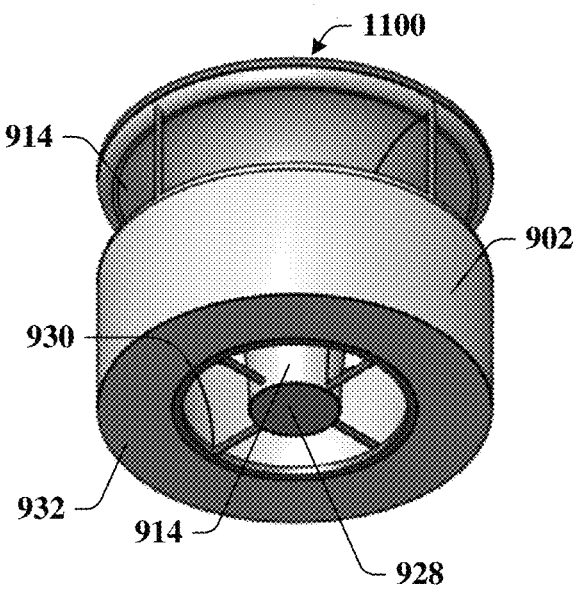
FIG. 11 illustrates a three-dimensional graphical depiction of an example improved intake device from a lower perspective showing a discharge of the intake device in accordance with certain embodiments of this disclosure.

Turning now to FIG. 11, a three-dimensional graphical depiction of an example assembled intake device 1100 is illustrated from a lower perspective showing a discharge of the intake device in accordance with certain embodiments of this disclosure. In this example, intake duct 902 is prominent and shown from the lower perspective. Inner funnel 914 is apparent both at the intake region (e.g., upper portion 920) and the discharge region (e.g., lower portion 922). Center support structures 930 that can to support inner funnel 914 within the passageway of intake duct 902 can also be observed from this perspective, as well as bottom duct cover 932 and bottom funnel cover 928.

Example Methods of Fabricating an Intake Device

Figure 12:
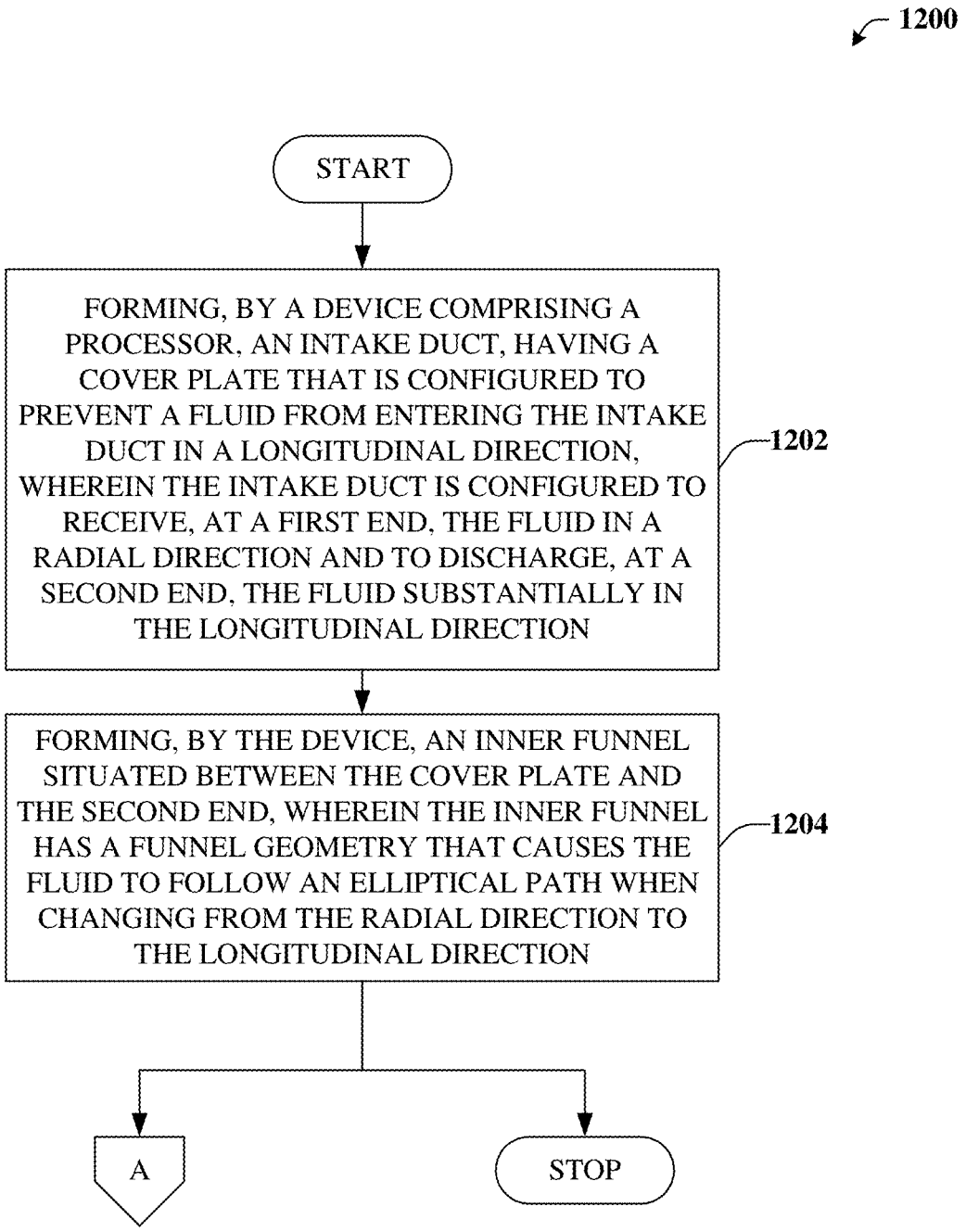
FIG. 12 illustrates a flow diagram of an example, non-limiting method for fabricating an intake device in accordance with one or more embodiments of the disclosed subject matter.
Figure 13:
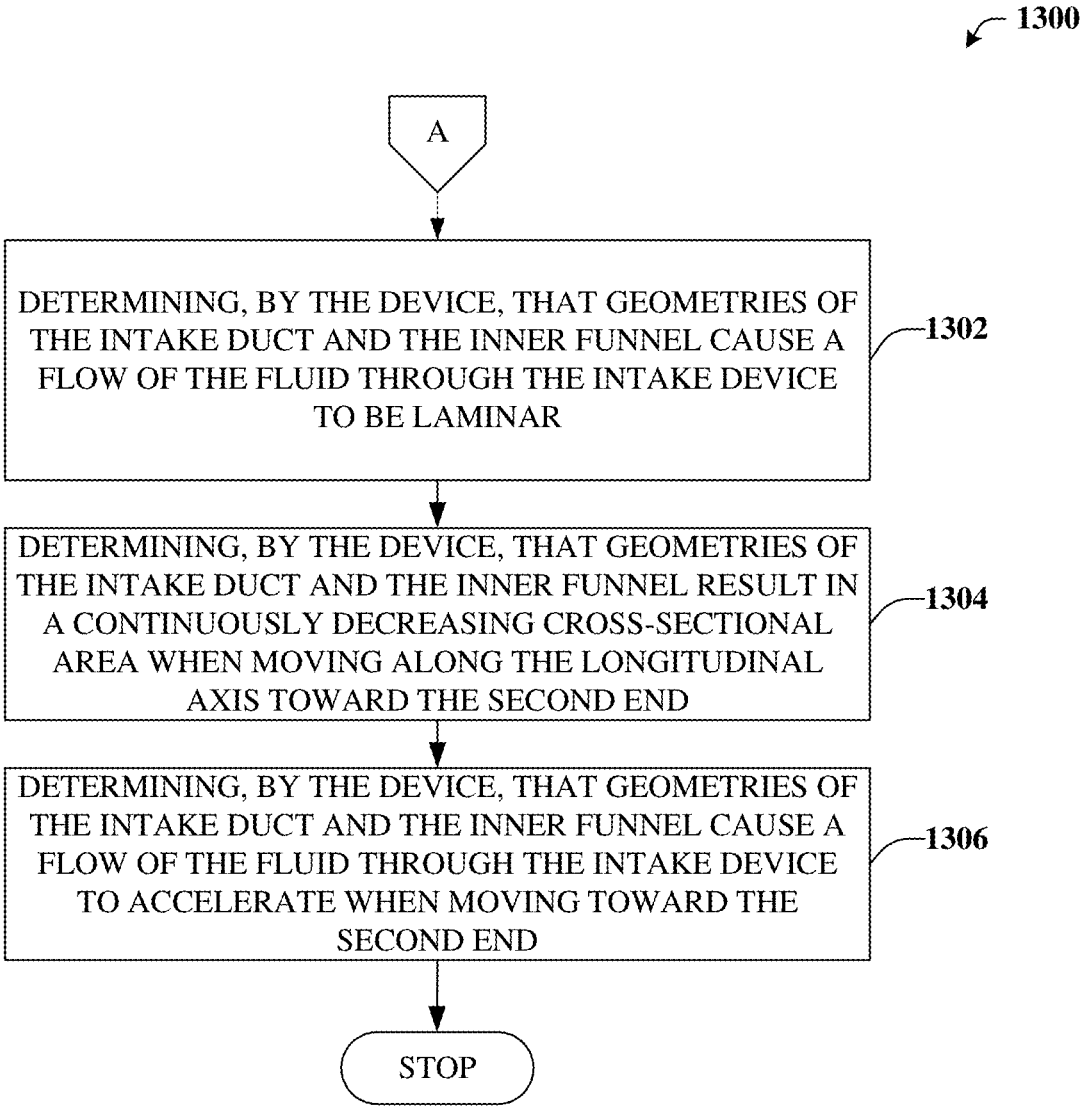
FIG. 13 illustrates a flow diagram of an example, non-limiting method that can provide additional aspects or elements in connection with fabricating an intake device in accordance with one or more embodiments of the disclosed subject matter.

FIGS. 12 and 13 illustrate various methodologies in accordance with the disclosed subject matter. While, for purposes of simplicity of explanation, the methodologies are shown and described as a series of acts, it is to be understood and appreciated that the disclosed subject matter is not limited by the order of acts, as some acts can occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts can be required to implement a methodology in accordance with the disclosed subject matter. Additionally, it should be further appreciated that the methodologies disclosed hereinafter and throughout this specification are capable of being stored on an article of manufacture to facilitate transporting and transferring such methodologies to computers.

FIG. 12 illustrates a flow diagram 1200 of an example, non-limiting method for fabricating an intake device in accordance with one or more embodiments of the disclosed subject matter. For example, a device comprising a processor can perform certain operations. Examples of said processor as well as other suitable computer or computing-based elements, can be found with reference to FIG. 24, and can be used in connection with implementing one or more of the devices or components shown and described in connection with figures disclosed herein.

At reference numeral 1202, the device comprising the processor can facilitate forming an intake duct. The intake duct can have a cover plate that is configured to prevent a fluid from entering the intake duct in a longitudinal direction. Further, the intake duct can be configured to receive, at a first end, the fluid in a radial direction and to discharge, at a second end, the fluid substantially in the longitudinal direction.

At reference numeral 1204, the device can facilitate forming an inner funnel. The inner funnel can be situated between the cover plate and the second end. In some embodiments, the inner funnel can be coupled to the cover plate, e.g., to a bottom side of the cover plate. Advantageously, the inner funnel can have a funnel geometry that causes the fluid to follow an elliptical path after entering the intake device from substantially the radial direction. In other words, the flow of the fluid, when changing from the radial direction to the longitudinal direction within the intake device is determined to follow the elliptical path. Method 1200 can proceed to insert A, which is further detailed in connection with FIG. 13, or terminate.

Turning now to FIG. 13, illustrated is a flow diagram 1300 of an example, non-limiting method that can provide additional aspects or elements in connection with fabricating an intake device in accordance with one or more embodiments of the disclosed subject matter.

At reference numeral 1302, the forming the intake duct and the forming the inner funnel further comprises determining, by the device, that geometries of the intake duct and the inner funnel cause a flow of the fluid through the intake device to be laminar.

At reference numeral 1304, the forming the intake duct and the forming the inner funnel further comprises determining, by the device, that geometries of the intake duct and the inner funnel result in a continuously decreasing cross-sectional area when moving along the longitudinal axis toward the second end.

At reference numeral 1306, the forming the intake duct and the forming the inner funnel further comprises determining, by the device, that geometries of the intake duct and the inner funnel cause a flow of the fluid through the intake device to accelerate when moving toward the second end.

Example Fan Intake Apparatus (e.g., Uniax)

Figure 14:
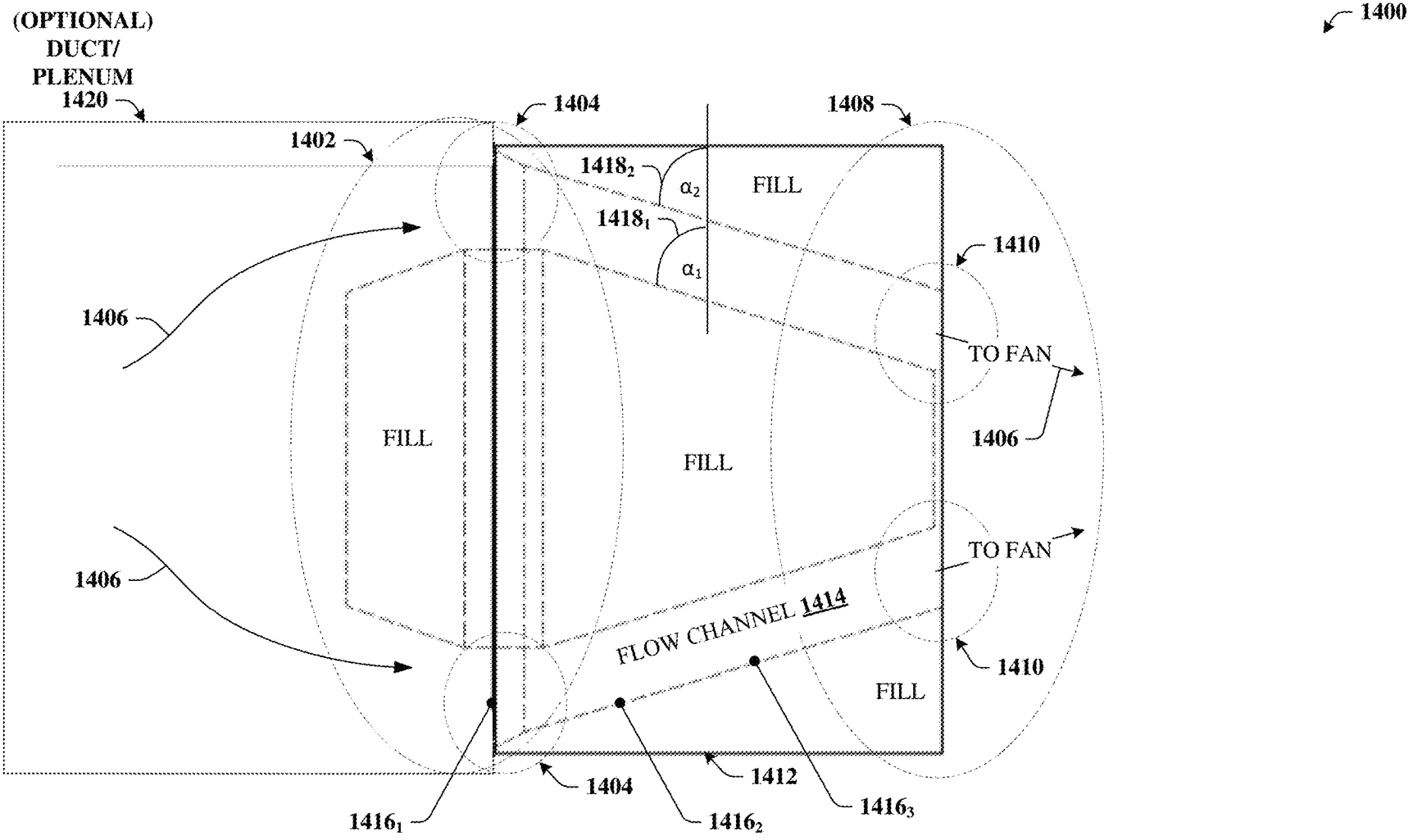
FIG. 14 illustrates a schematic diagram showing a cross-section of an a first example of a fan intake device in accordance with certain embodiments of this disclosure.

Turning now to FIG. 14, a schematic diagram is illustrated showing a cross-section of an example improved fan intake device 1400 in accordance with certain embodiments of this disclosure. Fan intake device 1400 can operate as an intake for a fluid, such as air, for a fan of an HVAC system. For instance a discharge of the fan intake device can feed into an HVAC fan or other suitable device. Conventional fan intake devices can lead to significant noise. Attempts by conventional fan intake devices to mitigate noise tend to result in pressure loss and flow intake irregularities, which can lead to a less efficient system. Designs and techniques disclosed herein can provide a fan intake device that can significantly reduce noise without resulting in pressure losses and/or flow intake irregularities common to previous systems or devices.

It is appreciated that fan intake device 1400, which can be referred to herein as an "aero-acoustical fan intake device", a "uniax", a "uniax device" or other similar variations, can contain all or only a portion of elements described, which are intended to be exemplary or representative, but also non-limiting. For instance, other elements may be present and certain elements discussed here may be optional or excluded, one example of which is duct/plenum 1420.

As illustrated, aero-acoustical fan intake device 1400 can comprise an inlet face that can broadly represent a side or face of device 1400 that receives a fluid. This inlet face is illustrated in FIG. 14 by element 1402 which encompasses the inlet face. Hereinafter, this inlet face is referred to as inlet face 1402. Inlet face 1402 can comprise an inlet opening(s), illustrated by elements 1404 that encompass the opening(s). Hereinafter the inlet openings are referred to as inlet opening (s) 1404, which can be configured to receive a flow of a fluid 1406. As illustrated, fluid 1406 on the left side of FIG. 14 flows toward inlet openings 1404. It is understood, fluid 1406 can flow toward inlet opening (2) 1404 from any suitable direction and/or point of origin, which can vary based a size and shape of (optional) duct/plenum 1420 as well as based on whether duct/plenum 1420 is present.

Fan intake device 1400 can further comprise a discharge face. Moving toward the right side of FIG. 14, element 1408 encompasses the discharge face, which is hereinafter referred to as discharge face 1408. Likewise, discharge face 1408 can comprise a discharge opening(s) 1410 that can be configured to discharge the flow of the fluid 1406 to a fan device. As illustrated fluid 1406 ultimately gets discharged toward a fan device (not shown), such as toward impellers of the fan device. It is appreciated that the fan device can be a centrifugal fan, a plenum fan, an axial fan or another suitable type of fan, which can be selected based upon implementation.

Fan intake device 1400 can further comprise housing 1412. Housing 1412 can encompass flow channel 1414 that can extend from inlet opening 1404 to discharge opening 1410. In other words, flow channel 1414 represents a constrained path through which fluid 1406 must flow in order to reach the fan device. Based on the geometry and/or design of fan intake device 1400, and specifically flow channel 1414, the flow of fluid 1406 can be manipulated to provide certain advantages detailed above and herein. It is appreciated that although this view illustrates a cross-section of fan intake device 1400, it can be readily visualized that inlet opening 1404 and discharge opening 1410 can have an annulus shape (e.g., ring-shaped).

Flow channel 1414 can be designed such that a cross-sectional area of flow channel 1414 (e.g., a cross-sectional area of the annulus or ring-shaped inlet opening 1404) can vary between inlet opening 1404 and discharge opening 1410 in a manner that is determined to cause the flow of fluid 1406 through flow channel 1414 to continuously accelerate. For instance, the cross-sectional area at inlet opening 1404 can be larger than the cross-sectional area of discharge opening 1410, which can cause acceleration in general.

More particularly, the variance in cross-sectional area can be determined to cause the flow of fluid 1406 through flow channel 1414 to continuously accelerate from some identified point (e.g., first location 1416) to discharge opening 1410. The portions of flow channel 1414 where it is determined that the flow continuously accelerates can depend on a particularly implementation, and three representative examples are discussed herein.

For instance, in some embodiments, first location 1416 (e.g., 14161) can be at inlet opening 1404. As such, in this embodiment, flow channel 1414 is designed such that continuous acceleration of fluid 1406 occurs throughout the entire length of flow channel 1414. In other embodiments, first location 1416 can be at other locations along flow channel 1414, such as about one third the distance to discharge opening 1410 (e.g., illustrated by first location $\mathbf{1416}_2$) or such as about one half the distance to discharge opening 1410 (e.g., illustrated by first location $\mathbf{1416}_3$). Other potential locations are contemplated, but it is noted that at whatever point along flow channel 1414 that is selected to represent first location 1416, flow of fluid 1406 is determined to continuously accelerate thereafter at least to discharge opening 1410.

As noted, one technique to accomplish this continuous acceleration can be to ensure that the cross-sectional area of flow channel 1414 continuously decreases from at least first location 1416 to discharge opening 1410. As one example, the design of fan intake device 1440 can be such that flow channel 1414 angles (e.g., see angles 14181 and $\mathbf{1418}_2$) toward the center of the device when moving from inlet opening 1404 to discharge opening 1410. It can be visualized that flow channel 1414 has an annulus or ring shape that decreases in size as fluid 1406 flows toward discharge opening 1410. In other words, for each cross-sectional, ring-shaped, slice of flow channel 1414, the size of the ring slices decrease, meaning their cross-sectional area decreases. This decrease in cross-sectional area can exist when angles 14181 (e.g., $\alpha_1$) and $\mathbf{1418}_2$ (e.g., $\alpha_2$) are the same, or even when those angles differ. For example, if $\alpha_1$ is greater than $\alpha_2$, then it can be readily observed that the cross-sectional area will decrease both as a function of the decreasing ring size and as a function of the height of discharge opening 1410 (e.g., a distance from the inner surface and the outer surface of flow channel 1414).

However, it is understood that, provided the difference is not too great between $\alpha_1$ and $\alpha_2$, the decrease in cross-sectional area can exist even when $\alpha_1$ is less than $\alpha_2$. In that case, the height of discharge opening 1410 can actually be greater than a height of inlet opening 1404, even while the cross-sectional area of flow channel 1414 decreases (e.g., due to the shrinking ring size). As one representative example, $\alpha_1$ can be approximately 73 degrees, while $\alpha_2$ can be approximately 74 degrees, resulting in a greater opening height at discharge than inlet, yet still a smaller cross-sectional area, which can cause the continuous acceleration of fluid 1406 flowing through flow channel 1414.

In some embodiments, the cross-sectional area of flow channel 1414 can monotonically decrease from inlet opening 1402 to discharge opening 1410 (or at least from first location 1416 to discharge opening 1410). The terminal monotonically decreased cross-sectional area can be substantially at an area swept by impellers of a fan situated proximal to discharge opening 1410.

In some embodiments, a geometry of flow channel 1414 that is determined to cause the flow of fluid 1406 to continuously accelerate is determined to result in a reduced energy loss across the aero-acoustical fan intake device 1400. This can be contrasted with conventional fan intake devices that yield a significant energy loss and/or pressure loss, which is typically in the range of 0.2 in. wc. to 0.5 in. wc.

In some embodiments, this reduction in energy loss provided by the geometry of flow channel 1414 or other components of fan intake device 1400 can be representative of a decrease in total pressure through fan intake device 1400 that is less than about 10% of an impeller velocity pressure. In some embodiments, the reduction in energy loss provided by the geometry of flow channel 1414 or other components of fan intake device 1400 can be representative of a decrease in total pressure through aero-acoustical fan intake device 1400 that is less than about 5% of an impeller velocity pressure.

It is further appreciated that, in some embodiments, a cross-sectional area of flow channel 1414 at inlet opening 1404 can be can be less than one-half of a cross sectional area of duct 1402. One advantage of such a design is that high frequency noise will tend to intersect inlet face 1402 at locations having solid or structural elements where that noise can be absorbed or constrained rather than entering flow channel 1414, which is open to fluid 1406. Thus, it can be advantageous for the diameter of flow-limiting structural elements to be greater than a fan impeller diameter, which is further detailed in connection with FIG. 15. In some embodiments, fan intake device 1400 can further comprise a material determined to absorb noise, e.g., fiberglass or the like. This material can be distributed within housing 1412 and/or around flow channel 1414 and elsewhere. For example, regions marked with the text "FILL" can be suitable locations for the noise-absorbing material in certain embodiments.

Figure 15:
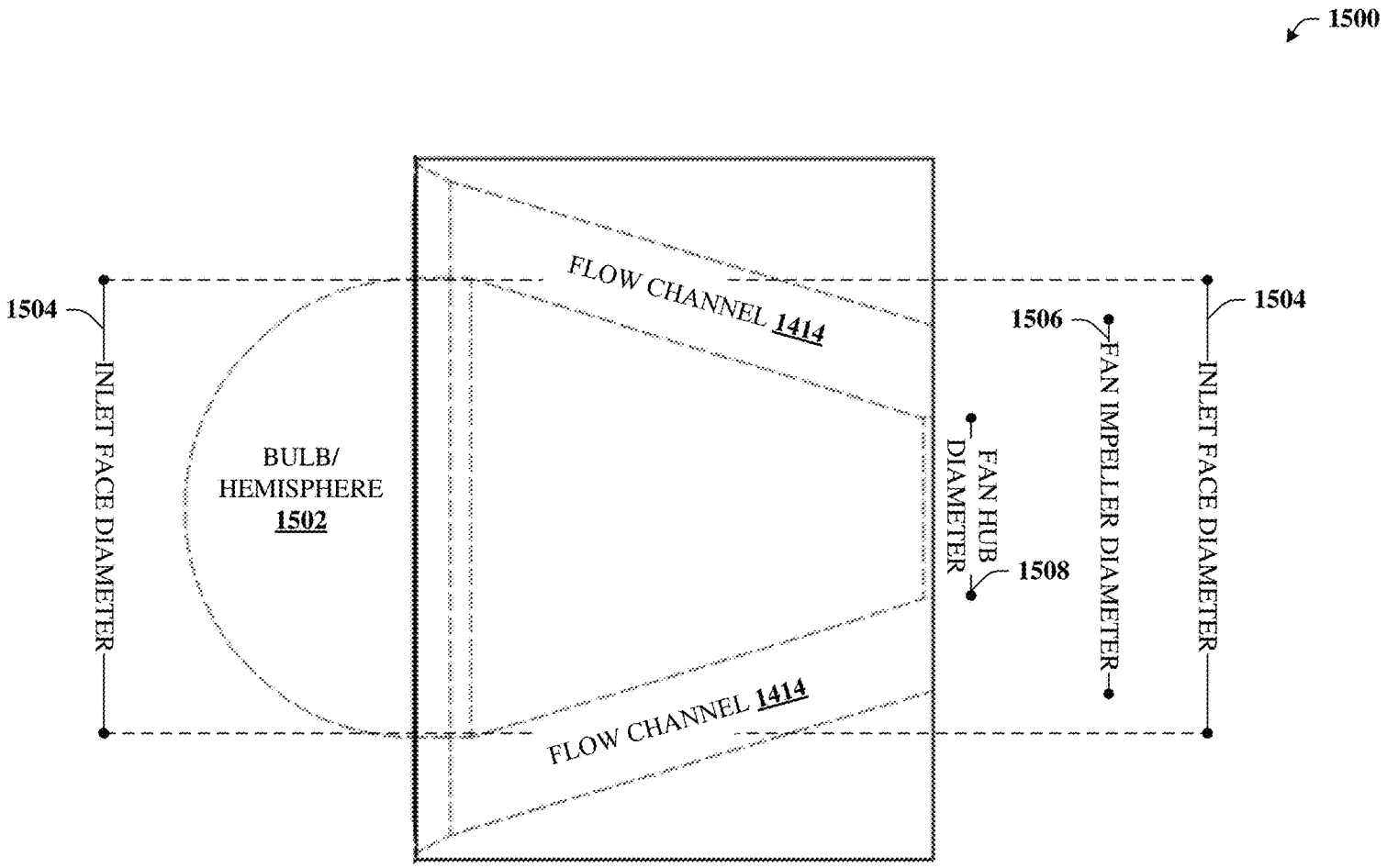
FIG. 15 illustrates a schematic diagram showing a cross-section of a second example of a fan intake device having a bulb-shaped inlet face in accordance with certain embodiments of this disclosure.

With reference now to FIG. 15, a schematic diagram showing a cross-section is illustrated of an example improved fan intake device 1500 having a bulb or hemisphere shaped inlet face in accordance with certain embodiments of this disclosure. For example, inlet face 1402 can be configured as a bulb 1502 (also referred to as hemisphere 1502) and inlet opening 1404 surround bulb 1502. Bulb 1502 can, relative to conventional fan intake devices, improve flow characteristics of fluid 1406 entering flow channel 1414, which can represent an advantage of fan intake device 1500. In this embodiment, fan intake device 1500 is illustrated without optional duct/plenum (e.g., see 1420), however it is appreciated that a duct or plenum can exist and can be of any suitable shape or size.

However, bulb 1502 can increase manufacturing costs of a fan intake device, so a lower manufacturing cost can be yet another advantage of fan intake device 1400, which is substantially similar to fan intake device 1500 in terms of having superior flow characteristics, but without bulb 1502.

In some embodiments, bulb 1502 can have an inlet face diameter 1504 that is determined to less than an impeller diameter 1506 of a fan situated proximal to discharge opening 1410. It is appreciated that greater inlet face diameter 1504 characteristic can apply to either inlet face, whether configured as a bulb 1502 (e.g., fan intake device 1500) or otherwise (e.g., fan intake device 1400). In some embodiments, a fan hub diameter 1508 can correspond to or be substantially similar to an inner diameter of flow channel.

Example Methods of Fabricating a Fan Intake Device

Figure 16:
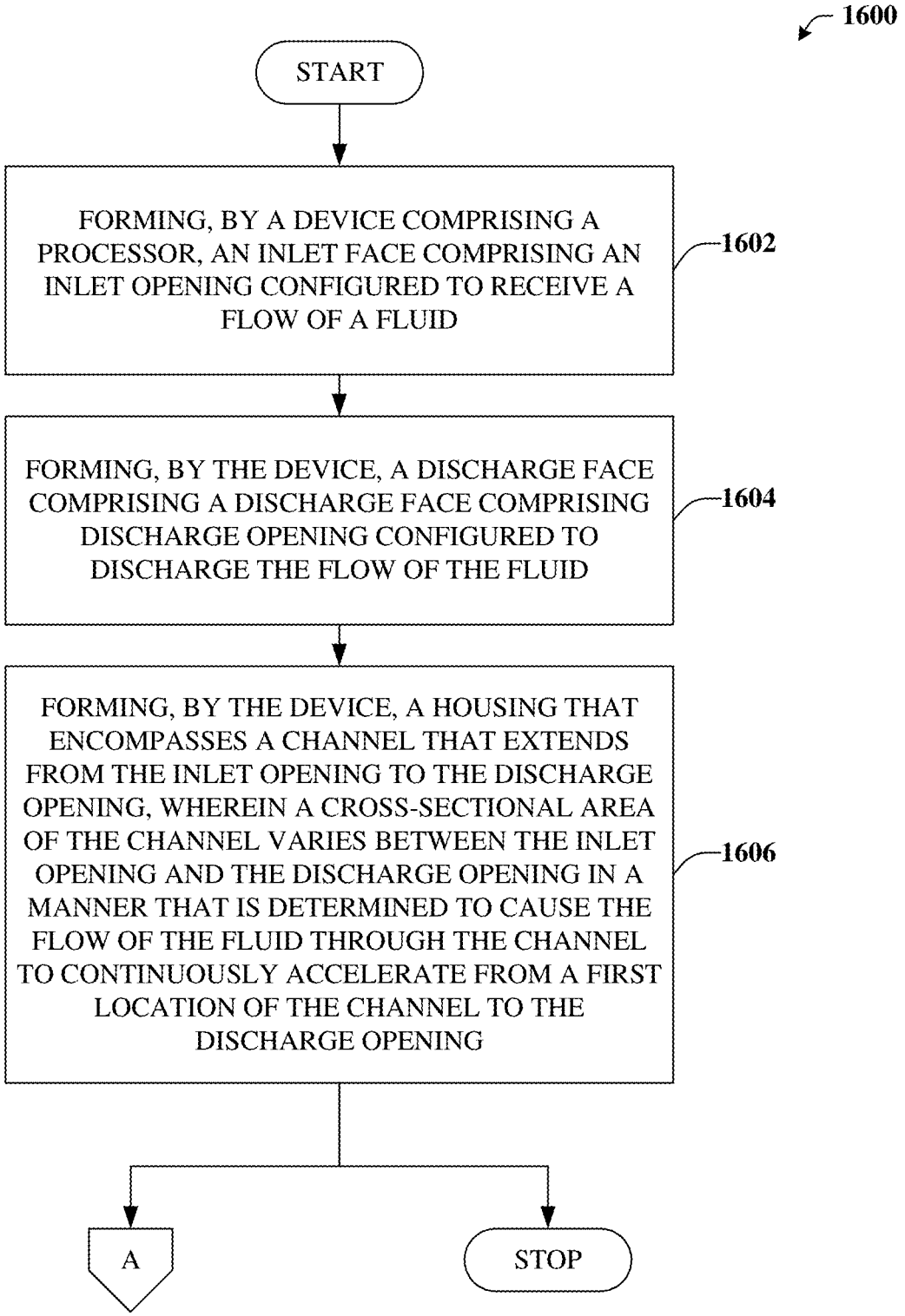
FIG. 16 illustrates a flow diagram of an example, non-limiting method for fabricating a fan intake device in accordance with one or more embodiments of the disclosed subject matter.
Figure 17:
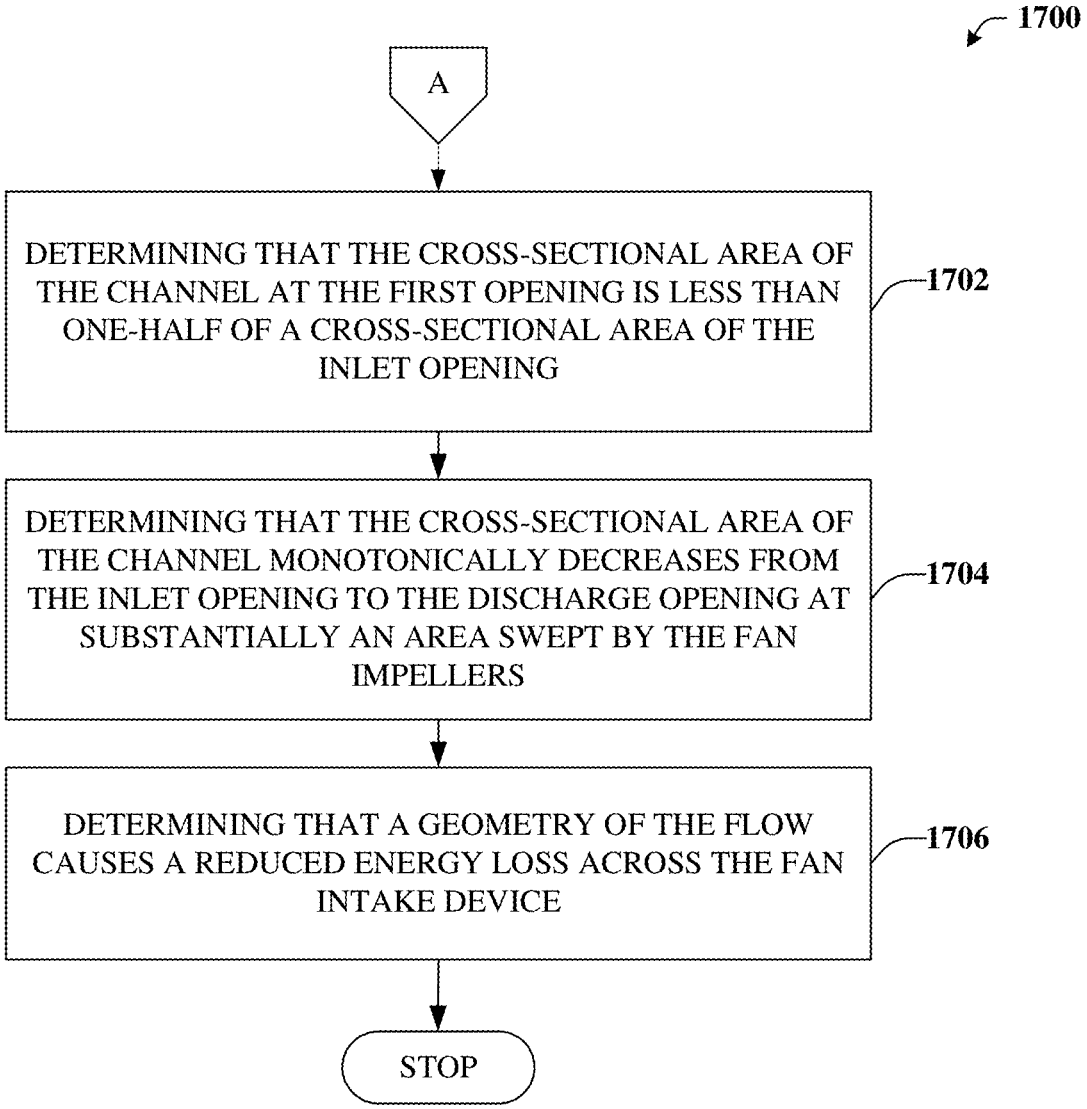
FIG. 17 illustrates a flow diagram of an example, non-limiting method that can provide additional aspects or elements in connection with fabricating a fan intake device in accordance with one or more embodiments of the disclosed subject matter.

FIGS. 16 and 17 illustrate various methodologies in accordance with the disclosed subject matter. While, for purposes of simplicity of explanation, the methodologies are shown and described as a series of acts, it is to be understood and appreciated that the disclosed subject matter is not limited by the order of acts, as some acts can occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts can be required to implement a methodology in accordance with the disclosed subject matter. Additionally, it should be further appreciated that the methodologies disclosed hereinafter and throughout this specification are capable of being stored on an article of manufacture to facilitate transporting and transferring such methodologies to computers.

FIG. 16 illustrates a flow diagram 1600 of an example, non-limiting method for fabricating a fan intake device in accordance with one or more embodiments of the disclosed subject matter. For example, a device comprising a processor can perform certain operations. Examples of said processor as well as other suitable computer or computing-based elements, can be found with reference to FIG. 24, and can be used in connection with implementing one or more of the devices or components shown and described in connection with figures disclosed herein.

At reference numeral 1602, the device comprising the processor can facilitate forming an inlet face. The inlet face can be surrounded by an inlet opening. The inlet opening can be configured to receive a flow of a fluid. In some embodiments, the inlet opening can be representative of an annulus or ring about the inlet face. In some embodiments, the inlet face can have a shape characterized as a bulb or hemisphere.

At reference numeral 1604, the device can facilitate forming a discharge face. The discharge face can be surrounded by a discharge opening. The discharge opening can be configured to discharge the flow of the fluid. The flow of the fluid can be discharged toward a proximally situated fan device and/or toward impellers of the fan device. In some embodiments, the discharge opening can be representative of an annulus or ring about the discharge face.

At reference numeral 1606, the device can facilitate forming a housing. The housing can encompass a channel that extends from the inlet opening to the discharge opening. A cross-sectional area of the channel can vary between the inlet opening and the discharge opening in a manner that is determined to cause the flow of the fluid through the channel to continuously accelerate. Continuous acceleration for the fluid can occur from a first location of the channel to the discharge opening. Selection of the first location can be a function of a particular implementation. Method 1600 can proceed to insert A, which is further detailed in connection with FIG. 17, or terminate.

Turning now to FIG. 17, illustrated is a flow diagram 1700 of an example, non-limiting method that can provide additional aspects or elements in connection with fabricating a fan intake device in accordance with one or more embodiments of the disclosed subject matter.

At reference numeral 1702, the forming the housing can further comprise determining, by the device, that the cross-sectional area of the channel at the first opening is less than one-half of a cross-sectional area of the inlet opening.

At reference numeral 1704, the forming the housing can further comprise determining, by the device, that the cross-sectional area of the channel monotonically decreases from the inlet opening to the discharge opening at substantially an area swept by the fan impellers. In some embodiments, it can be determined that the cross-sectional area of the channel monotonically decreases from the first location to the discharge opening at substantially an area swept by the fan impellers.

At reference numeral 1706, the forming the housing can further comprise determining, by the device, that a geometry of the flow causes a reduced energy loss across the fan intake device.

Example Air Handler Apparatuses and/or Products (e.g., Aircube)

Figure 18:
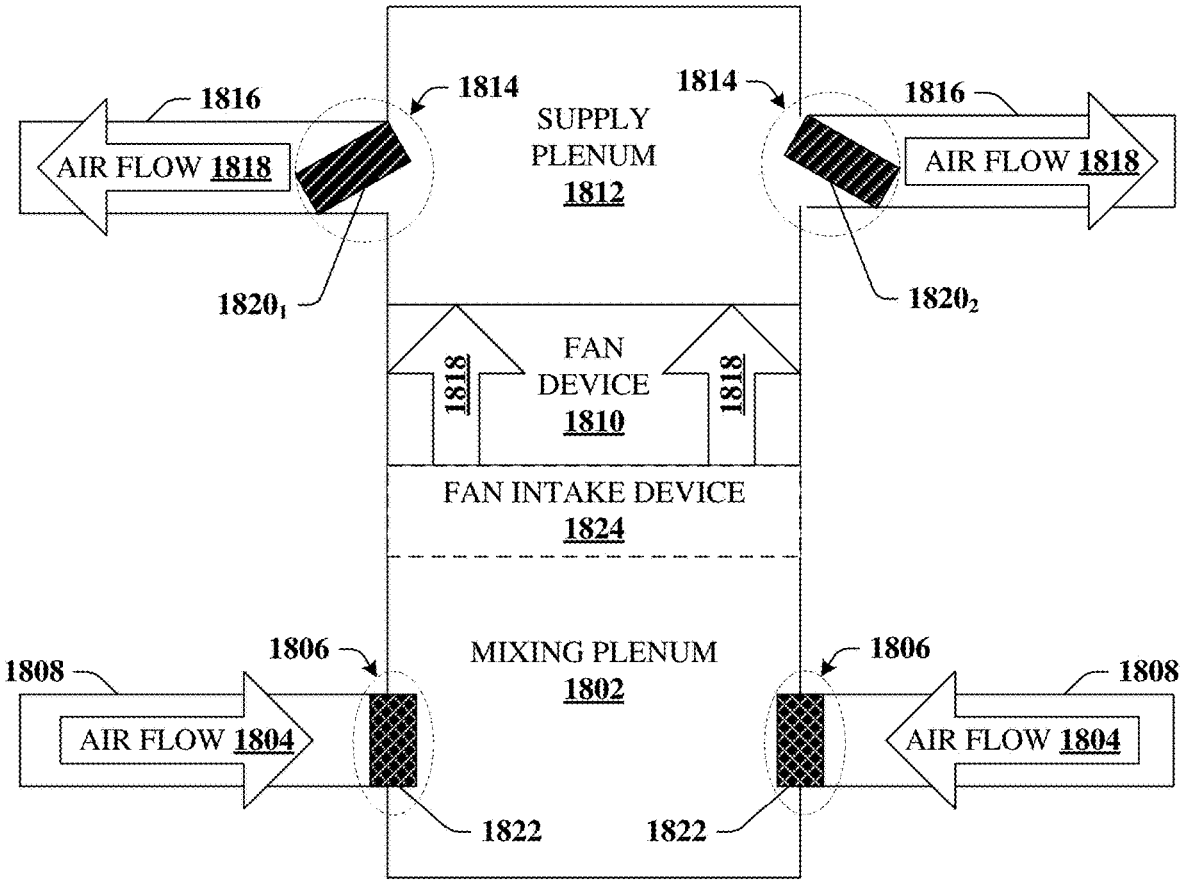
FIG. 18 illustrates a schematic diagram showing a cross-section of a first example air handler product in accordance with certain embodiments of this disclosure.

Turning now to FIG. 18, a schematic diagram is illustrated showing a cross-section of a first example air handler product in accordance with certain embodiments of this disclosure. Air handler device 1800 (also referred to as air handler product 1800) can operate to supply both heated and cooled air that can be independently selected based on the supply duct. Thus, for instance, cooled air can be provided to a first supply duct that serves one portion of a building (e.g., a south facing portion in direct sunlight) concurrently with heated air being provided to a second supply duct that serves a different portion or zone of the building (e.g. north facing portion). Such an advantage can be provided at a low cost, using only a single air handler device, which is distinct from conventional air handler devices that do not allow for concurrent deliver of both heated and cooled air. Another advantage can be observed in operational costs, since diverse heating or cooling needs can be satisfied during the same duty cycle rather than by multiple sequential duty cycles, which can reduce operational costs and increase equipment lifecycle.

It is appreciated that air handler device 1800, which can be referred to herein as an "aircube", an "aircube device/product" or other similar variations, can contain all or only a portion of elements described, which are intended to be exemplary or representative, but also non-limiting. Air handler device 1800 can comprise mixing plenum 1802, which can also be referred to as a mixing chamber or central chamber. Mixing plenum 1802 can receive multiple air flows 1804 from multiple different ducts 1808 that feed mixing plenum 1802 as well as in some cases directly from the surrounding area (e.g., non-ducted intake). In conventional literature, the term 'mixing' usually refers to combining air flows of different temperatures such as outside air and return air. As used herein, mixing plenum 1802 is intended to refer to a plenum or other structure (upstream from a fan) that receives air from multiple flows, inclusive of cases where the multiple flows are not of substantially different temperatures.

Reference numeral 1806 illustrates an encircled area conceptually representing mixing plenum interfaces that couple mixing plenum 1802 to surrounding air or to ducts 1808, referred to herein as mixing plenum interfaces 1806. In other words, as used herein, ducts 1808 can represent structural ductwork, as depicted, or another exposure to air flow 1804 such as from outside air. In some embodiments, air handler device 1800 can be located against an outside wall with outside air louvers and dampers placed in that outside wall, such as at mixing plenum interface 1806. In that case the mixing plenum interface 1806 can contain dampers enabling control of mixed air temperature, e.g., when outside air is cool and control of a minimum percentage of outside air, e.g., when outside air is hot. As further detailed below, mixing plenum interface 1806 can comprise air filters 1822 as well as dampers and louvers or other suitable elements.

Air handler device 1800 can comprise fan device 1810. Fan device 1810 can be configured to receive a mixing plenum flow (e.g., flow 1804) from mixing plenum 1802 and to discharge a supply flow 1818. Fan device 1810 can be embodied as, for example, a centrifugal fan, a plenum fan, an axial fan, or any other suitable type of fan, whereas embodiments described herein with respect to air handler device 1800 generally assume a centrifugal fan embodiment. Air handler device 1800 can further comprise supply plenum 1812. Supply plenum 1812 can be configured to receive supply flow 1818 from fan device 1810 and to discharge supply flow 1818 as explained below. It is appreciated that, as used herein, the term "supply plenum" can also refer to a region comprising vanes such as straightening vanes, which is typically more appropriate in cases where fan device 1810 is an axial fan, such as the generally presumed case with respect to FIG. 21. In other words, "supply plenum" can refer to what is conventionally considered a supply plenum (e.g., in embodiments that employ a centrifugal fan) as well as a vane section (e.g., in embodiments that employ an axial fan).

For example, supply plenum 1812 can comprise a plurality of duct interfaces 1814, which are conceptually illustrated by the encircled region where supply ducts 1816 intersect with supply plenum 1812. Hence, duct interfaces 1814 can be configured to interface with a different one of a plurality of supply ducts 1816. Supply plenum 1812 can further comprise a plurality of thermal transfer units (TTUs) 1820. For instance, the plurality of TTUs 1820 can comprise first TTU $\mathbf{1820}_1$ and second TTU $\mathbf{1820}_2$ that are respectively situated in different ones of the plurality of duct interfaces 1814. Advantageously, first TTU $\mathbf{1820}_1$ affecting a first air flow 1818 can be configured to a first temperature concurrently with second TTU $\mathbf{1820}_2$ affecting a second air flow 1818 can be configured to a second temperature that differs from the first temperature.

In the present embodiment, two TTUs 1820 are depicted, but it is appreciated that any suitable number of TTUs 1820 can be employed. For instance, for each supply duct 1816 and/or duct interface 1814, a different TTU 1820 can be employed, which can effectively allow individual (e.g., per-supply duct 1816) of heating versus cooling versus neutral or matching (e.g., neither heating nor cooling) as well as individually controlling temperature gradients on a per-duct basis. For example, air handler device 1800 can be configured as a two-TTU design (e.g., FIG. 18), a three-TTU design (e.g., FIG. 19), a four-TTU design (e.g., FIG. 20), or more. TTU 1820 can comprise coils that operate according to direct expansion, water-type, or any other suitable techniques for thermal transfer. The heat transfer medium of TTU 1820 can be any suitable fluid such as water, gas, refrigerant, CO2, O2, etc., that flows through pipe connecting an evaporative coil array to condensing coil arrays. Such can be used in any suitable configuration and in connection with heat pumps, air conditioners, compressors, or the like.

For example, in some embodiments, air handler device 1800 can be equipped with six-way valve water coils that can independently heat or cool supply flows 1818. In some embodiments, valve packages can be factory installed such that air handling device 1800 can be fully assembled prior to delivery at an installation site, which can significantly reduce costs.

Further, either draw-through or blow-through configurations can be provided, or in some embodiments both concurrently. For example, mixing plenum interfaces 1806 as well as duct interfaces 1814 can comprise either or both TTUs 1820 or filters 1822. As depicted, coils of a TTU 1820 can be situated in a slanted configuration, which can increase the thermal transfer between TTU 1820 and supply flow 1818.

Figure 20:
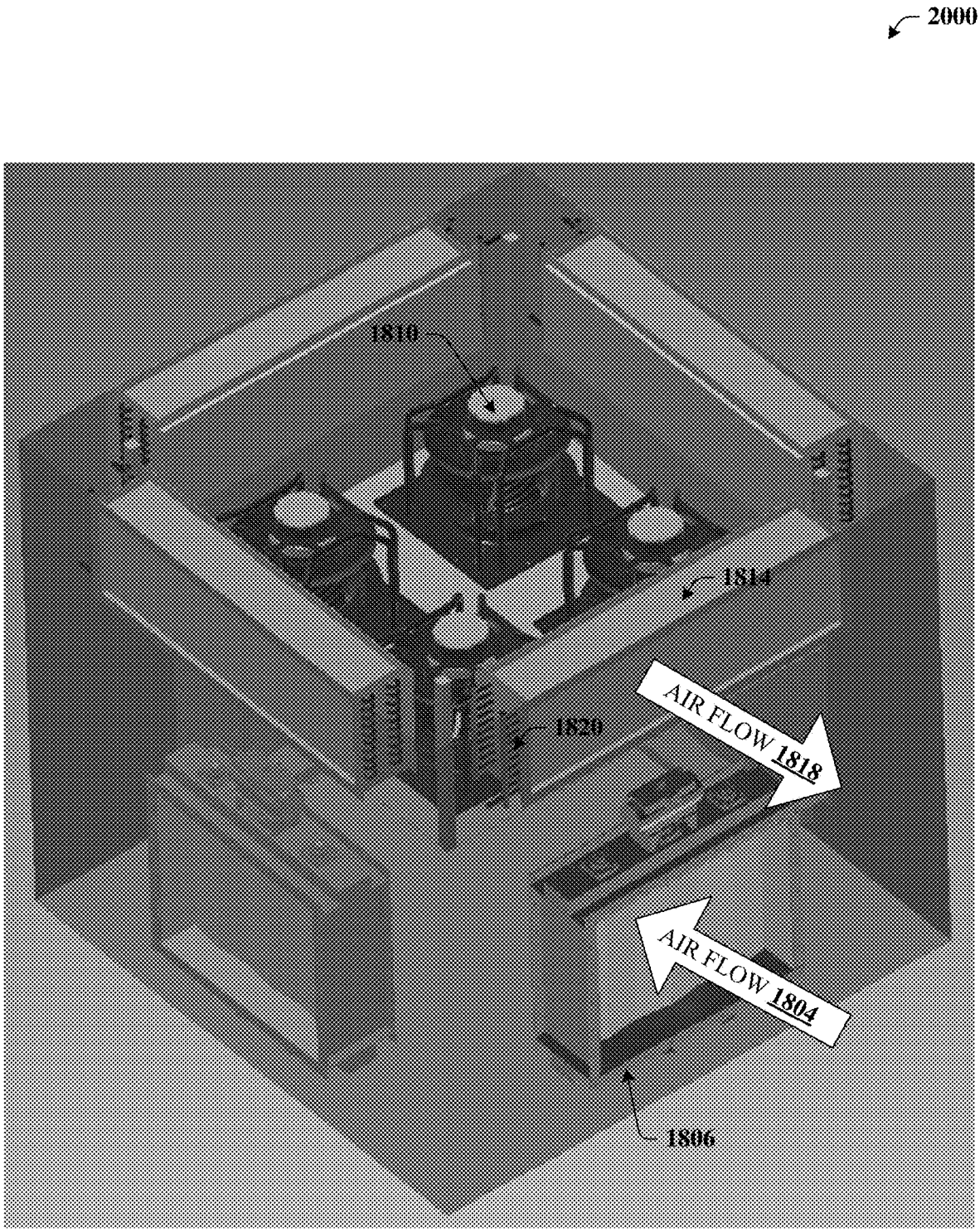
FIG. 20 illustrates a three-dimensional representation of a second example air handler product having multiple fans and four supply duct interfaces in accordance with certain embodiments of this disclosure.

Although a single fan device 1810 is illustrated, it is appreciated that any suitable number of fan devices 1810 can be employed. For example, depending on size or implementation, some embodiments can provide for two, three, four, six or more fans situated between mixing plenum 1802 and supply plenum 1812 (for instance see FIG. 20, showing four fan devices).

In some embodiments, fan device 1810 can comprise or be operatively coupled to fan intake device 1824 at an upstream location. Fan intake device 1824 can operate to straighten or improve air flow 1804 and/or to significantly reduce noise without significant pressure loss. In that regard, fan intake device 1824 employ designs or techniques detailed herein in connection with fan intake device 1400 or fan intake device 1500, of which advantages described herein with respect to those devices can be incorporated into air handler device 1800 (as well as embodiments of air handler product 2100 detailed in connection with FIG. 21).

In some embodiments, fan device 1810 can comprise or be operatively coupled to an evase device (not shown, but see evase device 2124 of FIG. 21) at a downstream location (e.g., toward supply plenum 1812). Such an evase device can be substantially similar to any of the evase devices detailed herein (e.g., evase device 400, evase device(s) 202, 302). As explained, the evase device can therefore operate to efficiently convert velocity pressure to static pressure. Hence, the evase device can be particularly advantages in cases where fan device 1820 is an axial fan (e.g., see FIG. 21), which tends to generate significantly more velocity pressure than centrifugal or plenum fans. In some embodiments, either or both of the evase device or the fan intake device 1824 can be built into fan device 1810 and/or can share a common housing.

Further, fan device(s) 1810 can be configured to discharge supply flow 1818 in a vertical direction, a horizontal direction, or some angle in between. Likewise, air handler devices or products disclosed herein can be configured to blow air upward (e.g., a floor unit such as air handler device 1800) or blow air downward (e.g., a rooftop unit an example of which is provided in connection with FIG. 21). It is to be further appreciated that an aspect ratio of various coils and/or TTUs 1820 can vary and/or be non-symmetrical. For instance, one side can be longer than other sides. In other words, coils of various TTUs 1820 can be configured to any suitable height, width, length specification. Such can provide better coil performance, such as, e.g., lower APD, additional face area, etc., and any TTU 1820 can be tailored specifically to a given duct or zone requirement.

In some embodiments, as depicted in FIG. 18, supply flows 1818 can flow in different directions, that is one supply flow 1818 is flowing toward the right of the page, while the other supply flow is flowing toward the left side of the page. In other embodiments, at least two supply flows 1818 can flow into two of supply ducts 1816 in a same direction. For example, two adjacent supply ducts 1816 might carry air in a parallel direction (e.g., out of the page or into the page), while two other supply ducts 1816 can carry air in different directions such as to the right of the page and the left of the page, as depicted. In any case, each supply duct 1816 can have an individually controllable TTU 1820 that can independently heat or cool corresponding supply flows 1818.

Figure 19:
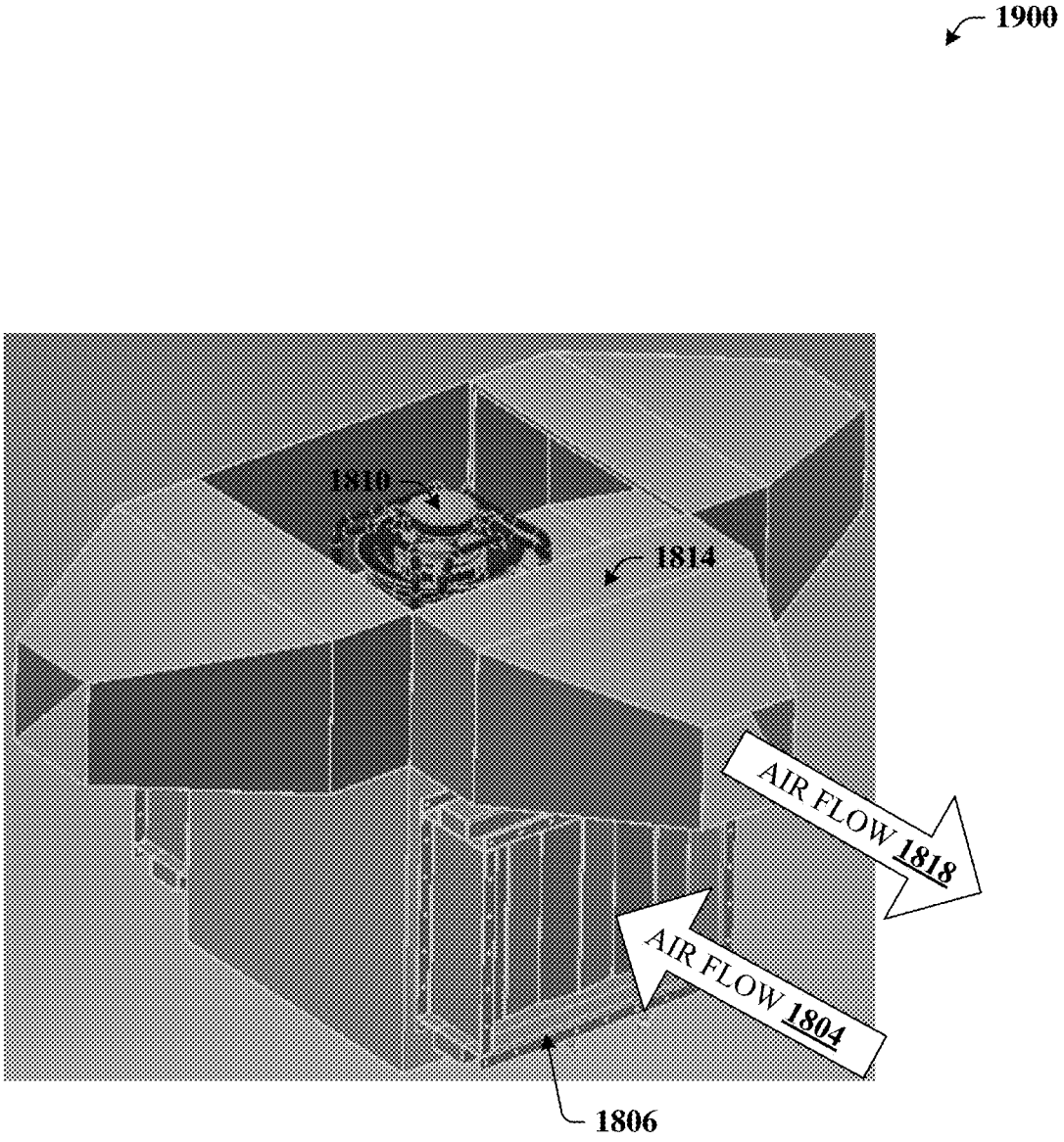
FIG. 19 illustrates a three-dimensional representation of a first example air handler product having three supply duct interfaces in accordance with certain embodiments of this disclosure.

Turning now to FIG. 19, illustrated is a three-dimensional representation of a first example air handler product 1900 having three supply duct interfaces in accordance with certain embodiments of this disclosure. Return air and/or a combination of return air and fresh air (e.g., air flow 1804) can be received via mixing plenum interface 1806, which can in some embodiments, include TTU 1820 and/or filter 1822. Air flow 1804 can be controlled by dampers or another suitable mechanism or technique. Likewise, supply duct interface 1814 can also be configured to include TTU 1820 and/or filter 1822. Supply flow 1818 can be received, via mixing plenum interface 1806, by fan device 1810 (e.g., a centrifugal fan or another suitable type of fan) and discharged via supply duct interface 1814. Supply duct interface 1814 can also be configured with dampers to control supply flow 1818 at any given supply duct interface 1814. The illustrated embodiment represents a three-way supply duct design, but other suitable designs are contemplated.

Referring now to FIG. 20, illustrated is a three-dimensional representation of a second example air handler product 2000 having multiple fans and four supply duct interfaces in accordance with certain embodiments of this disclosure. Return air and/or a combination of return air and fresh air can be received via mixing plenum interface 1806, which can in some embodiments, include TTU 1820 and/or filter 1822. Air flow 1804 can be controlled by dampers or another suitable mechanism or technique. Likewise, supply duct interface 1814 can also be configured to include TTU 1820 and/or filter 1822. Supply flow 1818 can be received, via mixing plenum interface 1806, by fan device 1810 (e.g., a centrifugal fan or another suitable type of fan) and discharged via supply duct interface 1814. Supply duct interface 1814 can also be configured with dampers to control supply flow 1818 at any given supply duct interface 1814. The illustrated embodiment represents a four-way supply duct design, but other suitable designs are contemplated.

Figure 21:
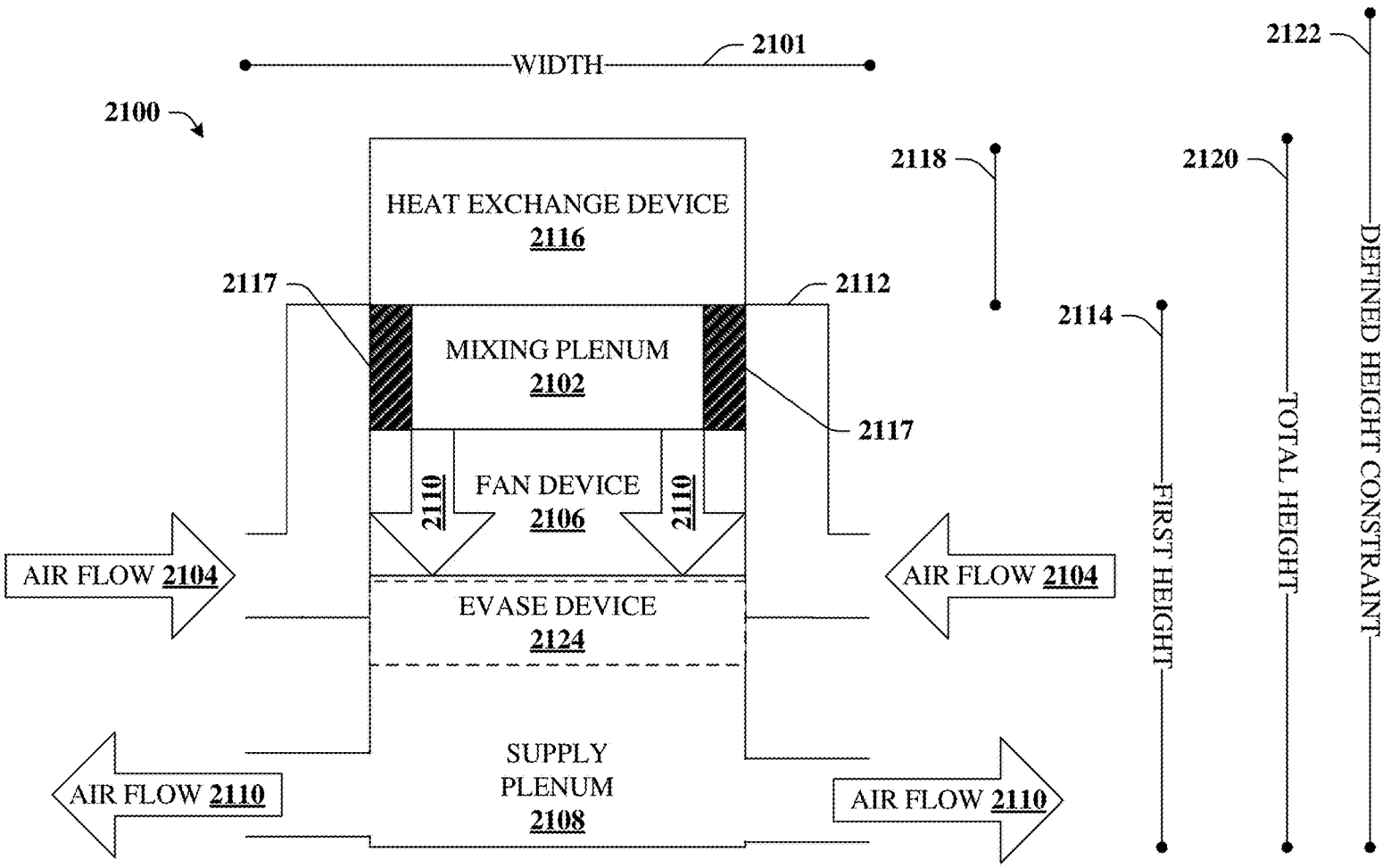
FIG. 21 illustrates a schematic diagram showing a cross-section of an a second example air handler product in accordance with certain embodiments of this disclosure.

Turning now to FIG. 21, a schematic diagram is illustrated showing a cross-section of a second example air handler product in accordance with certain embodiments of this disclosure. Air handler device 2100 (also referred to as air handler product 2100 or HVAC product 2100) is illustrated in the context of a rooftop unit, but it is appreciated that floor units are also contemplated. As such, air handler device 2100 is configured to blow air downward (as opposed to upward as illustrated in FIGS. 18-20). Air handler device 2100 can be factory-assembled and/or shipped to an installation site fully assembled, in some cases including valve packages or the like.

One difficulty associated with factory-assembled air handler devices is that the size of the unit typically makes shipping and fabrication more expensive. For example, transportation codes, which can be based on the height of highway overpasses or the like typically have a height constraint. Likewise, building codes can also impose a height constraint for rooftop units. In order to meet these constraints, conventional HVAC devices are manufactured to be wide and short. That is, all the ordinary components (e.g., duct interfaces, mixing chambers and other plenums, fan, heat rejection and/or thermal transfer unit, filters, etc.) are not stacked on top of one another, but rather situated side-by-side. This conventional design allows the unit to meet building codes, but due to the large width (and potentially weight), can increase shipping costs as only one unit might fit on a single truck at a time. The large size of the unit is also more costly in terms of materials and fabrication.

Due in part to advantageous designs disclosed above, and herein, the inventors have discovered a way to stack air handler components on top of one another, which can greatly decrease width 2101 of the unit, while meeting height code constraints. In particular, a heat rejection section can be placed on top, whereas conventional designs are unable to situate the heat rejection section on top and therefore place that component on the side of other air handler components. As a result, fewer units of conventional designs can be shipped per truck, which increases transportation costs as well as other costs, some noted herein.

HVAC product 2100 can comprise mixing plenum 2102, fan device 2106, and supply plenum 2108 (collectively referred to hereinafter as an air handler component). Collectively, these components can be configured to circulate flows of air within an HVAC system situated at a site HVAC product 2100 is to be installed. It is appreciated that air flow 2104 (e.g., return air and/or fresh air) follows a substantially "S" or "Z" shaped path to arrive at mixing plenum 2102 (also referred to as central chamber 2102) before entering fan device 2106. This design can significantly reduce noise and can also improve aerodynamic properties (e.g., reduce turbulence or shear flows, etc), which might otherwise damage fan device 2106.

In some embodiments, fan device 2106 can be an axial fan, which typically generates a much greater velocity pressure than plenum or centrifugal fans. By utilizing an axial fan in this design, the rating of the unit can be much greater than conventional units of similar dimensions. However, several difficulties can arise with the use of axial fans. A first difficulty is that the fan impellers can break when confronted with shear flows, turbulence, or the like. This difficulty can be substantially mitigated by the "S" or "Z" shaped path of air flow 2104, as detailed above as well as implementation of a fan intake device (not shown, but see fan intake device 1824 of FIG. 18).

A second difficulty associated with axial fans is they produce a very large velocity pressure that tends to be inefficiently converted to static pressure in the remainder of the system. Thus, in conventional designs, the total pressure loss can be significant with axial fans. In order to mitigate this difficulty, evase device 2124 can be placed downstream of fan device 2106 in some embodiments. Evase device 2124 can be substantially similar to any of the devices detailed herein (e.g., evase device 400, evase device(s) 202, 302). As explained previously, evase device 2124 can therefore operate to efficiently convert velocity pressure to static pressure. Hence, the second difficulty of using axial fans can be mitigated.

Because of the efficient, space-saving design, a top surface 2112 of the air handler component can have a significantly smaller height (e.g., first height 2114) than other systems or products. As such, a heat exchange device 2116 can be situated on top surface 2112. Heat exchange device 2116 can be configured to exchange heat with air flow 2104 and can include coils 2117 and/or filters, etc. situated in the path of air flow 2104. In some embodiments, coils 2117 can be slanted as illustrated and discussed in connection with coils 1820. Further, coils 2117 can be configured to heat, cool, or neither (e.g., provide neutral air) independently from other coils 2117 as discussed in connection with coils 1820.

Heat exchange device 2116 can have a second height 2118 that, when combined with first height 2114, represents a total height 2120 of HVAC product 2100. Total height 2120, which reflects heat exchange device 2116 being situated on top (rather than on the side), can be determined to be less than or equal to a defined height constraint 2122. In some embodiments, the defined height constraint 2122 can be determined to satisfy a local building code of the installation site. In some embodiments, the defined height constraint 2122 can be determined to satisfy a transportation code applicable to a transportation route between a manufacturing site of HVAC product 2100 and the installation site. By way of example, the defined height constraint 2122 can be, e.g., 14 feet, or 10 feet, or some other suitable value. Further, in some embodiments, a weight of HVAC product 2100 can be determined to satisfy a defined weight constraint.

Moreover, it is appreciated that the described HVAC product 2100 can be designed to discharge according to an overhead configuration or an under floor configuration. Hence, in some embodiments, heat exchange device 2116 can be situated on a bottom surface of the air handler component. For example, if HVAC product 2100 is rotated 180 degrees, for instance to accommodate a floor unit versus a rooftop unit, top surface 2112 would then be descriptive of a bottom surface, below which can be situated heat exchange device 2116. In either embodiment, it can be seen that such is distinct from conventional designs in which heat rejection sections are situated side-by-side with other components.

Example Methods of Fabricating an Air Handler Product

Figure 22:
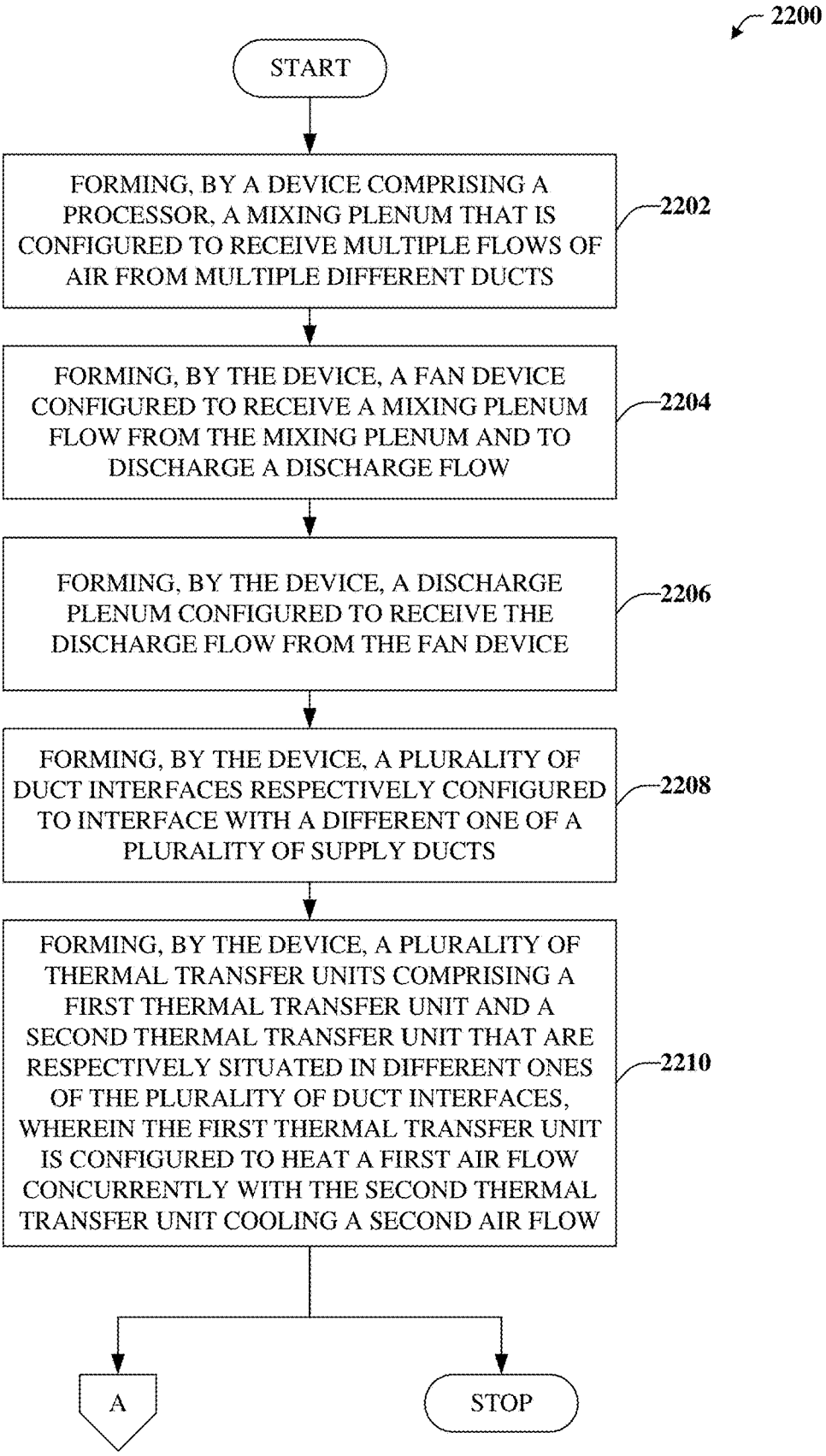
FIG. 22 illustrates a flow diagram of an example, non-limiting method for fabricating an air handler product in accordance with one or more embodiments of the disclosed subject matter.
Figure 23:
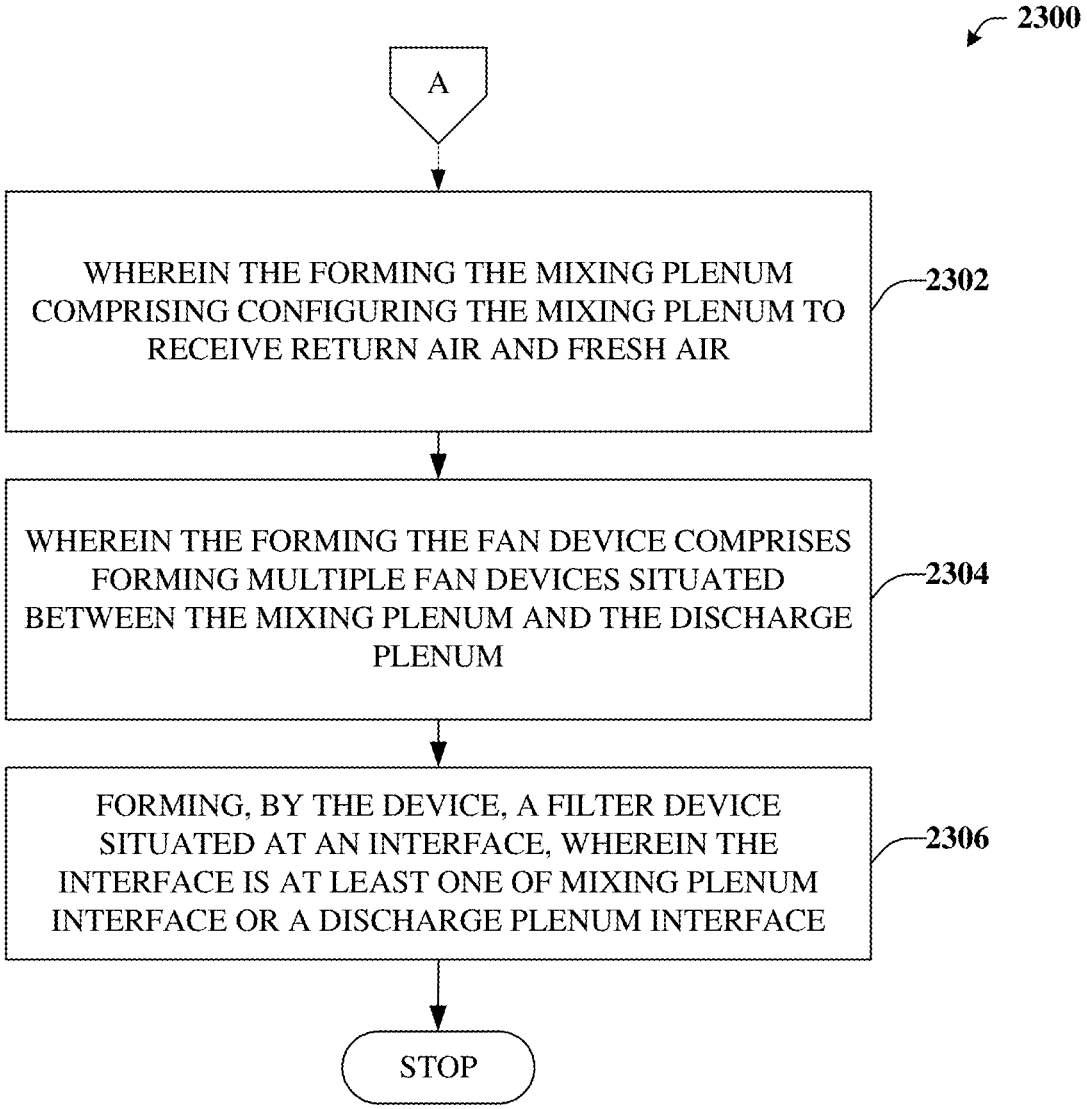
FIG. 23 illustrates a flow diagram of an example, non-limiting method that can provide additional aspects or elements in connection with fabricating an air handler product in accordance with one or more embodiments of the disclosed subject matter.

FIGS. 22 and 23 illustrate various methodologies in accordance with the disclosed subject matter. While, for purposes of simplicity of explanation, the methodologies are shown and described as a series of acts, it is to be understood and appreciated that the disclosed subject matter is not limited by the order of acts, as some acts can occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts can be required to implement a methodology in accordance with the disclosed subject matter. Additionally, it should be further appreciated that the methodologies disclosed hereinafter and throughout this specification are capable of being stored on an article of manufacture to facilitate transporting and transferring such methodologies to computers.

FIG. 22 illustrates a flow diagram 2200 of an example, non-limiting method for fabricating an air handler product in accordance with one or more embodiments of the disclosed subject matter. For example, a device comprising a processor can perform certain operations. Examples of said processor as well as other suitable computer or computing-based elements, can be found with reference to FIG. 24, and can be used in connection with implementing one or more of the devices or components shown and described in connection with figures disclosed herein.

At reference numeral 2202, the device comprising the processor can facilitate forming a mixing plenum. The mixing plenum can be configured to receive multiple flows of air from multiple different ducts. In some embodiments, the multiple flows of air can be from multiple different directions.

At reference numeral 2204, the device comprising the processor can facilitate forming a fan device. The fan device can be configured to receive a mixing plenum flow from the mixing plenum and to discharge a supply flow. At reference numeral 2206, the device comprising the processor can facilitate forming a supply plenum. The supply plenum can be configured to receive the supply flow from the fan device.

At reference numeral 2208, the device comprising the processor can facilitate forming a plurality of duct interfaces. The plurality of duct interfaces can be respectively configured to interface with a different one of a plurality of supply ducts. In some embodiments, the plurality of supply ducts can be configured to transport air in multiple different directions. In some embodiments, at least two of the plurality of supply ducts can be configured to transport air in a same direction.

At reference numeral 2210, the device comprising the processor can facilitate forming a plurality of thermal transfer units. The plurality of thermal transfer units can comprise a first thermal transfer unit and a second thermal transfer unit that can be, respectively, situated in different ones of the plurality of duct interfaces. The first thermal transfer unit can be configured to heat a first air flow concurrently with the second thermal transfer unit cooling a second air flow. Method 2200 can proceed to insert A, which is further detailed in connection with FIG. 23, or terminate.

Turning now to FIG. 23, illustrated is a flow diagram 2300 of an example, non-limiting method that can provide additional aspects or elements in connection with fabricating an air handler device in accordance with one or more embodiments of the disclosed subject matter.

At reference numeral 2302, the device can facilitate configuring the mixing plenum to receive return air and fresh air from the multiple different ducts. Said configuring can be accomplished in connection with the forming the mixing plenum that is detailed above in connection with reference numeral 2202 of FIG. 22.

At reference numeral 2304, and potentially in connection with the forming the fan device discussed at reference numeral 2204 of FIG. 22, the device can facilitate forming multiple fan devices situated between the mixing plenum and the supply plenum.

At reference numeral 2306, the device can facilitate forming a filter device situated at an interface. The interface can be at least one of a mixing plenum interface or a supply plenum interface. In other words, the filter can be situated at either one of or both of the mixing plenum interface or the supply plenum interface.

Example Air Handler with U-Bend Structure

Certain air handler devices detailed herein (e.g., those associated with FIGS. 18-20, 25, and 26) can be implemented according to designs or techniques typically have small footprints that take up very little floor space, allowing for additional leasable space. Moreover, improved or superior acoustics can also lead to additional space savings such as by reducing or eliminating mechanical rooms with acoustical abatement. Embodiments with floor-level fans and/or filters can save on maintenance by providing simplified access to fans, filters, and/or controls. Further, when coupling to downstream devices having accurate air flow devices, air handler devices with multi-sided coil configurations can reduce or eliminate zone level coils or other fluid distribution infrastructure, resulting in a sustainability and economic advantage over previous HVAC designs or systems.

It is understood that an air handler device, as used herein, can be a centralized unit that provides supply air to multiple downstream zones or zone-level devices and can receive return air from the multiple downstream zones or zone-level devices as well as outside air or fresh air that can be mixed with the return air. In situations in which outside air is added to the return air, it can be advantageous to thoroughly mix the outside air with the return air. Such can produce adequately mixed supply air that is discharged by the air handler device to the downstream zones and/or zone-level devices.

Air handler devices and other HVAC components are installed in buildings or other structures. Generally, these buildings allocate specific spaces for HVAC equipment, such as ceiling spaces, floor spaces, and may potentially have equipment rooms devoted to HVAC equipment.

Figure 24:
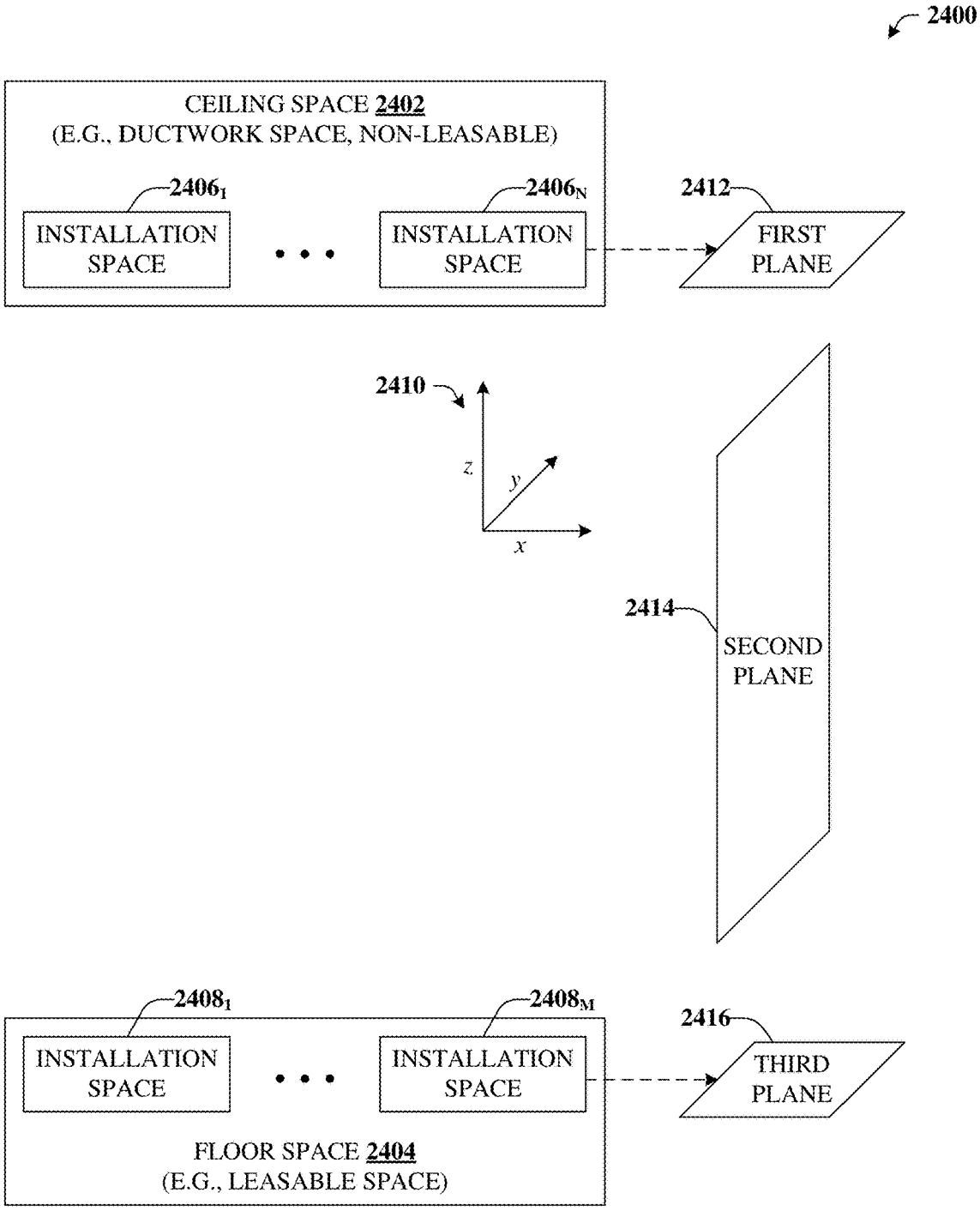
FIG. 24 illustrates a schematic diagram 2400 depicting an example building layout for accommodating air handler devices and other HVAC components, devices, or elements in accordance with certain embodiments of this disclosure.

With reference now to FIG. 24, schematic diagram 2400 depicts an example building layout for accommodating air handler devices and other HVAC components, devices, or elements in accordance with certain embodiments of this disclosure. In this example, two primary spaces are illustrated, namely, ceiling space 2402 and floor space 2404.

Ceiling space 2402 can be considered at or above a ceiling structure and/or an elevated space, and is typically where much of a building's ductwork exists or is foreseen to be installed. In addition to ductwork, ceiling space 2402 can comprise one or more (ceiling) installation spaces 2406, denoted here as installation spaces $\mathbf{2406}_1$-$\mathbf{2406}_N$, where N can be any whole number. Installation space(s) 2406 can be representative of a ceiling space that is suitable for installation of all or a portion of the disclosed air handler devices and/or other suitable HVAC equipment detailed herein.

Floor space 2404 can comprise one or more (floor) installation spaces 2408, denoted here as installation spaces $\mathbf{2408}_1$-$\mathbf{2408}_M$, where M can be any whole number. Installation space(s) 2408 can be representative of a floor space that is suitable for installation of all or a portion of the disclosed air handler devices and/or other suitable HVAC equipment detailed herein. While ceiling space 2402 can relate to elevated spaces, floor space 2404 can relate to floor-level space which is often leasable space and therefore commands a much greater premium than certain ceiling space 2402 that is non-leasable space. Thus, in some embodiments, it can be advantageous to reduce HVAC equipment footprint on floor space 2404, e.g., by shifting HVAC equipment typically installed in installation space 2408 (e.g., at floor level) to installation space 2406 (e.g., at ceiling level).

In order to better describe the disclosed air handler unit with a U-bend structure in the context of building layouts, consider coordinate system 2410, illustrating a commonly referenced Cartesian coordinate system, having three dimensional axes, x, y, and z. In coordinate system 2410, first plane 2412 can exist that can comprise the dimensions indicated by the x-y axes. First plane 2412 can intersect installation space(s) 2406 in some embodiments. In some embodiments, first plane 2412 can intersect spaces within ceiling space 2402 in which ductwork exists or is allocated for ductwork installation.

Consider as well, second plane 2414, which can be substantially perpendicular to first plane 2412. Second plane 2414 can therefore comprise dimensions indicated by the y-z axes as illustrated here or the x-z axes, or any angle of rotation about the z-axis, as all examples are substantially perpendicular to first plane 2412.

Third plane 2416 can be substantially parallel with first plane 2412 and can therefore also comprise dimensions of the x-y axes. Third plane 2416 can intersect installation space(s) 2408 in some embodiments. In some embodiments, third plane 2412 can intersect a floor or leasable floor space within a building. It is noted that in conventional buildings, a typical vertical distance between (ceiling) installation space 2406 and (floor) installation space 2408 is about 12 feet. Hence, although such can depend on the implementation or embodiment, about 12 feet can represent a common distance between first plane 2412 and third plane 2416. As a common range, this distance may be between 8 and 15 feet between the two planes 2412, 2416, which can also represent the regions of interest of second plane 2414, namely a distance between the floor and ceiling and/or the distance between the intersection of second plane 2414 with first plane 2412 and third plane 2416.

Figure 25:
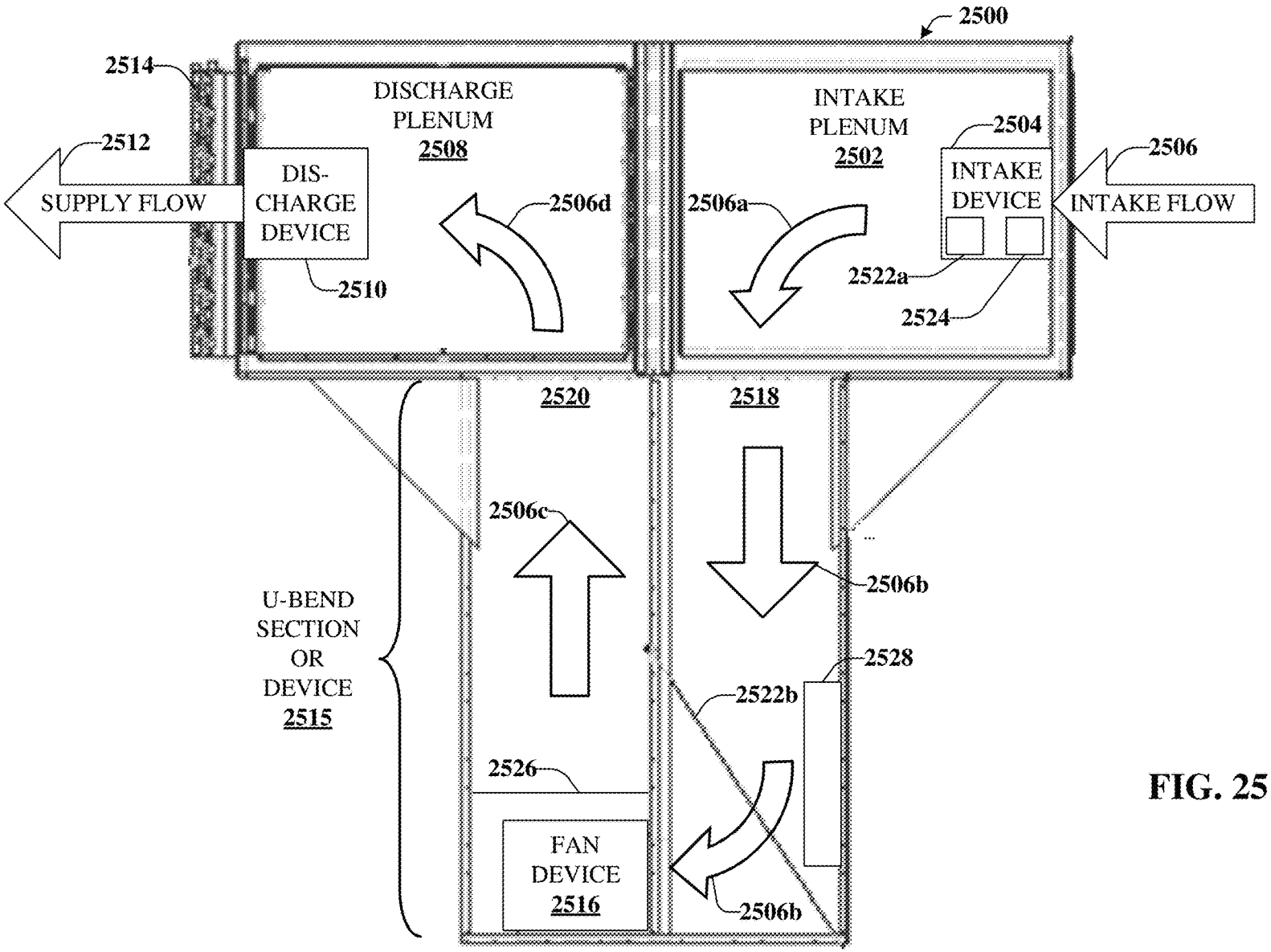
FIG. 25 illustrates a schematic block diagram of an example air handler device 2500 illustrated having a U-bend structure in accordance with certain embodiments of this disclosure.

While still referring to FIG. 24, but turning as well to FIG. 25, a schematic block diagram of an example air handler device 2500 is illustrated having a U-bend structure in accordance with certain embodiments of this disclosure. This U-bend structure can be indicative of an air flow path that changes directions about 180 degrees. This directional change can coincide with an intake and discharge of a fan device that is situated within the U-bend structure, and can be within a single plane (e.g., both paths can be on second plane 2414).

Air handler device 2500 can comprise intake plenum 2502. Intake plenum 2502 can comprise intake device 2504 that is configured to receive intake flow 2506. Intake flow 2506 can comprise intake air. This intake air can comprise one or both of return air or outside air that is to be mixed together by air handler device 2500. In some embodiments, intake device 2504 can comprise filter 2522*a*. Filter 2522*a* can be configured to filter the intake air. In some embodiments, intake device 2504 can comprise economizer device 2524. Economizer device 2524 can comprise at least one of a damper or a fan, e.g., to provide additional control over intake flow 2506.

Air handler device 2500 can further comprise discharge plenum 2508. Discharge plenum 2508 can comprise discharge device 2510 that is configured to discharge supply flow 2512. Supply flow 2512 can comprise supply air that is composed of the intake air that was mixed by air handler device 2500. In some embodiments, discharge device 2510 can comprise or be coupled to a thermal transfer unit (TTU) 2514. TTU 2514 can be configured to control a temperature of the supply air of supply flow 2512.

As illustrated, discharge plenum 2508 can be situated, or configured to be installed, adjacent to intake plenum 2500. As one example, intake plenum 2502 and discharge plenum 2508 can be adjacently situated in the same (ceiling) installation space 2406 or respectively installed in adjacent or contiguous installation spaces $\mathbf{2406}_1$-$\mathbf{2406}_N$.

In this example, both intake plenum 2502 and discharge plenum 2508 can be adjacently situated along and/or intersecting first plane 2412. Likewise, intake flow 2506 and discharge flow 2512 can be situated on (or substantially parallel to) first plane 2412. Even though intake flow 2506 and discharge flow 2512 can be in the same plane along with intake plenum 2502 and discharge plenum 2508 that are adjacent to one another, the entire air flow path through air handler device 2500 does not remain on that plane, but rather extends in other dimensions, due at least in part to U-bend device 2515, which may also be referred to herein as U-bend section 2515.

Hence, air handler device 2500 can further comprise U-bend device 2515 that can provide an air flow path between (adjacently situated) intake plenum 2502 and discharge plenum 2508. In more detail, U-bend device 2515 can comprise fan device 2516. Fan device 2516 can be configured to draw air (e.g., the intake air that is being mixed) from intake plenum 2502 and provide the air to discharge plenum 2508. Fan device 2516 can be a plenum fan, an axial fan, a centrifugal fan, or any other suitable type of fan. Fan device 2516 can comprise one or more fan devices 2516.

U-bend device 2515 can further comprise first channel 2518 and second channel 2520, one of which can comprise or encompass fan device 2516. First channel 2518 can extend from intake plenum 2502 to some region or location that is adjacent to fan device 2516. In some embodiments, first channel 2518 can comprise filter 2522*b*. Filter 2522*b* can be configured to filter the intake air.

Second channel can extend from discharge plenum 2508 to a second location adjacent to fan device 2516. As intake plenum 2502 and discharge plenum 2508 are situated adjacently, first channel 2518 and second channel 2520 can be similarly adjacent.

In this example, all portions of fan device 2516 are situated in second channel 2520, but all or portions of fan device 2516 might otherwise be situated in first channel 2518 in other implementations or embodiments. Regardless, it is appreciated that fan device 2516 can be installed in (floor) installation space 2408. Thus, fan device 2516 can intersect third plane 2416, whereas first channel 2518 and second channel 2520 can intersect or extend along second plane 2414.

As illustrated, after being received by intake device 2504, intake flow 2506 changes direction within intake plenum 2502, as illustrated at flow 2506*a*. Hence, flow 2506*a* potentially leaves first plane 2412 while potentially following a direction that is on second plane 2414. Upon entering first channel 2518, flow 2506*b* can be drawn into fan device 2516 and discharged by fan device 2516 into second channel 2520 as flow 2506*c* that can also be on second plane 2414. Once entering discharge plenum 2508, flow 2506*d* can again change direction, potentially rejoining first plane 2412 as supply flow 2512.

Figure 26:
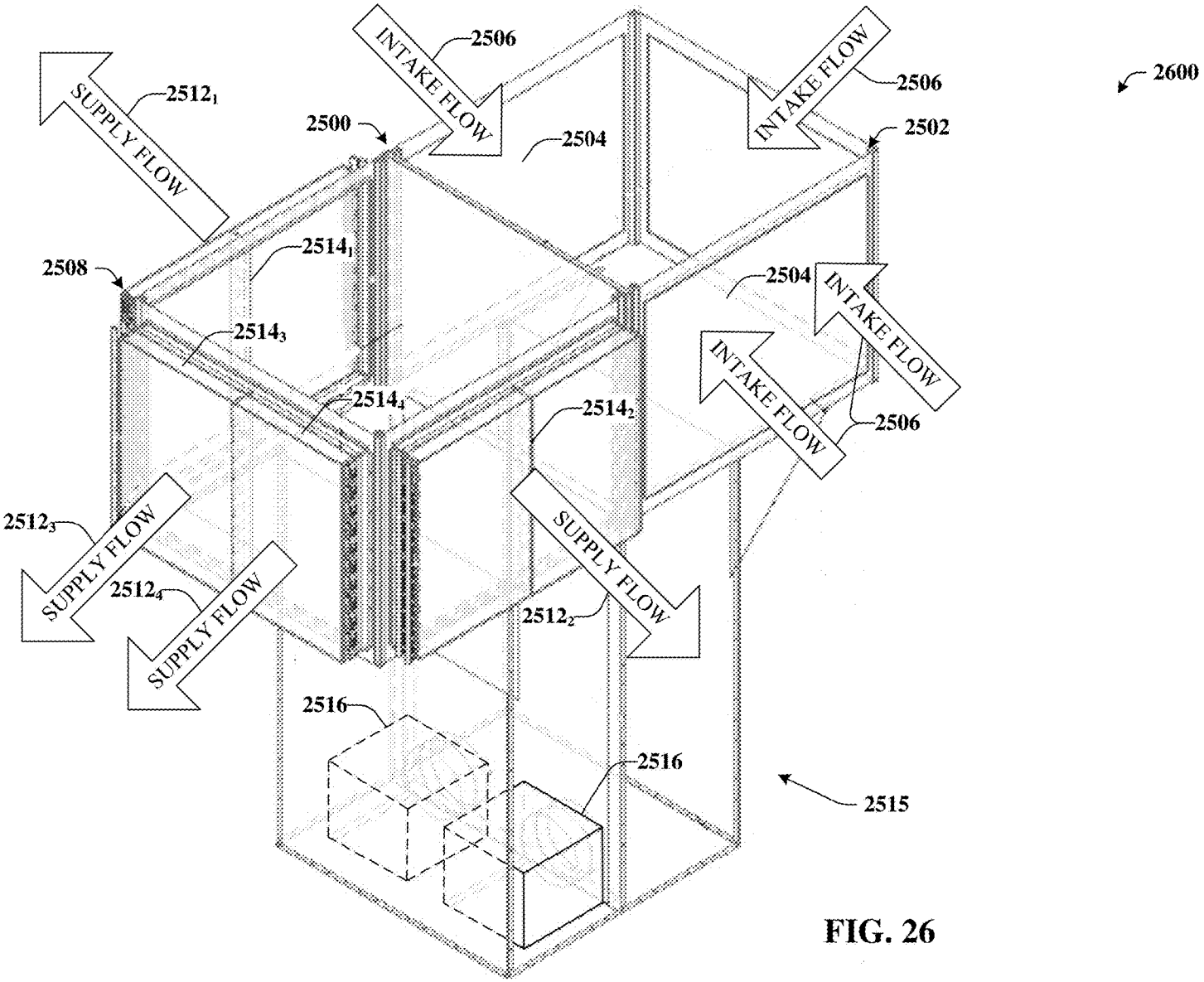
FIG. 26 illustrates a schematic block diagram 2600 of the example air handler device 2500 having a U-bend structure 2515 illustrated in an isometric view in accordance with certain embodiments of this disclosure.

Turning now to FIG. 26, a schematic block diagram 2600 of the example air handler device 2500 having a U-bend structure is illustrated in an isometric view in accordance with certain embodiments of this disclosure. As shown, U-bend section 2515 comprises multiple fan devices 2516.

Intake plenum 2502 can comprise multiple intake devices 2504 that can be respectively configured to receive respective intake flows 2506. In some embodiments, different intake flows 2506 can be fed into intake plenum 2502 from separate ducts or other equipment. As shown, any two intake flows 2506 may be received in the same direction as one another or may instead be received in different directions. In some embodiments, all or a portion of the various intake flows 2506 can be received in directions that are on first plane 2412, even though, within first plane 2412, the individual directions of respective intake flows 2506 can be in different directions. As noted, a first intake flow 2506 can be comprised of return air, while a second intake flow 2506 can be comprised of outside air to be mixed, and any or all of the associated intake device(s) 2504 can comprise an economizer device 2524 with a damper or a fan attached, as well as filter 2522*a* or other elements.

Further, discharge plenum 2508 can comprise multiple discharge devices 2510 that can be respectively configured to discharge respective supply flows 2512, denoted here as supply flows $\mathbf{2512}_1$-$\mathbf{2512}_4$ for clarity. In some embodiments, different supply flows 2512 can be generated for separate ducts or other equipment. As shown, any two supply flows 2512 may be discharged in the same direction as one another (e.g., supply flows $\mathbf{2512}_3$ and $\mathbf{2512}_4$) or may instead be discharged in different directions (e.g., supply flows $\mathbf{2512}_1$ vs. $\mathbf{2512}_2$ or $\mathbf{2512}_3$). In some embodiments, all or a portion of the various supply flows 2512 can be discharged in directions that are on first plane 2412, even though, within first plane 2412, the individual directions of respective supply flows 2512 can be in different directions. In some embodiments, discharge device 2510 can comprise a damper to control an associated supply flow 2512.

As noted, potentially each discharge device 2510 can comprise a respective TTU 2514, which are labeled here as TTU $\mathbf{2514}_1$-$\mathbf{2514}_4$ for the sake of clarity, that can be configured to control an associated temperature of an associated supply flow 2512. In some embodiments, TTUs 2514 can be configured to independently control the associated temperature such that a first temperature, e.g., controlled by TTU $\mathbf{2514}_1$ that affects a first supply flow $\mathbf{2512}_1$ can concurrently differ from a second temperature, e.g., controlled by TTU $\mathbf{2514}_2$ that affects a second supply flow $\mathbf{2512}_2$.

In some embodiments, TTU 2514 can be independently controllable to perform one or more of a group of thermal transfer operations. For instance, these thermal transfer operations can comprise a heating operation that heats an associated supply flow 2512, a cooling operation that cools the associated supply flow 2512, or a neutral operation that does not affect the temperature of the associated supply flow 2512. In some embodiments, TTU $\mathbf{2514}_1$ can perform one of the thermal transfer operations (e.g., the cooling operation) concurrently with TTU $\mathbf{2514}_2$ performing a different thermal transfer operation (e.g., the heating operations or the neutral operation).

These designs and techniques, suitably illustrated in FIGS. 25 and 26, can be advantageous for a number of reasons. For example, it is understood that each supply flow 2512 can supply air to different downstream zones or zone-level devices. Because each associated TTU 2514 can be independently controlled to meet the individual (and potentially different) downstream demands from a single location (e.g., the location of air handler device 2500), there is no need to install thermal transfer coils or other equipment at downstream zones as is done conventionally. Such can result in significant cost savings in terms of piping costs and mitigate the potential for damage due to leaks in piping infrastructure that, in conventional systems, extend throughout the majority of most buildings.

Another example advantage is that, even though intake plenum 2502 and discharge plenum 2508 can be adjacent to one another in ceiling space 2402, the total flow path can be substantial. For instance, U-bend section 2516 can provide a flow path that in many implementations is well over 20 feet (e.g., extending from ceiling space 2402 to floor space 2404 and back). Such can provide for superior mixing of the intake air over conventional designs. It is observed that mixing can occur for all flows 2506*a*-2506*d* between intake device 2504 to discharge device 2510.

As another example advantage, intake plenum 2502 and discharge plenum 2508, collectively representing the largest elements of air handler device 2500, can be situated in ceiling space 2402, thereby significantly reducing the footprint on potential leasable space. As one example, an equipment room can be much smaller than conventional expectations, both because intake plenum 2502 and discharge plenum 2508 can be adjacently situated and because both intake plenum 2502 and discharge plenum 2508 can be situated in ceiling space 2402.

However, fan device 2516, which is smaller by comparison and typically represents the portion of air handler device 2500 that is more frequently serviced, can be situated in floor space 2404, which can dramatically simplify replacement, repair, or maintenance of fan device 2516. In some embodiments, U-bend section 2516 can comprise service door 2526. Service door 2526 can be a full-service door, not merely a hatch that allows access to fan device 2516. In that regard, service door 2526 can have dimensions that are greater than dimensions of fan device 2516 and/or that are sufficient to remove or install fan device 2516 via service door 2526.

Likewise, U-bend device 2516 can comprise filter door or hatch 2528 that can facilitate access to filter 2522*b*. As illustrated here, service door 2526 can, depending on the implementation, be in either one of first channel 2518 or second channel 2520, which can depend on the location of fan device 2516. As illustrated here, service door 2526 is situated in second channel 2520 and filter door or hatch 2528 is in first channel 2518, but other implementations are contemplated.

Furthermore, other installation orientations or locations can vary based on the customer constraints. For example, while the present illustration illustrates intake plenum 2502 and discharge plenum 2508 being in ceiling space 2402 and fan device 2516 being in floor space 2404, this orientation can be reversed. Conceptually, such can be imaged by rotating the illustrated design 180 degrees and potentially making suitable other modifications to certain elements. In that case, intake plenum 2502 and discharge plenum 2508 may be situated in floor space 2404 and fan device 2516 may be situated in ceiling space 2402. Such an orientation may address specific ductwork layout, or other constraints of a customer.

In a different embodiment, substantially all portions of air handler device 2500 (e.g., intake plenum 2502, discharge plenum 2508, and fan device 2516) can be in either ceiling space 2402 or floor space 2404. Conceptually, such can be imaged by rotating the illustrated design 90 degrees. In ceiling-only embodiments, such can have the advantage of minimizing the leasable space footprint. In floor-only embodiments, such can have the advantage of simplifying all service operations for any portion of air handler device 2500.

In some embodiments, intake plenum 2502 and discharge plenum 2508 may not both be situated at an intersection of first plane 2412 and second plane 2414. For example, intake plenum 2502 and discharge plenum 2508 can be situated diagonally or cattycorner to one another (albeit, sill adjacent). In that case, it can be imaged that the shape of U-bend device 2516 would more closely resemble a "V" shape, however, such variations are considered to be within the spirit and scope of this disclosure. In other embodiments, there may multiple instances of U-bend device 2516 and/or additional channels, such as a third channel (e.g., similar in flow direction to first channel 2518) and a fourth channel (e.g., similar in flow direction to second channel 2520). Such can provide additional potential flow path length, which can further improve mixing or provide other advantages.

Still another advantage of the illustrated designs or techniques is a dramatic improvement in aero-acoustics. U-bend section 2516 can function to significantly reduce noise levels over conventional air handler devices. For example, the long flow paths can reduce noise-producing turbulence and acoustical lining can be applied to the first channel 2518 and/or the second channel 2520. Acoustical lining can also be applied to intake plenum 2502 and discharge plenum 2508.

Yet another advantage is that many of the individual elements of air handler device 2500 can be fabricated, shipped, and/or installed in a modular manner. For example, each of intake plenum 2502, discharge plenum 2508, and U-bend device 2512 can individually be sized to fit in a standard elevator, dramatically simplifying installation or retrofit installation.

As used herein, the term 'adjacent' is intended to mean being near to one another with no like element between. Thus, in the context of intake plenum 2502 and discharge plenum 2508 being adjacent, such can mean that these two elements (or associated housings or structures) are in contact or can mean that these two elements are near to one another with no other plenum device in between.

Figure 27:
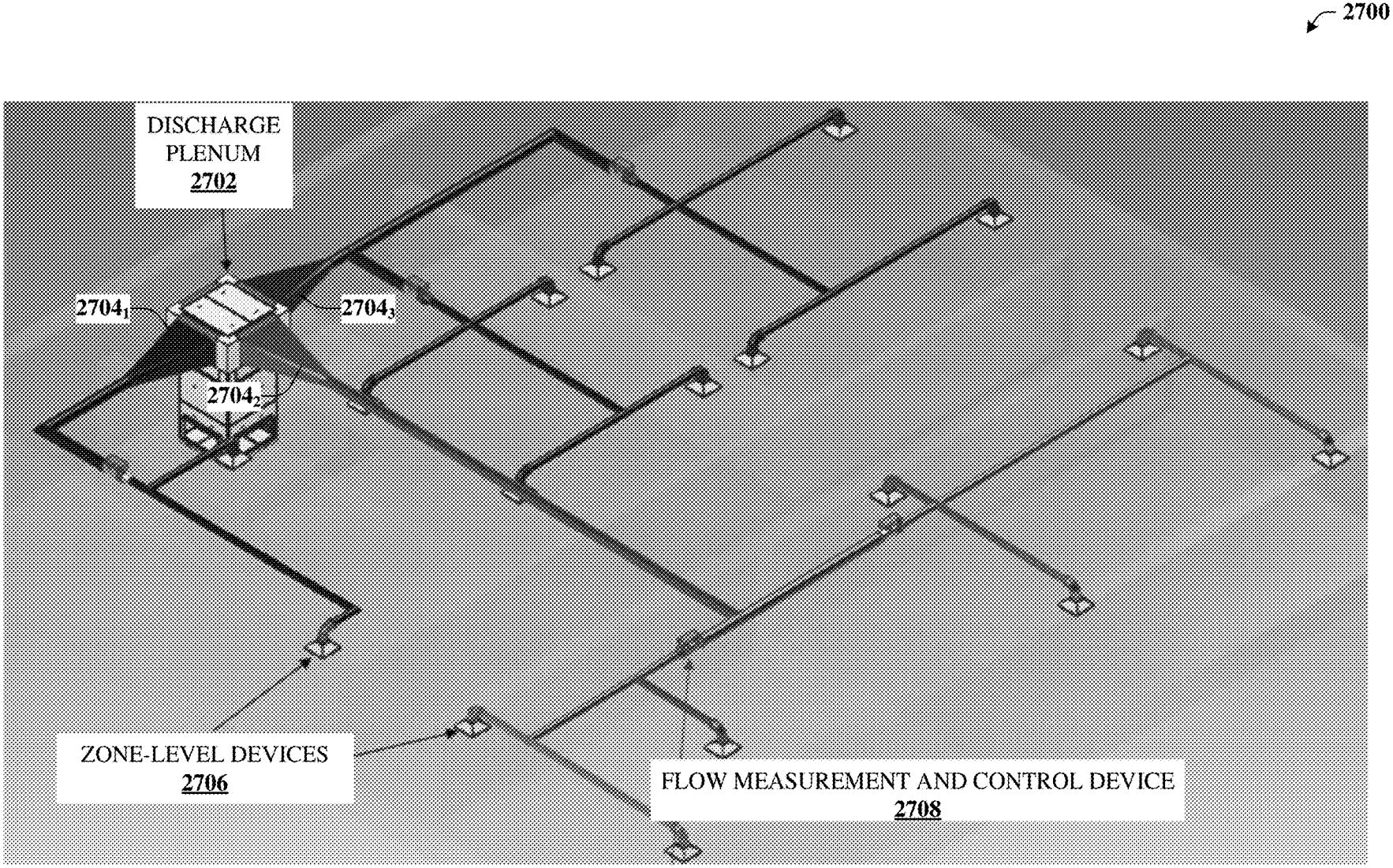
FIG. 27 illustrates a schematic diagram 2700 showing an example discharge plenum having multiple temperature controlled discharge devices integrated into a building duct layout in accordance with certain embodiments of this disclosure.

FIG. 27 illustrates a schematic diagram 2700 showing an example discharge plenum 2702 having multiple temperature controlled discharge devices 2704 integrated into a building duct layout in accordance with certain embodiments of this disclosure. Discharge plenum 2702 can in some embodiments be substantially similar to discharge plenum 2508 of FIGS. 25 and 26, supply plenum 1812, and/or other suitable plenums disclosed herein.

Hence, discharge plenum 2702 can have multiple discharge devices $\mathbf{2704}_1$-$\mathbf{2704}_3$ that respectively serve different portions of a building or a floor of a building. Thus, different supply flows (e.g., supply flows $\mathbf{2512}_1$-$\mathbf{2512}_3$) can be delivered to different discharge device 2704 and associated downstream devices such as zone-level devices 2706 (e.g., diffusers or other suitable devices) and flow measurement and control devices 2708, either of which may comprise a downstream damper device.

Because discharge devices 2704 can comprise independently controllable TTU (e.g., TTUs $\mathbf{2514}_1$-$\mathbf{2514}_3$), a zone or zones served by discharge device $\mathbf{2704}_1$ can be provided supply flows having a different temperature than downstream zones served by discharge devices $\mathbf{2704}_2$ or $\mathbf{2704}_3$. For example, a first downstream zone (e.g., on a south side of the building) served by discharge device $\mathbf{2704}_1$ can be served cool air, while a second downstream zone (e.g., on an east side of the building) can be served neutral or ambient temperature air by discharge device $\mathbf{2704}_2$, and while a third downstream zone (e.g., on a north side of the building) can be served heated air by discharge device $\mathbf{2704}_3$. Associated flow measurement and control device can modulate the supply air according to the demands of individual zones. In other words, discharge plenum 2702 and/or an associated air handler device can control the temperatures of all downstream zones directly (e.g., as requested by respective zone thermostats), by concurrently supplying hot air, cold air, or any temperature in between.

Individual zone demands can be met by controlling an exact amount of air (e.g., cubic feet per minute) commensurate to temperature using flow measurement and control device(s) 2708, which can have turndowns exceeding 300-1. Such can also facilitate self-balancing, which can minimize or reduce zone-level thermal transfer devices and hydronic infrastructure, adding sustainability and potentially resulting in a higher return on investment.

Zone-level device(s) 2706 can be configured for proper room mixing over a wide dynamic range of flows, including low flows. Such can also facilitate hybrid flex space that can reduce costly mechanical retrofits, which can enable healthy space and occupancy management to meet personal and organizational needs.

Example Operating Environments

Figure 28:
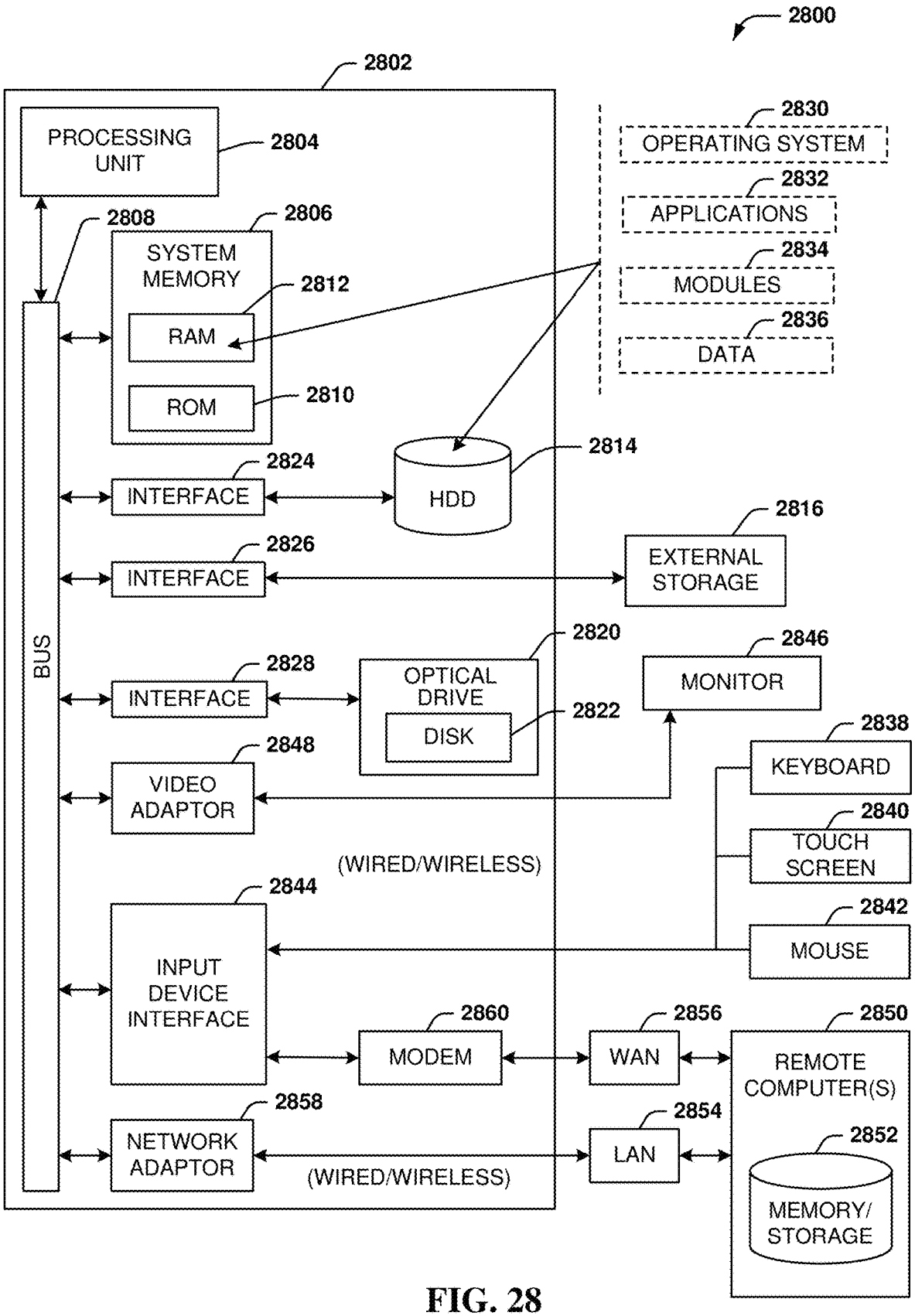
FIG. 28 illustrates a block diagram of an example, non-limiting computing environment by which one or more embodiments described herein can be fabricated or otherwise facilitated.

In order to provide additional context for various embodiments described herein, FIG. 28 and the following discussion are intended to provide a brief, general description of a suitable computing environment 2800 in which the various embodiments of the embodiment described herein can be implemented, for example, a device or product fabrication environment.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, Internet of Things (IoT) devices, distributed computing systems, as well as personal computers, hand-held computing devices, microprocessor-based or programmable consumer electronics, and the like, each of which can be operatively coupled to one or more associated devices.

The illustrated embodiments of the embodiments herein can be also practiced in distributed computing environments where certain tasks are performed by remote processing devices that are linked through a communications network. In a distributed computing environment, program modules can be located in both local and remote memory storage devices.

Computing devices typically include a variety of media, which can include computer-readable storage media, machine-readable storage media, and/or communications media, which two terms are used herein differently from one another as follows. Computer-readable storage media or machine-readable storage media can be any available storage media that can be accessed by the computer and includes both volatile and nonvolatile media, removable and non-removable media. By way of example, and not limitation, computer-readable storage media or machine-readable storage media can be implemented in connection with any method or technology for storage of information such as computer-readable or machine-readable instructions, program modules, structured data or unstructured data.

Computer-readable storage media can include, but are not limited to, random access memory (RAM), read only memory (ROM), electrically erasable programmable read only memory (EEPROM), flash memory or other memory technology, compact disk read only memory (CD-ROM), digital versatile disk (DVD), Blu-ray disc (BD) or other optical disk storage, magnetic cassettes, magnetic tape, magnetic disk storage or other magnetic storage devices, solid state drives or other solid state storage devices, or other tangible and/or non-transitory media which can be used to store desired information. In this regard, the terms "tangible" or "non-transitory" herein as applied to storage, memory or computer-readable media, are to be understood to exclude only propagating transitory signals per se as modifiers and do not relinquish rights to all standard storage, memory or computer-readable media that are not only propagating transitory signals per se.

Computer-readable storage media can be accessed by one or more local or remote computing devices, e.g., via access requests, queries or other data retrieval protocols, for a variety of operations with respect to the information stored by the medium.

Communications media typically embody computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

With reference again to FIG. 28, the example environment 2800 for implementing various embodiments of the aspects described herein includes a computer 2802, the computer 2802 including a processing unit 2804, a system memory 2806 and a system bus 2808. The system bus 2808 couples system components including, but not limited to, the system memory 2806 to the processing unit 2804. The processing unit 2804 can be any of various commercially available processors. Dual microprocessors and other multi-processor architectures can also be employed as the processing unit 2804.

The system bus 2808 can be any of several types of bus structure that can further interconnect to a memory bus (with or without a memory controller), a peripheral bus, and a local bus using any of a variety of commercially available bus architectures. The system memory 2806 includes ROM 2810 and RAM 2812. A basic input/output system (BIOS) can be stored in a non-volatile memory such as ROM, erasable programmable read only memory (EPROM), EEPROM, which BIOS contains the basic routines that help to transfer information between elements within the computer 2802, such as during startup. The RAM 2812 can also include a high-speed RAM such as static RAM for caching data.

The computer 2802 further includes an internal hard disk drive (HDD) 2814 (e.g., EIDE, SATA), one or more external storage devices 2816 (e.g., a magnetic floppy disk drive (FDD) 2816, a memory stick or flash drive reader, a memory card reader, etc.) and an optical disk drive 2820 (e.g., which can read or write from a CD-ROM disc, a DVD, a BD, etc.). While the internal HDD 2814 is illustrated as located within the computer 2802, the internal HDD 2814 can also be configured for external use in a suitable chassis (not shown). Additionally, while not shown in environment 2800, a solid state drive (SSD) could be used in addition to, or in place of, an HDD 2814. The HDD 2814, external storage device(s) 2816 and optical disk drive 2820 can be connected to the system bus 2808 by an HDD interface 2824, an external storage interface 2826 and an optical drive interface 2828, respectively. The interface 2824 for external drive implementations can include at least one or both of Universal Serial Bus (USB) and Institute of Electrical and Electronics Engineers (IEEE) 2894 interface technologies. Other external drive connection technologies are within contemplation of the embodiments described herein.

The drives and their associated computer-readable storage media provide nonvolatile storage of data, data structures, computer-executable instructions, and so forth. For the computer 2802, the drives and storage media accommodate the storage of any data in a suitable digital format. Although the description of computer-readable storage media above refers to respective types of storage devices, it should be appreciated by those skilled in the art that other types of storage media which are readable by a computer, whether presently existing or developed in the future, could also be used in the example operating environment, and further, that any such storage media can contain computer-executable instructions for performing the methods described herein.

A number of program modules can be stored in the drives and RAM 2812, including an operating system 2830, one or more application programs 2832, other program modules 2834 and program data 2836. All or portions of the operating system, applications, modules, and/or data can also be cached in the RAM 2812. The systems and methods described herein can be implemented utilizing various commercially available operating systems or combinations of operating systems.

Computer 2802 can optionally comprise emulation technologies. For example, a hypervisor (not shown) or other intermediary can emulate a hardware environment for operating system 2830, and the emulated hardware can optionally be different from the hardware illustrated in FIG. 28. In such an embodiment, operating system 2830 can comprise one virtual machine (VM) of multiple VMs hosted at computer 2802. Furthermore, operating system 2830 can provide runtime environments, such as the Java runtime environment or the .NET framework, for applications 2832. Runtime environments are consistent execution environments that allow applications 2832 to run on any operating system that includes the runtime environment. Similarly, operating system 2830 can support containers, and applications 2832 can be in the form of containers, which are lightweight, standalone, executable packages of software that include, e.g., code, runtime, system tools, system libraries and settings for an application.

Further, computer 2802 can be enable with a security module, such as a trusted processing module (TPM). For instance with a TPM, boot components hash next in time boot components, and wait for a match of results to secured values, before loading a next boot component. This process can take place at any layer in the code execution stack of computer 2802, e.g., applied at the application execution level or at the operating system (OS) kernel level, thereby enabling security at any level of code execution.

A user can enter commands and information into the computer 2802 through one or more wired/wireless input devices, e.g., a keyboard 2838, a touch screen 2840, and a pointing device, such as a mouse 2842. Other input devices (not shown) can include a microphone, an infrared (IR) remote control, a radio frequency (RF) remote control, or other remote control, a joystick, a virtual reality controller and/or virtual reality headset, a game pad, a stylus pen, an image input device, e.g., camera(s), a gesture sensor input device, a vision movement sensor input device, an emotion or facial detection device, a biometric input device, e.g., fingerprint or iris scanner, or the like. These and other input devices are often connected to the processing unit 2804 through an input device interface 2844 that can be coupled to the system bus 2808, but can be connected by other interfaces, such as a parallel port, an IEEE 1394 serial port, a game port, a USB port, an IR interface, a BLUETOOTH® interface, etc.

A monitor 2846 or other type of display device can be also connected to the system bus 2808 via an interface, such as a video adapter 2848. In addition to the monitor 2846, a computer typically includes other peripheral output devices (not shown), such as speakers, printers, etc.

The computer 2802 can operate in a networked environment using logical connections via wired and/or wireless communications to one or more remote computers, such as a remote computer(s) 2850. The remote computer(s) 2850 can be a workstation, a server computer, a router, a personal computer, portable computer, microprocessor-based entertainment appliance, a peer device or other common network node, and typically includes many or all of the elements described relative to the computer 2802, although, for purposes of brevity, only a memory/storage device 2852 is illustrated. The logical connections depicted include wired/wireless connectivity to a local area network (LAN) 2854 and/or larger networks, e.g., a wide area network (WAN) 2856. Such LAN and WAN networking environments are commonplace in offices and companies, and facilitate enterprise-wide computer networks, such as intranets, all of which can connect to a global communications network, e.g., the Internet.

When used in a LAN networking environment, the computer 2802 can be connected to the local network 2854 through a wired and/or wireless communication network interface or adapter 2858. The adapter 2858 can facilitate wired or wireless communication to the LAN 2854, which can also include a wireless access point (AP) disposed thereon for communicating with the adapter 2858 in a wireless mode.

When used in a WAN networking environment, the computer 2802 can include a modem 2860 or can be connected to a communications server on the WAN 2856 via other means for establishing communications over the WAN 2856, such as by way of the Internet. The modem 2860, which can be internal or external and a wired or wireless device, can be connected to the system bus 2808 via the input device interface 2844. In a networked environment, program modules depicted relative to the computer 2802 or portions thereof, can be stored in the remote memory/storage device 2852. It will be appreciated that the network connections shown are example and other means of establishing a communications link between the computers can be used.

When used in either a LAN or WAN networking environment, the computer 2802 can access cloud storage systems or other network-based storage systems in addition to, or in place of, external storage devices 2816 as described above. Generally, a connection between the computer 2802 and a cloud storage system can be established over a LAN 2854 or WAN 2856 e.g., by the adapter 2858 or modem 2860, respectively. Upon connecting the computer 2802 to an associated cloud storage system, the external storage interface 2826 can, with the aid of the adapter 2858 and/or modem 2860, manage storage provided by the cloud storage system as it would other types of external storage. For instance, the external storage interface 2826 can be configured to provide access to cloud storage sources as if those sources were physically connected to the computer 2802.

The computer 2802 can be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, store shelf, etc.), and telephone. This can include Wireless Fidelity (Wi-Fi) and BLUETOOTH® wireless technologies. Thus, the communication can be a predefined structure as with a conventional network or simply an ad hoc communication between at least two devices.

As used in this application, the terms "component," "system," "platform," "interface," and the like, can refer to and/or can include a computer-related entity or an entity related to an operational machine with one or more specific functionalities. The entities disclosed herein can be either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine, e.g., within a cloud computing system.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration and are intended to be non-limiting. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As it is employed in the subject specification, the term "processor" can refer to substantially any computing processing unit or device comprising, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Further, processors can exploit nano-scale architectures such as, but not limited to, molecular and quantum-dot based transistors, switches and gates, in order to optimize space usage or enhance performance of user equipment. A processor can also be implemented as a combination of computing processing units. In this disclosure, terms such as "store," "storage," "data store," data storage," "database," and substantially any other information storage component relevant to operation and functionality of a component are utilized to refer to "memory components," entities embodied in a "memory," or components comprising a memory. It is to be appreciated that memory and/or memory components described herein can be either volatile memory or nonvolatile memory or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), flash memory, or nonvolatile random-access memory (RAM) (e.g., ferroelectric RAM (FeRAM). Volatile memory can include RAM, which can act as external cache memory, for example. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM (RDRAM). Additionally, the disclosed memory components of systems or computer-implemented methods herein are intended to include, without being limited to including, these and any other suitable types of memory.

What has been described above include mere examples of systems and computer-implemented methods. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim. The descriptions of the various embodiments have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Example Aspects

Aspects denoted with the letter "A" generally relate to an evase device, aspects denoted with the letter "B" generally relate to a fluid intake device, aspects denoted with the letter "C" generally relate to a fan intake device, and aspects denoted with the letter "D" generally relate to an air handler device. It is appreciated that aspects denoted with a same letter can generally be combined with together in any suitable combination. In some cases, if relevant, any aspect noted below can be combined with any other aspect. In some cases aspects of different letters can be combined to produce a combined device or product such as, for example, an aspect having the letter D (e.g., an air handler device) can be combined with suitable any combination of aspects having letters A-C (e.g., an air handler device further improved by an evase device, a fluid intake device, and/or a fan intake device).

Aspect A1. An evase device, comprising: a housing that encompasses a channel that extends in a longitudinal direction from a first side of the housing to a second side of the housing; a first opening, situated at the first side of the housing, configured to receive a flow of a fluid discharged by a fan; and a second opening, situated at the second side of the housing, configured to discharge the flow into a duct, wherein, at the second side, the housing has a rounded corner determined to mitigate a reverse flow of the fluid at corners of the duct.

Aspect A2. The system or device in accordance with aspect A1, wherein a shape of the rounded corners is designed based on a Reynolds number calculation.

Aspect A3. The system or device in accordance with aspect A1 or any suitable previous aspect, wherein the fan is an axial fan.

Aspect A4. The system or device in accordance with aspect A1 or any suitable previous aspect, wherein the fan is an axial fan.

Aspect A5. The system or device in accordance with aspect A1 or any suitable previous aspect, wherein the corners of the duct are squared corners.

Aspect A6. The system or device in accordance with aspect A1 or any suitable previous aspect, wherein the fluid discharged by the fan flows in the longitudinal direction from the first opening to the second opening.

Aspect A7. The system or device in accordance with aspect A1 or any suitable previous aspect, wherein the fluid discharged by the fan has a velocity pressure that is converted to static pressure less an impact loss.

Aspect A8. The system or device in accordance with aspect A7 or any suitable previous aspect, wherein the fluid discharged by the fan has a velocity pressure that is converted to static pressure less an impact loss.

Aspect A9. The system or device in accordance with aspect A1 or any suitable previous aspect, wherein the first opening has an annular shape having a diameter that matches an impeller hub diameter of the fan.

Aspect A10. The system or device in accordance with aspect A1 or any suitable previous aspect, further comprising the fan, wherein the fan is mounted to the housing at the first opening.

Aspect A11. The system or device in accordance with aspect A10 or any suitable previous aspect, wherein the housing operates as a fan housing for the fan.

Aspect A12. The system or device in accordance with aspect A10 or any suitable previous aspect, wherein a motor of the fan is situated outside the channel.

Aspect A13. The system or device in accordance with aspect A10 or any suitable previous aspect, wherein a motor of the fan is situated within the channel.

Aspect A14. The system or device in accordance with aspect A1 or any suitable previous aspect, further comprising an intermediate baffle situated in the channel.

Aspect A15. The system or device in accordance with aspect A14 or any suitable previous aspect, wherein the intermediate baffle has rounded corners at an end that discharges the fluid into the channel.

Aspect A16. The system or device in accordance with aspect A1 or any suitable previous aspect, further comprising a container for the evase device that is filled with a material that absorbs sound.

Aspect A17. A method of fabricating an evase device, comprising: forming, by a device comprising a processor, a housing that encompasses a channel that extends in a longitudinal direction from a first side of the housing to a second side of the housing; forming, by the device, a first opening in the housing that is situated at the first side of the housing, wherein the first opening is configured to receive a flow of a fluid discharged by a fan; forming, by the device, a second opening in the housing that is situated at the second side of the housing, wherein the second opening is configured to discharge the flow of a fluid into a duct; and forming, by the device, rounded corners at the second side of the housing, wherein the rounded corners are determined to mitigate a reverse flow of the fluid at corners of the duct.

Aspect A18. The method in accordance with aspect A17 or any suitable previous aspect, further comprising forming or assembling, by the device, an intermediate baffle situated in the channel.

Aspect A19. The method in accordance with aspect A17 or any suitable previous aspect, further comprising forming or assembling, by the device, the fan situated within the housing.

Aspect A20. The method in accordance with aspect A19 or any suitable previous aspect, further comprising forming or assembling, by the device, a motor of the fan that is situated within the channel.

Aspect B1. An intake device, comprising: an intake duct comprising: a first opening by which a fluid enters the intake duct and a second opening by which the fluid exits the intake duct, wherein the first opening and the second opening are substantially circular about a longitudinal axis of the intake duct, and wherein a first circumference of the first opening is larger than a second circumference of the second opening; and an interior surface that extends from the first opening to the second opening, providing a passageway for a flow of the fluid; the intake device further comprising: a top cover, situated a distance from the first opening, that prevents the fluid from entering the intake duct in a direction along the longitudinal axis, and that permits the fluid to enter the intake duct in a radial direction that is radial about the longitudinal axis; and an inner funnel, comprising: an upper portion that couples to the top cover; a lower portion extends into the passageway; and an outer surface, spanning the upper portion and the lower portion, that is sloped, causing the flow of the fluid entering the intake device in the radial direction to change to the direction along the longitudinal axis.

Aspect B2. The system or device in accordance with aspect B1 or any suitable previous aspect, wherein the interior surface of the intake duct provides a smoothly tapered surface that encompasses a substantially funnel-shaped passageway for the flow of the fluid.

Aspect B3. The system or device in accordance with aspect B1 or any suitable previous aspect, wherein an angular difference of the change in direction of the flow, representing a difference between the radial direction and the direction along the longitudinal axis, is between about 80 degrees and 100 degrees.

Aspect B4. The system or device in accordance with aspect B1 or any suitable previous aspect, wherein an angular difference of the change in direction of the flow, representing a difference between the radial direction and the direction along the longitudinal axis, is approximately 90 degrees.

Aspect B5. The system or device in accordance with aspect B1 or any suitable previous aspect, wherein a cross-section of the passageway of the intake duct has an area that is a difference between a first area of the interior surface of the intake duct at the cross-section and a second area of the outer surface of the inner funnel at the cross-section.

Aspect B6. The system or device in accordance with aspect B5 or any suitable previous aspect, wherein the area of the cross-section of the passageway decreases when moving along the longitudinal axis from the first opening to the second opening.

Aspect B7. The system or device in accordance with aspect B6 or any suitable previous aspect, wherein the area that decreases when moving from the first opening to the second opening is determined to cause the flow of the fluid in the passageway to increase in velocity while flowing toward the second opening.

Aspect B8. The system or device in accordance with aspect B7 or any suitable previous aspect, wherein the increase in velocity is determined to have a damping effect on turbulence of the flow.

Aspect B9. The system or device in accordance with aspect B1 or any suitable previous aspect, wherein geometries of the outer surface of the inner funnel and the interior surface of the intake duct are determined to cause the flow to be laminar.

Aspect B10. The system or device in accordance with aspect B9 or any suitable previous aspect, wherein the geometries are determined to mitigate losses due to flow separation along bounding surfaces of a turning flow, and wherein the turning flow represents the flow entering in the radial direction and turning toward the longitudinal direction.

Aspect B11. The system or device in accordance with aspect B9 or any suitable previous aspect, wherein the geometries are determined to cause at least a portion of the flow entering the intake device to follow an elliptical path when changing from the radial direction to the direction along the longitudinal axis.

Aspect B12. An intake device, comprising: an intake duct, having a cover plate that is configured to prevent a fluid from entering the intake duct in a longitudinal direction, wherein the intake duct is configured to receive, at a first end, the fluid in a radial direction and to discharge, at a second end, the fluid substantially in the longitudinal direction; and an inner funnel situated between the cover plate and the second end, wherein the inner funnel has a funnel geometry that causes the fluid to follow an elliptical path when changing from the radial direction to the longitudinal direction.

Aspect B13. The system or device in accordance with aspect B12 or any suitable previous aspect, wherein an area of a cross-section of an inner chamber of the intake duct, through which the fluid flows, decreases when moving along the longitudinal axis from the first end to the second end.

Aspect B14. The system or device in accordance with aspect B12 or any suitable previous aspect, wherein the intake duct has a duct geometry configured to reduce a surface area normal to a flow of the fluid as the fluid flows from the first end to the second end.

Aspect B15. The system or device in accordance with aspect B14 or any suitable previous aspect, wherein the duct geometry is determined to cause the flow to be laminar.

Aspect B16. The system or device in accordance with aspect B14 or any suitable previous aspect, wherein the duct geometry is determined to mitigate losses due to flow separation along bounding surfaces of a turning flow, and wherein the turning flow represents the flow entering in the radial direction and turning toward the longitudinal direction.

Aspect B17. A method of fabricating an intake device, comprising: forming, by a device comprising a processor, an intake duct, having a cover plate that is configured to prevent a fluid from entering the intake device in a longitudinal direction, wherein the intake device is configured to receive, at a first end, the fluid in a radial direction and to discharge, at a second end, the fluid substantially in the longitudinal direction; and forming, by the device, an inner funnel situated between the cover plate and the second end, wherein the inner funnel has a funnel geometry that causes the fluid to follow an elliptical path when changing from the radial direction to the longitudinal direction.

Aspect B18. The method in accordance with aspect B17 or any suitable previous aspect, wherein the forming the intake duct and the forming the inner funnel further comprises, determining, by the device, that geometries of the intake duct and the inner funnel cause a flow of the fluid through the intake device to be laminar.

Aspect B19. The method in accordance with aspect B17 or any suitable previous aspect, wherein the forming the intake duct and the forming the inner funnel further comprises, determining, by the device, that geometries of the intake duct and the inner funnel result in a continuously decreasing cross-sectional area when moving along the longitudinal axis toward the second end.

Aspect B20. The method in accordance with aspect B17 or any suitable previous aspect, wherein the forming the intake duct and the forming the inner funnel further comprises, determining, by the device, that geometries of the intake duct and the inner funnel cause a flow of the fluid through the intake device to accelerate when moving toward the second end.

Aspect C1. An aero-acoustical fan intake device, comprising: an inlet face comprising an inlet opening configured to receive a flow of a fluid; a discharge face comprising a discharge opening configured to discharge the flow of the fluid; and a housing that encompasses a flow channel that extends from the inlet opening to the discharge opening, wherein a cross-sectional area of the flow channel varies between the inlet opening and the discharge opening in a manner that is determined to cause the flow of the fluid through the flow channel to continuously accelerate from a first location of the channel to the discharge opening.

Aspect C2. The system or device in accordance with aspect C1 or any suitable previous aspect, of claim 1, wherein the inlet opening has an annulus shape.

Aspect C3. The system or device in accordance with aspect C1 or any suitable previous aspect, of claim 1, wherein the discharge opening has an annulus shape.

Aspect C4. The system or device in accordance with aspect C1 or any suitable previous aspect, of claim 1, wherein the first location is at the inlet opening.

Aspect C5. The system or device in accordance with aspect C1 or any suitable previous aspect, of claim 1, wherein the first location is about midway between the inlet opening and the discharge opening.

Aspect C6. The system or device in accordance with aspect C1 or any suitable previous aspect, of claim 1, wherein the first location is about one third of a distance between the inlet opening and the discharge opening.

Aspect C7. The system or device in accordance with aspect C1 or any suitable previous aspect, of claim 1, wherein the inlet opening receives the flow of the fluid from an inlet duct or plenum.

Aspect C8. The system or device in accordance with aspect C7 or any suitable previous aspect, of claim 1, wherein the cross-sectional area of the flow channel at the first opening is less than one-half of a cross-sectional area of the inlet face.

Aspect C9. The system or device in accordance with aspect C1 or any suitable previous aspect, of claim 1, further comprising a material determined to absorb noise that is distributed within the housing around the flow channel.

Aspect C10. The system or device in accordance with aspect C1 or any suitable previous aspect, of claim 1, wherein the cross-sectional area of the flow channel monotonically decreases from the inlet opening to the discharge opening at substantially an area swept by impellers of a fan situated proximal to the discharge opening.

Aspect C11. The system or device in accordance with aspect C1 or any suitable previous aspect, of claim 1, wherein the inlet face is shaped as a bulb and the inlet opening surrounds the bulb.

Aspect C12. The system or device in accordance with aspect C11 or any suitable previous aspect, of claim 1, wherein the bulb has a bulb diameter that is determined to be greater than an impeller diameter of a fan.

Aspect C13. The system or device in accordance with aspect C1 or any suitable previous aspect, of claim 1, wherein a geometry of the flow channel that is determined to cause the flow of the fluid to continuously accelerate is determined to result in a reduced energy loss across the aero-acoustical fan intake device.

Aspect C14. The system or device in accordance with aspect C13 or any suitable previous aspect, of claim 1, wherein the reduced energy loss across the aero-acoustical fan intake device is representative of a decrease in total pressure through the aero-acoustical fan intake device that is less than about 10% of an impeller velocity pressure.

Aspect C15. The system or device in accordance with aspect C13 or any suitable previous aspect, of claim 1, wherein the reduced energy loss across the aero-acoustical fan intake device is representative of a decrease in total pressure through the aero-acoustical fan intake device that is less than about 50% of an impeller velocity pressure.

Aspect C16. A method of fabricating a fan intake device, comprising: forming, by a device comprising a processor, an inlet face surrounded by an inlet opening configured to receive a flow of a fluid; forming, by the device, a discharge face surrounded by a discharge opening configured to discharge the flow of the fluid; and forming, by the device, a housing that encompasses a channel that extends from the inlet opening to the discharge opening, wherein a cross-sectional area of the channel varies between the inlet opening and the discharge opening in a manner that is determined to cause the flow of the fluid through the channel to continuously accelerate from a first location of the channel to the discharge opening.

Aspect C17. The method in accordance with aspect C16 or any suitable previous aspect, wherein the forming the housing comprises determining that the cross-sectional area of the channel at the first opening is less than one-half of a cross-sectional area of the inlet opening.

Aspect C18. The method in accordance with aspect C16 or any suitable previous aspect, wherein the forming the housing comprises determining that the cross-sectional area of the channel monotonically decreases from the inlet opening to the discharge opening at substantially an area swept by the fan impellers.

Aspect C19. The method in accordance with aspect C16 or any suitable previous aspect, wherein the forming the housing comprises determining that a geometry of the flow causes a reduced energy loss across the fan intake device.

Aspect D1. An air handler device, comprising: a mixing plenum configured to receive multiple flows of air from multiple different ducts or intakes that feed the mixing plenum; a fan device configured to receive a mixing plenum flow from the mixing plenum and to discharge a supply flow; and a supply plenum configured to receive the supply flow from the fan device, wherein the supply plenum comprises:

a plurality of duct interfaces respectively configured to interface with a different one of a plurality of supply ducts; and a plurality of thermal transfer units comprising a first thermal transfer unit and a second thermal transfer unit that are respectively situated in different ones of the plurality of duct interfaces, wherein the first thermal transfer unit affecting a first flow is configured to a first temperature concurrently with the second thermal transfer affecting a second air flow being configured to a second temperature that differs from the first temperature.

Aspect D2. The system or device in accordance with aspect D1 or any suitable previous aspect, of claim 1, wherein a first flow of the multiple flows comprises return air of a heating, ventilation, and air conditioning (HVAC) system.

Aspect D3. The system or device in accordance with aspect D1 or any suitable previous aspect, of claim 1, wherein a second flow of the multiple flows comprises fresh air.

Aspect D4. The system or device in accordance with aspect D1 or any suitable previous aspect, of claim 1, wherein a duct of the multiple different ducts that feed the mixing plenum comprises at least one of a group comprising: a thermal transfer device configured to exchange heat with a corresponding flow through the duct and a filter device configured to filter the corresponding flow.

Aspect D5. The system or device in accordance with aspect D1 or any suitable previous aspect, of claim 1, wherein the fan is a centrifugal fan.

Aspect D6. The system or device in accordance with aspect D1 or any suitable previous aspect, of claim 1, further comprising multiple fan devices situated between the mixing plenum and the supply plenum.

Aspect D7. The system or device in accordance with aspect D1 or any suitable previous aspect, of claim 1, wherein the plurality of thermal transfer units are individually configured to heat, cool, or match in temperature a flow of air independently of other members of the plurality of thermal transfer units.

Aspect D8. The system or device in accordance with aspect D1 or any suitable previous aspect, of claim 1, wherein the plurality of duct interfaces comprise four duct interfaces.

Aspect D9. The system or device in accordance with aspect D1 or any suitable previous aspect, of claim 1, wherein the plurality of duct interfaces comprise three duct interfaces.

Aspect D10. The system or device in accordance with aspect D1 or any suitable previous aspect, of claim 1, wherein a plurality of supply air flows that flow into the plurality of duct interfaces flow in different directions.

Aspect D11. The system or device in accordance with aspect D1 or any suitable previous aspect, of claim 1, wherein at least two of a plurality of supply air flows that flow into two of the plurality of duct interfaces flow in a same direction.

Aspect D12. A heating, ventilation, and air conditioning (HVAC) product, comprising: an air handler component configured to circulate a flow of air within an HVAC system situated at a site the HVAC product is to be installed, wherein the air handler device comprises a top surface that is, relative to an installation at the site, on top of the air handler component and has a first height that is, relative to the installation, a height of the air handler component; and a heat exchange device configured to exchange heat with the flow of air, wherein the heat exchange device has a second height that is, relative to the installation, a height of the heat exchange device, and wherein the heat exchange device is situated on the top surface of the air handler component, resulting in the HVAC product having a total height that is, relative to the installation, determined to be less than or equal to a defined height constraint.

Aspect D13. The system or device in accordance with aspect D12 or any suitable previous aspect, of claim 1, wherein the defined height constraint is determined to satisfy a local building code of the installation site.

Aspect D14. The system or device in accordance with aspect D12 or any suitable previous aspect, of claim 1, wherein the defined height constraint is determined to satisfy a transportation code applicable to a transportation route between a manufacturing site of the HVAC product and the installation site.

Aspect D15. The system or device in accordance with aspect D12 or any suitable previous aspect, of claim 1, wherein the defined height constraint is 14 feet.

Aspect D16. The system or device in accordance with aspect D12 or any suitable previous aspect, of claim 1, wherein the defined height constraint is 10 feet.

Aspect D17. The system or device in accordance with aspect D12 or any suitable previous aspect, of claim 1, wherein the air handler component comprises an evase device, wherein the evase device comprises a housing configured to couple, at an interface, to a duct or plenum at the site, and wherein the housing of the evase has rounded corners at the interface that are determined to mitigate a reverse flow of the flow of air at corners of the duct.

Aspect D18. The system or device in accordance with aspect D17 or any suitable previous aspect, of claim 1, wherein the rounded corners have a shape that is determined based on a Reynolds number calculation.

Aspect D19. The system or device in accordance with aspect D18 or any suitable previous aspect, of claim 1, wherein a height of the evase device is determined to facilitate the total height satisfying the defined height constraint based on the shape of the rounded corners that, by mitigating the reverse flow, reduce turbulence in the flow of air over a shorter distance represented by the height of the evase device.

Aspect D20. The system or device in accordance with aspect D17 or any suitable previous aspect, of claim 1, further comprising a fan that is integrated into the housing of the evase.

Aspect D21. The system or device in accordance with aspect D20 or any suitable previous aspect, of claim 1, wherein a height of the evase device is determined to be reduced in response to situating a motor of the fan on a downstream side of an impeller of the fan.

Aspect D22. The system or device in accordance with aspect D17 or any suitable previous aspect, of claim 1, further comprising a fan that is integrated into the housing of the evase.

Aspect D23. The system or device in accordance with aspect D12 or any suitable previous aspect, of claim 1, wherein the air handler component comprises a mixing plenum that receives the flow of air, wherein the mixing plenum comprises multiple intake openings, comprising: a first opening that receives into the mixing plenum a first portion of the flow of air from a first direction; and a second opening that receives into the mixing plenum a second portion of the flow of air from a second direction that differs from the first direction.

Aspect D24. The system or device in accordance with aspect D23 or any suitable previous aspect, of claim 1, wherein the heat exchange device comprises a separate coil array unit for each of the multiple intake openings.

Aspect D25. The system or device in accordance with aspect D24 or any suitable previous aspect, of claim 1, wherein the heat exchange device comprises: a first coil array unit that exchanges heat with the first portion of the flow prior to entering the mixing plenum from the first direction; and a second coil array unit that exchanges heat with the second portion of the flow prior to entering the mixing plenum from the second direction.

Aspect D26. The system or device in accordance with aspect D24 or any suitable previous aspect, of claim 1, wherein the separate coil array unit further comprises a filter that filters contaminants from the flow of air.

Aspect D27. The system or device in accordance with aspect D12 or any suitable previous aspect, of claim 1, wherein a total weight of the HVAC product is determined to satisfy a defined weight constraint.

Aspect D28. The system or device in accordance with aspect D12 or any suitable previous aspect, of claim 1, wherein the mixing plenum comprises a single, axial fan that feed the supply flow to a vane.

Aspect D29. The system or device in accordance with aspect D12 or any suitable previous aspect, of claim 1, wherein the HVAC product is shipped to the site fully assembled as a single unit.

Aspect D30. A method of fabricating an air handler device, comprising: forming, by a device comprising a processor, a mixing plenum that is configured to receive multiple flows of air from multiple different ducts; forming, by the device, a fan device configured to receive a mixing plenum flow from the mixing plenum and to discharge a supply flow; forming, by the device, a supply plenum configured to receive the supply flow from the fan device; forming, by the device, a plurality of duct interfaces respectively configured to interface with a different one of a plurality of supply ducts; and forming, by the device, a plurality of thermal transfer units comprising a first thermal transfer unit and a second thermal transfer unit that are respectively situated in different ones of the plurality of duct interfaces, wherein the first thermal transfer unit is configured to a first temperature concurrently with the second thermal transfer unit being configured to a second temperature that differs from the first temperature.

Aspect D31. The method in accordance with aspect D30 or any suitable previous aspect, wherein the forming the mixing plenum comprising configuring the mixing plenum to receive return air and fresh air.

Aspect D32. The method in accordance with aspect D30 or any suitable previous aspect, wherein the forming the fan device comprises forming multiple fan devices situated between the mixing plenum and the supply plenum.

Aspect D33. The method in accordance with aspect D30 or any suitable previous aspect, further comprising forming, by the device, a filter device situated at an interface, wherein the interface is at least one of a mixing plenum interface or a supply plenum interface.

Aspect D34. The system or device in accordance with aspect D1 or any suitable previous aspect, of claim 1, that is configured according to a blowthrough configuration or a drawthrough configuration.

Aspect D35. The system or device in accordance with aspect D1 or any suitable previous aspect, of claim 1, that is configured according to an overhead discharge configuration or an under floor configuration.

Aspect D36. A heating, ventilation, and air conditioning (HVAC) product, comprising: an air handler component configured to circulate a flow of air within an HVAC system situated at a site the HVAC product is to be installed, wherein the air handler device comprises a bottom surface that is, relative to an installation at the site, on bottom of the air handler component and has a first height that is, relative to the installation, a height of the air handler component; and an air handler component configured to circulate a flow of air within an HVAC system situated at a site the HVAC product is to be installed, wherein the air handler device comprises a bottom surface that is, relative to an installation at the site, on bottom of the air handler component and has a first height that is, relative to the installation, a height of the air handler component.

What is claimed is:

1. An intake device, comprising:

an intake duct comprising:

a first opening by which a fluid enters the intake duct and a second opening by which the fluid exits the intake duct, wherein the first opening and the second opening are substantially circular about a longitudinal axis of the intake duct, and wherein a first circumference of the first opening is larger than a second circumference of the second opening; and an interior surface that extends from the first opening to the second opening, providing a passageway for a flow of the fluid;

a top cover, situated a distance from the first opening, that prevents the fluid from entering the intake duct in a direction along the longitudinal axis, and that permits the fluid to enter the intake duct in a radial direction that is radial about the longitudinal axis; and an inner funnel, comprising:

an upper portion that couples to the top cover;

a lower portion extends into the passageway; and an outer surf ace, spanning the upper portion and the lower portion, that is sloped, causing the flow of the fluid entering the intake device in the radial direction to change to the direction along the longitudinal axis;

wherein the outer surface and the interior surface are continuously tapered along the longitudinal axis such that a cross-sectional area of the passageway of the intake duct continuously decreases along the longitudinal axis.

2. The intake device of claim 1, wherein the interior surface of the intake duct provides a smoothly tapered surface that encompasses a substantially funnel-shaped passageway for the flow of the fluid.

3. The intake device of claim 1, wherein an angular difference of the change in direction of the flow, representing a difference between the radial direction and the direction along the longitudinal axis, is between 80 degrees and 100 degrees.

4. The intake device of claim 1, wherein an angular difference of the change in direction of the flow, representing a difference between the radial direction and the direction along the longitudinal axis, is approximately 90 degrees.

5. The intake device of claim 1, wherein a cross-section of the passageway of the intake duct has the cross-sectional area that is a difference between a first area of the interior surface of the intake duct at the cross-section and a second area of the outer surface of the inner funnel at the cross-section.

6. The intake device of claim 5, wherein the cross-sectional area of the cross-section of the passageway decreases when moving along the longitudinal axis from the first opening to the second opening.

7. The intake device of claim 6, wherein the cross-sectional area that decreases when moving from the first opening to the second opening is determined to cause the flow of the fluid in the passageway to increase in velocity while flowing toward the second opening.

8. The intake device of claim 7, wherein the increase in velocity is determined to have a damping effect on turbulence of the flow.

9. The intake device of claim 1, wherein geometries of the outer surface of the inner funnel and the interior surface of the intake duct are determined to cause the flow to be laminar.

10. The intake device of claim 9, wherein the geometries are determined to mitigate losses due to flow separation along bounding surfaces of a turning flow, and wherein the turning flow represents the flow entering in the radial direction and turning toward the longitudinal direction.

11. The intake device of claim 9, wherein the geometries are determined to cause at least a portion of the flow entering the intake device to follow an elliptical path when changing from the radial direction to the direction along the longitudinal axis.

12. An intake device, comprising:

an intake duct, having a cover plate that is configured to prevent a fluid from entering the intake duct in a longitudinal direction, wherein the intake duct is configured to receive, at a first end, the fluid in a radial direction and to discharge, at a second end, the fluid substantially in the longitudinal direction; and an inner funnel situated between the cover plate and the second end, wherein the inner funnel has a funnel geometry that causes the fluid to follow an elliptical path when changing from the radial direction to the longitudinal direction; and wherein the fluid flows through a passageway that, at least due to the funnel geometry and a geometry of the intake duct that are continuously tapered in the longitudinal direction, has a cross-sectional area that continuously decreases when moving in the longitudinal direction.

13. The intake device of claim 12, wherein the cross-sectional area that decreases when moving in the longitudinal direction is determined to cause the flow of the fluid in the passageway to increase in velocity while flowing in the longitudinal direction.

14. The intake device of claim 12, wherein the intake duct has a duct geometry configured to reduce a surface area normal to a flow of the fluid as the fluid flows from the first end to the second end.

15. The intake device of claim 14, wherein the duct geometry is determined to cause the flow to be laminar.

16. The intake device of claim 14, wherein the duct geometry is determined to mitigate losses due to flow separation along bounding surfaces of a turning flow, and wherein the turning flow represents the flow entering in the radial direction and turning toward the longitudinal direction.

17. A method of fabricating an intake device, comprising:

forming, by a device comprising a processor, an intake duct, having a cover plate that is configured to prevent a fluid from entering the intake device in a longitudinal direction, wherein the intake device is configured to receive, at a first end, the fluid in a radial direction and to discharge, at a second end, the fluid substantially in the longitudinal direction; and forming, by the device, an inner funnel situated between the cover plate and the second end, wherein the inner funnel has a funnel geometry that causes the fluid to follow an elliptical path when changing from the radial direction to the longitudinal direction.

18. The method of claim 17, wherein the forming the intake duct and the forming the inner funnel further comprises, determining, by the device, that geometries of the intake duct and the inner funnel cause a flow of the fluid through the intake device to be laminar.

19. The method of claim 17, wherein the forming the intake duct and the forming the inner funnel further comprises, determining, by the device, that geometries of the intake duct and the inner funnel result in a continuously decreasing cross-sectional area when moving along the longitudinal axis toward the second end.

20. A method of fabricating an intake device, comprising:

forming, by a device comprising a processor, an intake duct, having a cover plate that is configured to prevent a fluid from entering the intake device in a longitudinal direction, wherein the intake device is configured to receive, at a first end, the fluid in a radial direction and to discharge, at a second end, the fluid substantially in the longitudinal direction; and forming, by the device, an inner funnel situated between the cover plate and the second end, wherein the inner funnel has a funnel geometry that causes the fluid to follow an elliptical path when changing from the radial direction to the longitudinal direction; and wherein the funnel geometry and a geometry of the intake duct produce a passageway for the fluid that continuously tapers in the longitudinal direction, such that a cross-sectional area of the passageway continuously decreases when moving in the longitudinal direction.

* * * * *